US008195465B2

(12) United States Patent
Zopf et al.

(10) Patent No.: US 8,195,465 B2
(45) **Date of Patent: *Jun. 5, 2012**

(54) TIME-WARPING OF DECODED AUDIO SIGNAL AFTER PACKET LOSS

(75) Inventors: Robert W. Zopf, Rancho Santa Margarita, CA (US); Juin-Hwey Chen, Irvine, CA (US); Jes Thyssen, San Juan Capistrano, CA (US)

(73) Assignee: Broadcom Corporation, Irvine, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/227,239

(22) Filed: Sep. 7, 2011

(65) Prior Publication Data

US 2011/0320213 A1 Dec. 29, 2011

Related U.S. Application Data

(63) Continuation of application No. 11/838,908, filed on Aug. 15, 2007, now Pat. No. 8,024,192.

(60) Provisional application No. 60/853,461, filed on Oct. 23, 2006, provisional application No. 60/848,051, filed on Sep. 29, 2006, provisional application No. 60/848,049, filed on Sep. 29, 2006, provisional application No. 60/837,627, filed on Aug. 15, 2006.

(51) Int. Cl.
*G10L 13/06* (2006.01)

(52) U.S. Cl. ..... 704/267; 455/70; 455/45; 455/205; 455/307; 341/143; 700/94

(58) Field of Classification Search ..... 704/226–230, 704/500–504, 201, 200.1, 220, 203, 219, 704/267, 258; 455/70, 45, 205, 307, 701, 455/228; 341/243; 375/240; 700/94
See application file for complete search history.

(56) References Cited

U.S. PATENT DOCUMENTS 4,935,963 A 6/1990 Jain (Continued)

FOREIGN PATENT DOCUMENTS

EP 1096477 A2 5/2001

(Continued)

OTHER PUBLICATIONS

Serizawa et al., "A Packet Loss Concealment Method Using Pitch Waveform Repetition and Internal State Update on the Decoded Speech for the Sub-Band ADPCM Wideband Speech Codec", Speech Coding, IEEE Workshop Proceedings, Oct. 6-9, 2002, pp. 68-70).*

(Continued)

*Primary Examiner* — Vijay B Chawan
(74) *Attorney, Agent, or Firm* — Fiala & Weaver P.L.L.C.

(57) ABSTRACT

A technique is described for use in a decoder configured to decode a series of frames representing an encoded audio signal. The technique is for transitioning between a lost frame and one or more received frames following the lost frame in the series of frames. In accordance with the technique, an output audio signal associated with the lost frame is synthesized. An extrapolated signal is generated based on the synthesized output audio signal. A time lag is calculated between the extrapolated signal and a decoded audio signal associated with the received frame(s), wherein the time lag represents a phase difference between the extrapolated signal and the decoded audio signal. The decoded audio signal is time-warped based on the time lag, wherein time-warping the decoded audio signal comprises stretching or shrinking the decoded audio signal in the time domain.

31 Claims, 24 Drawing Sheets

U.S. PATENT DOCUMENTS

| | | | | |
|---|---|---|---|---|
| 6,351,730 | B2 * | 2/2002 | Chen | 704/229 |
| 6,408,267 | B1 | 6/2002 | Proust | |
| 6,549,587 | B1 | 4/2003 | Li | |
| 6,665,637 | B2 | 12/2003 | Bruhn | |
| 7,031,926 | B2 * | 4/2006 | Makinen et al. | 704/500 |
| 7,047,187 | B2 | 5/2006 | Cheng et al. | |
| 7,047,190 | B1 | 5/2006 | Kapilow | |
| 7,177,804 | B2 * | 2/2007 | Wang et al. | 704/219 |
| 7,233,893 | B2 * | 6/2007 | Sung et al. | 704/201 |
| 7,272,554 | B2 | 9/2007 | Serizawa et al. | |
| 7,467,072 | B2 * | 12/2008 | Adam | 703/2 |
| 7,467,082 | B2 | 12/2008 | Sung et al. | |
| 7,502,734 | B2 * | 3/2009 | Jelinek | 704/214 |
| 7,619,995 | B1 * | 11/2009 | El-Hennawey et al. | 370/260 |
| 7,693,710 | B2 * | 4/2010 | Jelinek et al. | 704/207 |
| 7,707,034 | B2 * | 4/2010 | Sun et al. | 704/262 |
| 7,805,293 | B2 | 9/2010 | Takada et al. | |
| 8,000,960 | B2 | 8/2011 | Chen et al. | |
| 8,005,678 | B2 | 8/2011 | Zopf et al. | |
| 8,024,192 | B2 | 9/2011 | Zopf et al. | |
| 8,041,562 | B2 | 10/2011 | Thyssen | |
| 8,078,458 | B2 | 12/2011 | Zopf et al. | |
| 2002/0080779 | A1 | 6/2002 | LeBlanc | |
| 2002/0102942 | A1 | 8/2002 | Taori et al. | |
| 2002/0123887 | A1 | 9/2002 | Unno | |
| 2003/0074197 | A1 | 4/2003 | Chen | |
| 2003/0200083 | A1 | 10/2003 | Serizawa et al. | |
| 2004/0078194 | A1 * | 4/2004 | Liljeryd et al. | 704/200.1 |
| 2005/0015242 | A1 | 1/2005 | Gracie et al. | |
| 2005/0154584 | A1 | 7/2005 | Jelinek et al. | |
| 2006/0045138 | A1 | 3/2006 | Black et al. | |
| 2007/0147518 | A1 * | 6/2007 | Bessette | 375/243 |
| 2007/0150262 | A1 | 6/2007 | Mori et al. | |
| 2007/0174047 | A1 | 7/2007 | Anderson et al. | |
| 2007/0213976 | A1 * | 9/2007 | Sung et al. | 704/201 |
| 2007/0225971 | A1 * | 9/2007 | Bessette | 704/203 |
| 2008/0027711 | A1 * | 1/2008 | Rajendran et al. | 704/201 |
| 2008/0027715 | A1 * | 1/2008 | Rajendran et al. | 704/205 |
| 2008/0033585 | A1 * | 2/2008 | Zopf | 700/94 |
| 2008/0046233 | A1 * | 2/2008 | Chen et al. | 704/211 |
| 2008/0046236 | A1 * | 2/2008 | Thyssen et al. | 704/228 |
| 2008/0046237 | A1 * | 2/2008 | Zopf et al. | 704/228 |
| 2008/0046248 | A1 | 2/2008 | Chen et al. | |
| 2008/0046249 | A1 | 2/2008 | Thyssen et al. | |
| 2008/0046252 | A1 * | 2/2008 | Zopf et al. | 704/501 |
| 2008/0092019 | A1 | 4/2008 | Lakaniemi et al. | |
| 2008/0126086 | A1 * | 5/2008 | Vos et al. | 704/225 |
| 2009/0232228 | A1 | 9/2009 | Thyssen | |
| 2009/0240492 | A1 * | 9/2009 | Zopf et al. | 704/219 |
| 2009/0299755 | A1 * | 12/2009 | Ragot et al. | 704/500 |
| 2009/0319264 | A1 * | 12/2009 | Yoshida et al. | 704/230 |
| 2010/0121646 | A1 * | 5/2010 | Ragot et al. | 704/500 |
| 2010/0228541 | A1 * | 9/2010 | Oshikiri | 704/203 |
| 2012/0010882 | A1 | 1/2012 | Thyssen et al. | |

FOREIGN PATENT DOCUMENTS

| | | | |
|---|---|---|---|
| EP | 1288916 | A2 | 3/2003 |
| EP | 1684267 | A2 | 7/2006 |
| WO | 2008/022176 | A2 | 2/2008 |
| WO | 2008/022181 | A2 | 2/2008 |
| WO | 2008/022184 | A2 | 2/2008 |
| WO | 2008/022200 | A2 | 2/2008 |
| WO | 2008/022207 | A2 | 2/2008 |
| WO | 2008/022207 | A3 | 4/2008 |
| WO | 2008/022176 | A3 | 5/2008 |
| WO | 2008/022181 | A3 | 5/2008 |
| WO | 2008/022184 | A3 | 6/2008 |
| WO | 2008/022200 | A3 | 6/2008 |

OTHER PUBLICATIONS

Goodman et al.,"Waveform Substitution Techniques for Recovering Missing Speech Segments in Packet Voice Communications", IEEE Transactions on Acoustics, Speech and Signal Processing, vol. 34, No. 6, Dec. 1986, pp. 1440-1448.

Thyssen Jes et al., "Detailed Description of the Broadcom G. 722 PLC Candidate Algorithm", ITU Study Group 16, Nov. 2006, 37 pages.

Thyssen Jes et al., "A Candidate for the ITU-T G.722 Packet Loss Concealment Standard", ICASSP, Apr. 15, 2007, pp. 549-552.

Shetty et al., "Improving the Robustness of the G.722 Wideband Speech Codec to Packet Losses for Voice over WLANS", Acoustics, Speech and Signal Processing, ICASSP Proceedings, IEEE International Conference, Toulouse, May 14-19, 2006, pp. V365-V368.

Serizawa et al., "A Packet Loss Concealment Method Using Pitch Waveform Repetition and Internal State Update on the Decoded Speech for the Sub-band ADPCM Wideband Speech CODEC", Speech Coding, IEEE Workshop Proceedings, Oct. 6-9, 2002, pp. 68-70.

Chibani et al., "Resynchronization of the Adaptive Codebook in a Constrained CELP CODEC After a Frame Erasure", Acoustics, Speech and Signal Processing, ICASSP 2006 Proceedings, IEEE International Conference, Toulouse, May 14-19, 2006, pp. 1-13.

"Coding of Speech at 16 kbit/s using low-delay code excited linear prediction", Frame or Packet loss concealment for the LD-celp decoder, May 1, 1999, 20 pages.

"7 KHz audio-coding within 64 kbits G.722 (11/88)", ITU-T Standard in Force (I), Dec. 25, 1988, 76 pages.

* cited by examiner

TIME-WARPING OF DECODED AUDIO SIGNAL AFTER PACKET LOSS

CROSS-REFERENCE TO RELATED APPLICATIONS

This application is a continuation of U.S. patent application Ser. No. 11/838,908, filed on Aug. 15, 2007. U.S. patent application Ser. No. 11/838,908 claims priority to provisional U.S. Patent Application No. 60/837,627, filed Aug. 15, 2006, provisional U.S. Patent Application No. 60/848,049, filed Sep. 29, 2006, provisional U.S. Patent Application No. 60/848,051, filed Sep. 29, 2006 and provisional U.S. Patent Application No. 60/853,461, filed Oct. 23, 2006. Each of these applications is incorporated by reference herein in its entirety.

BACKGROUND OF THE INVENTION

1. Field of the Invention

The present invention relates to systems and methods for concealing the quality-degrading effects of packet loss in a speech or audio coder.

2. Background Art

In digital transmission of voice or audio signals through packet networks, the encoded voice/audio signals are typically divided into frames and then packaged into packets, where each packet may contain one or more frames of encoded voice/audio data. The packets are then transmitted over the packet networks. Sometimes some packets are lost, and sometimes some packets arrive too late to be useful, and therefore are deemed lost. Such packet loss will cause significant degradation of audio quality unless special techniques are used to conceal the effects of packet loss.

There exist prior-art packet loss concealment (PLC) methods for block-independent coders or full-band predictive coders based on extrapolation of the audio signal. Such PLC methods include the techniques described in U.S. patent application Ser. No. 11/234,291 to Chen entitled "Packet Loss Concealment for Block-Independent Speech Codecs" and U.S. patent application Ser. No. 10/183,608 to Chen entitled "Method and System for Frame Erasure Concealment for Predictive Speech Coding Based on Extrapolation of Speech Waveform." However, the techniques described in these applications cannot be directly applied to sub-band predictive coders such as the ITU-T Recommendation G.722 wideband speech coder because there are sub-band-specific structural issues that are not addressed by those techniques. Furthermore, for each sub-band the G.722 coder uses an Adaptive Differential Pulse Code Modulation (ADPCM) predictive coder that uses sample-by-sample backward adaptation of the quantizer step size and predictor coefficients based on a gradient method, and this poses special challenges that are not addressed by prior-art PLC techniques. Therefore, there is a need for a suitable PLC method specially designed for sub-band predictive coders such as G.722.

SUMMARY OF THE INVENTION

The present invention is useful for concealing the quality-degrading effects of packet loss in a sub-band predictive coder. It specifically addresses some sub-band-specific architectural issues when applying audio waveform extrapolation techniques to such sub-band predictive coders. It also addresses the special PLC challenges for the backward-adaptive ADPCM coders in general and the G.722 sub-band ADPCM coder in particular.

In particular, a method is described herein for use in a decoder configured to decode a series of frames representing an encoded audio signal. The method is for transitioning between a lost frame and one or more received frames following the lost frame in the series of frames. In accordance with the method, an output audio signal associated with the lost frame is synthesized. An extrapolated signal is generated based on the synthesized output audio signal. A time lag is calculated between the extrapolated signal and a decoded audio signal associated with the received frame(s), wherein the time lag represents a phase difference between the extrapolated signal and the decoded audio signal. The decoded audio signal is time-warped based on the time lag, wherein time-warping the decoded audio signal comprises stretching or shrinking the decoded audio signal in the time domain.

A system is also described herein. The system includes a decoder, an audio signal synthesizer, and time-warping logic. The decoder is configured to decode received frames in a series of frames representing an encoded audio signal. The audio signal synthesizer is configured to synthesize an output audio signal associated with a lost frame in the series of frames. The time-warping logic is configured to generate an extrapolated signal based on the synthesized output audio signal, to calculate a time lag between the extrapolated signal and a decoded audio signal associated with one or more received frames following the lost frame in the series of frames, and to time-warp the decoded audio signal based on the time lag. The time lag represents a phase difference between the extrapolated signal and the decoded audio signal and time-warping the decoded audio signal comprises stretching or shrinking the decoded audio signal in the time domain.

A computer program product is also described herein. The computer program product includes a computer-readable medium having computer program logic recorded thereon for enabling a processor to transition between a lost frame and one or more received frames following the lost frame in a series of frames representing an encoded audio signal. The computer program logic includes first means, second means, third means and fourth means. The first means is for enabling the processor to synthesize an output audio signal associated with the lost frame. The second means is for enabling the processor to generate an extrapolated signal based on the synthesized output audio signal. The third means is for enabling the processor to calculate a time lag between the extrapolated signal and a decoded audio signal associated with the received frame(s), wherein the time lag represents a phase difference between the extrapolated signal and the decoded audio signal. The fourth means is for enabling the processor to time-warp the decoded audio signal based on the time lag, wherein time-warping the decoded audio signal comprises stretching or shrinking the decoded audio signal in the time domain.

Further features and advantages of the present invention, as well as the structure and operation of various embodiments of the present invention, are described in detail below with reference to the accompanying drawings. It is noted that the invention is not limited to the specific embodiments described herein. Such embodiments are presented herein for illustrative purposes only. Additional embodiments will be apparent to persons skilled in the art based on the teachings contained herein.

BRIEF DESCRIPTION OF THE DRAWINGS/FIGURES

The accompanying drawings, which are incorporated herein and form a part of the specification, illustrate one or more embodiments of the present invention and, together with the description, further serve to explain the purpose, advantages, and principles of the invention and to enable a person skilled in the art to make and use the invention.

Figure 12A:
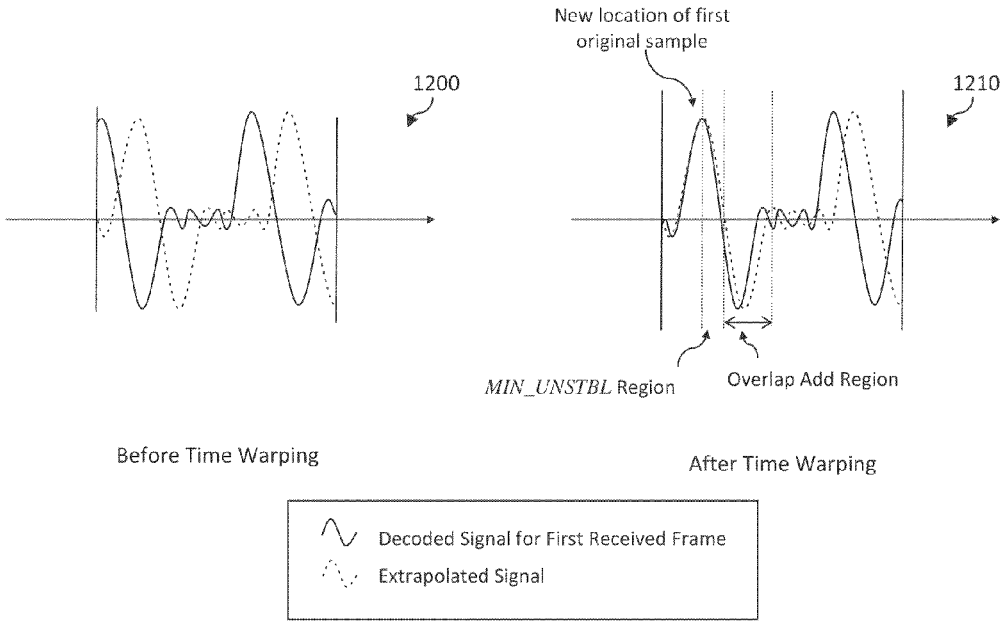
FIG. 12A depicts the application of time-warping to a decoded speech signal that leads an extrapolated speech signal in accordance with an embodiment of the present invention.
Figure 12B:
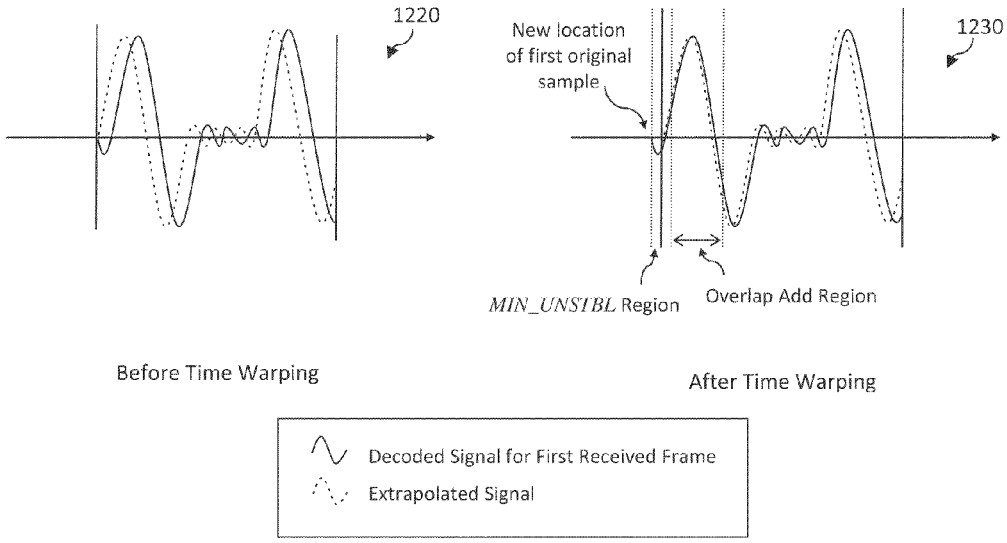
Figure 12C:
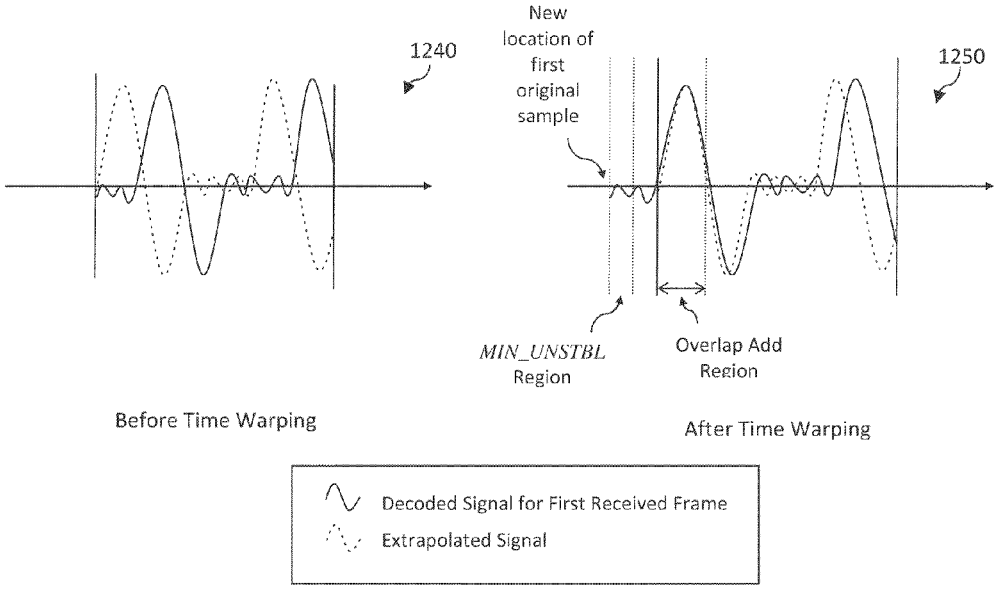

FIGS. 12B and 12C each depict the application of time-warping to a decoded speech signal that lags an extrapolated speech signal in accordance with an embodiment of the present invention.

Figure 13:
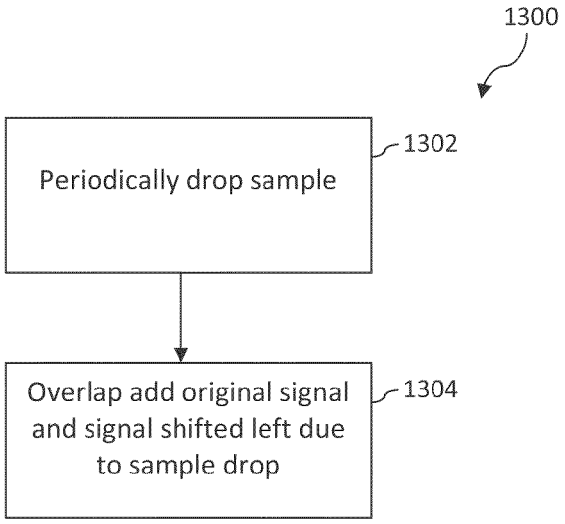

FIG. 13 depicts a flowchart of one method for performing time-warping to shrink a signal along a time axis in accordance with an embodiment of the present invention.

Figure 14:
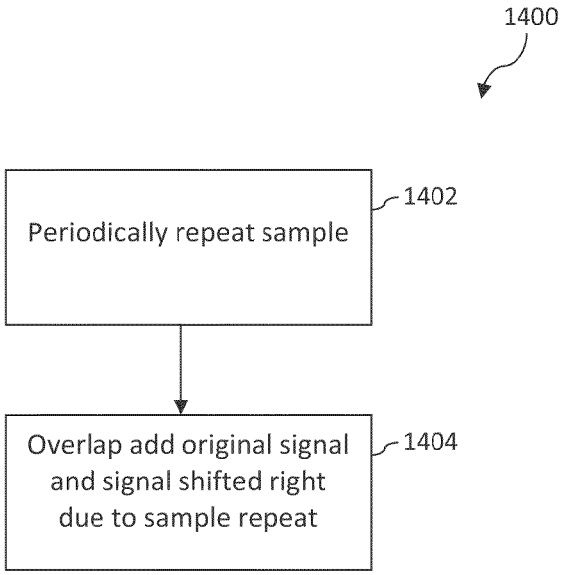

FIG. 14 depicts a flowchart of one method for performing time-warping to stretch a signal along a time axis in accordance with an embodiment of the present invention.

Figure 15:
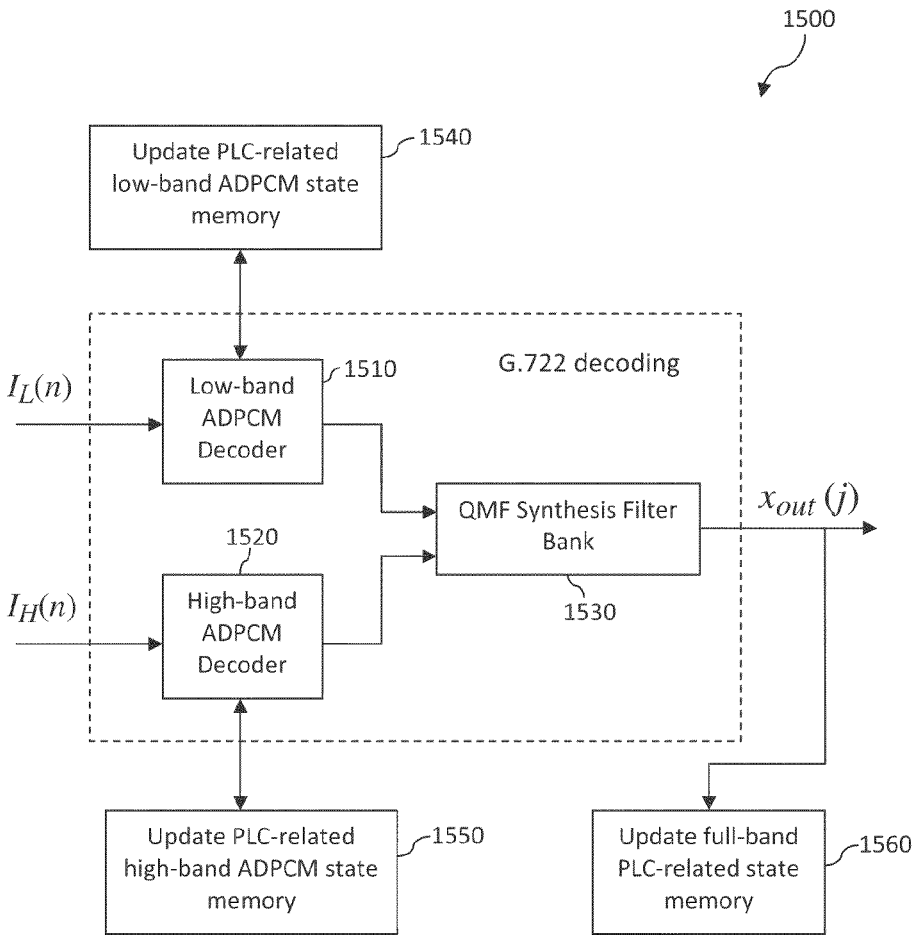

FIG. 15 is a block diagram of logic configured to process received frames beyond a predefined number of received frames after a packet loss in a decoder/PLC system in accordance with an embodiment of the present invention.

Figure 16:
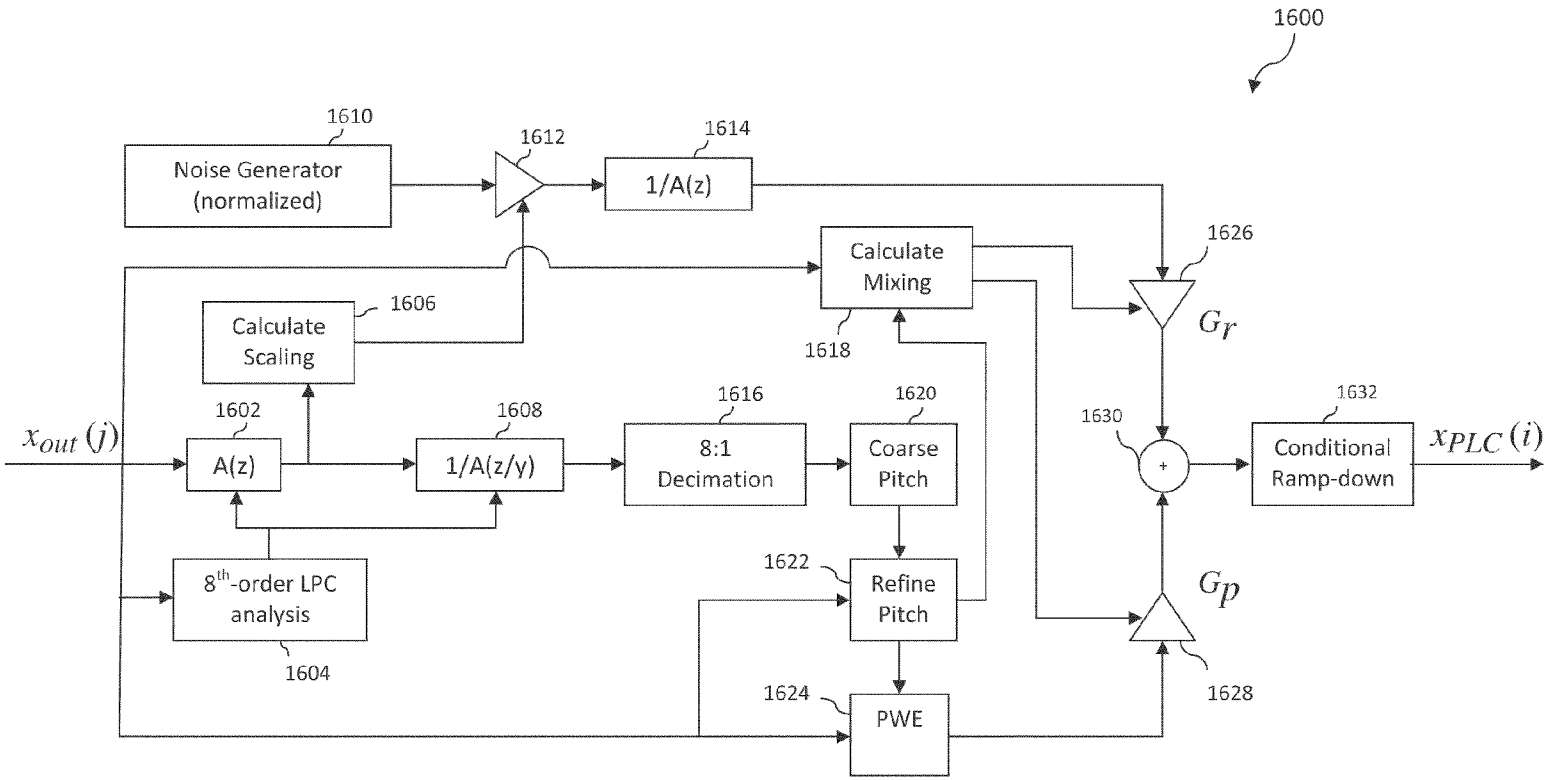

FIG. 16 is a block diagram of logic configured to perform waveform extrapolation to produce an output speech signal associated with a lost frame in a decoder/PLC system in accordance with an embodiment of the present invention.

Figure 17:
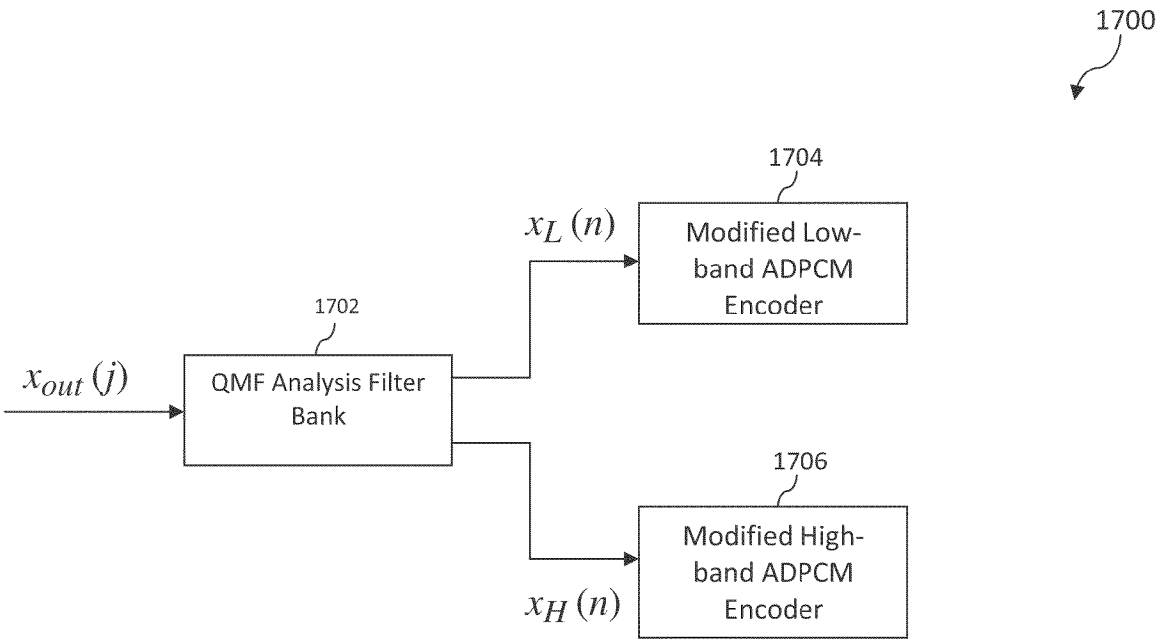

FIG. 17 is a block diagram of logic configured to update the states of sub-band ADPCM decoders within a decoder/PLC system in accordance with an embodiment of the present invention.

Figure 18:
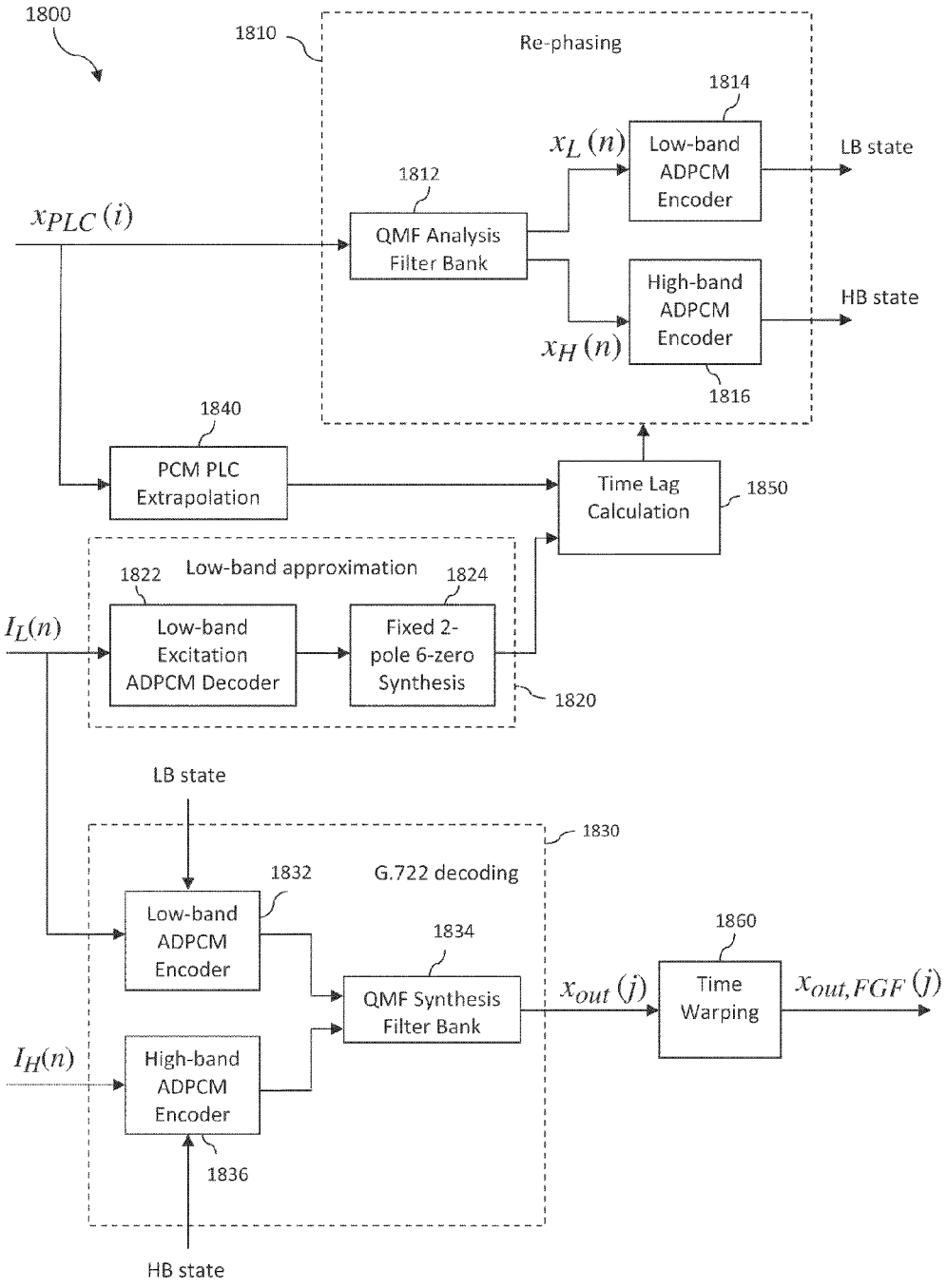

FIG. 18 is a block diagram of logic configured to perform re-phasing and time-warping in a decoder/PLC system in accordance with an embodiment of the present invention.

Figure 19:
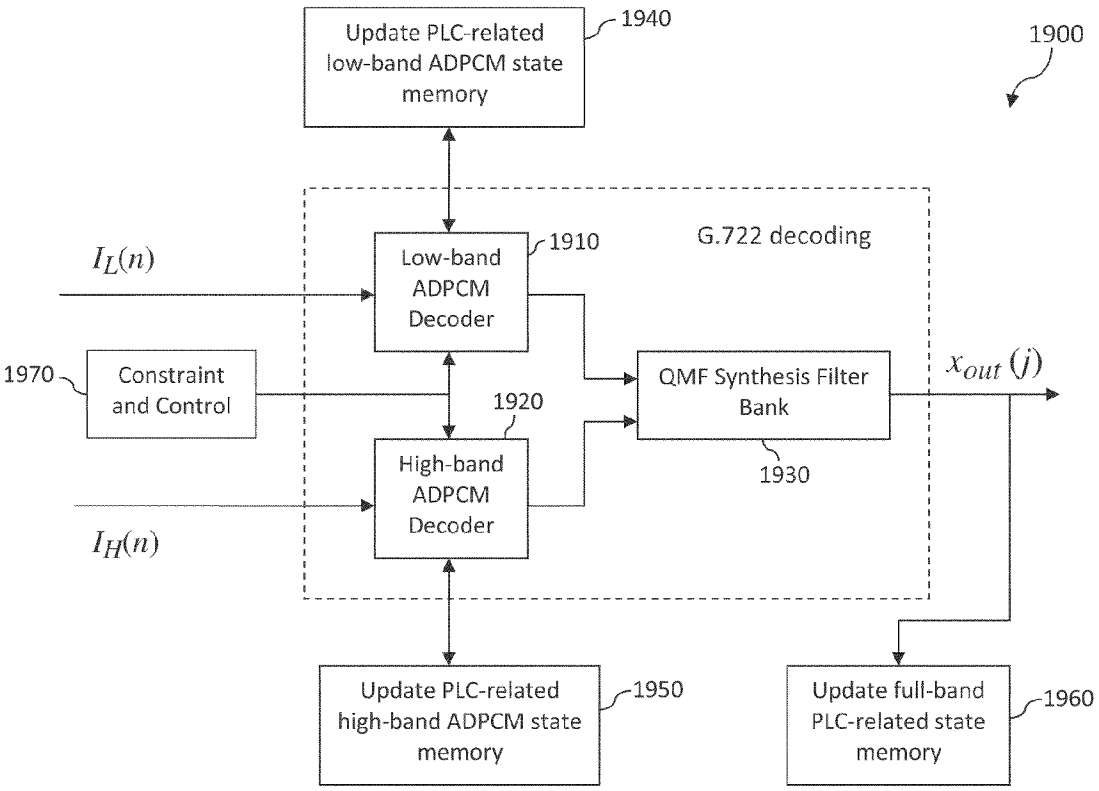

FIG. 19 is a block diagram of logic configured to perform constrained and controlled decoding of good frames received after a packet loss in a decoder/PLC system in accordance with an embodiment of the present invention.

Figure 20:
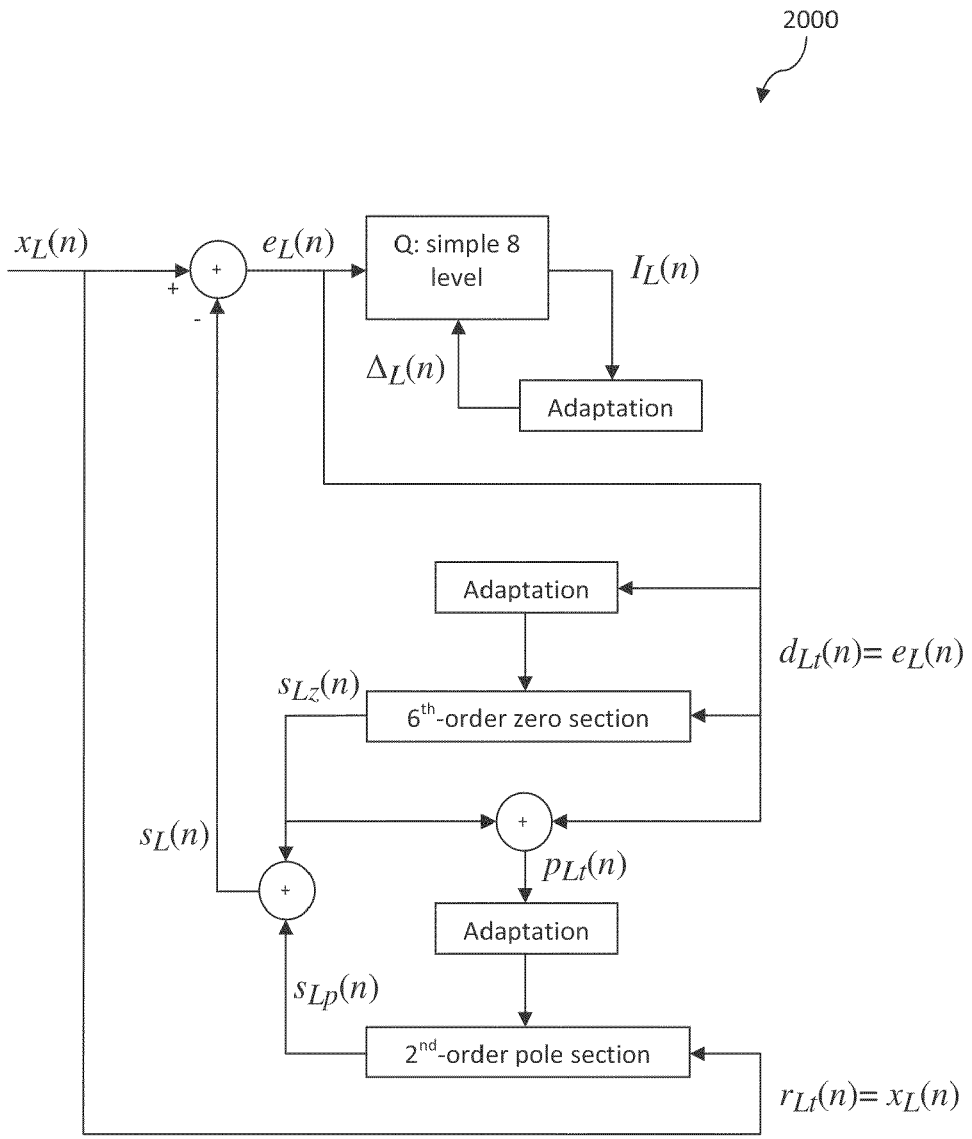

FIG. 20 is a block diagram of a simplified low-band ADPCM encoder used for updating the internal state of a low-band ADPCM decoder during packet loss in accordance with an embodiment of the present invention.

Figure 21:
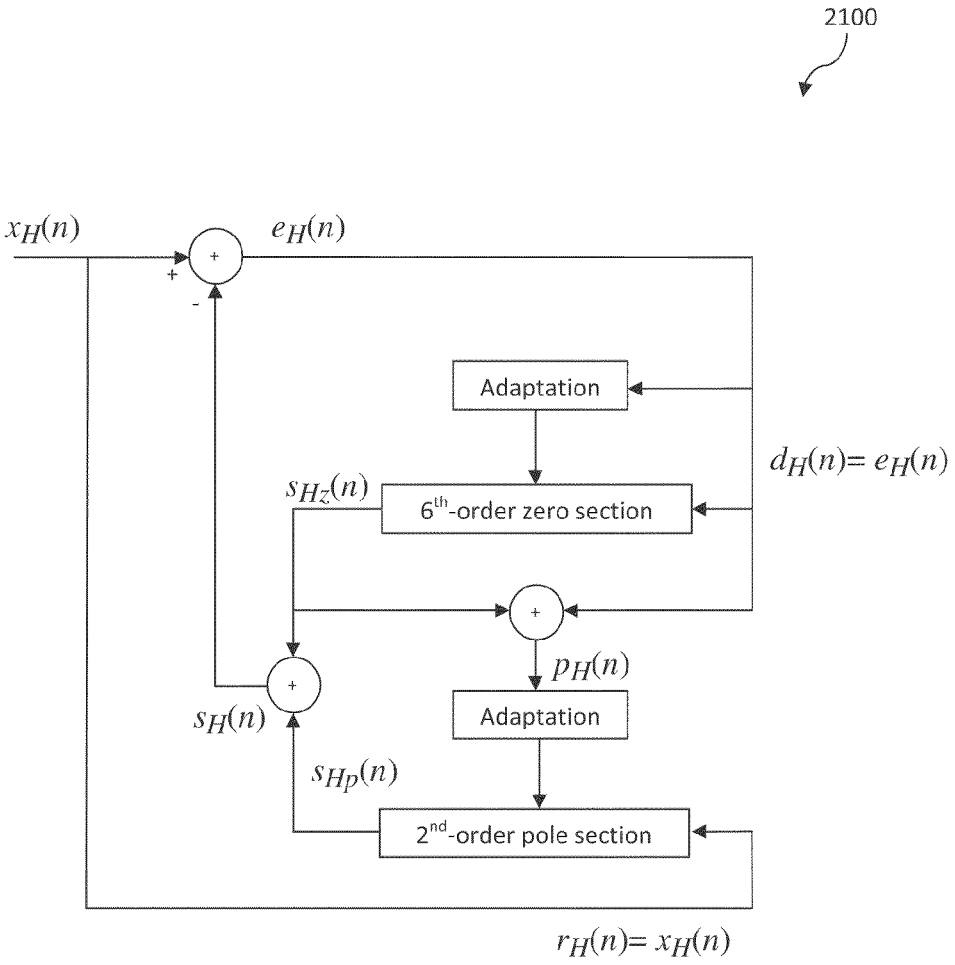

FIG. 21 is a block diagram of a simplified high-band ADPCM encoder used for updating the internal state of a high-band ADPCM decoder during packet loss in accordance with an embodiment of the present invention.

Figure 22A:
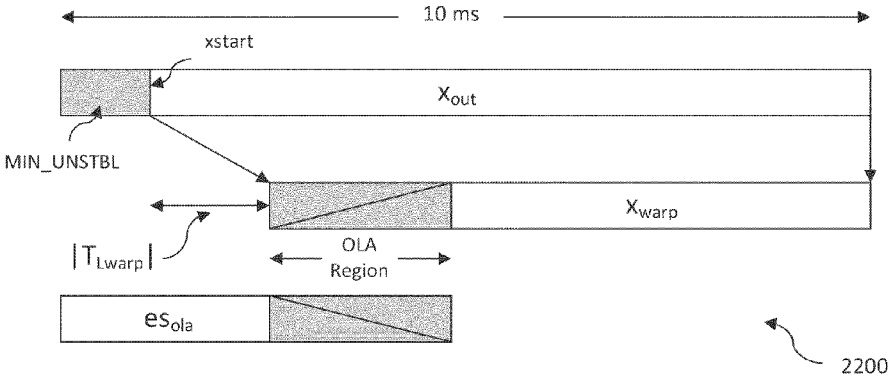
Figure 22B:
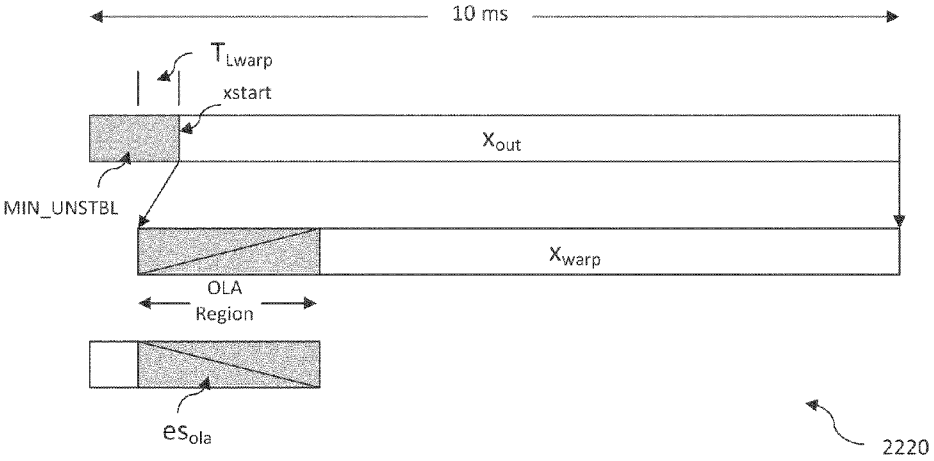
Figure 22C:
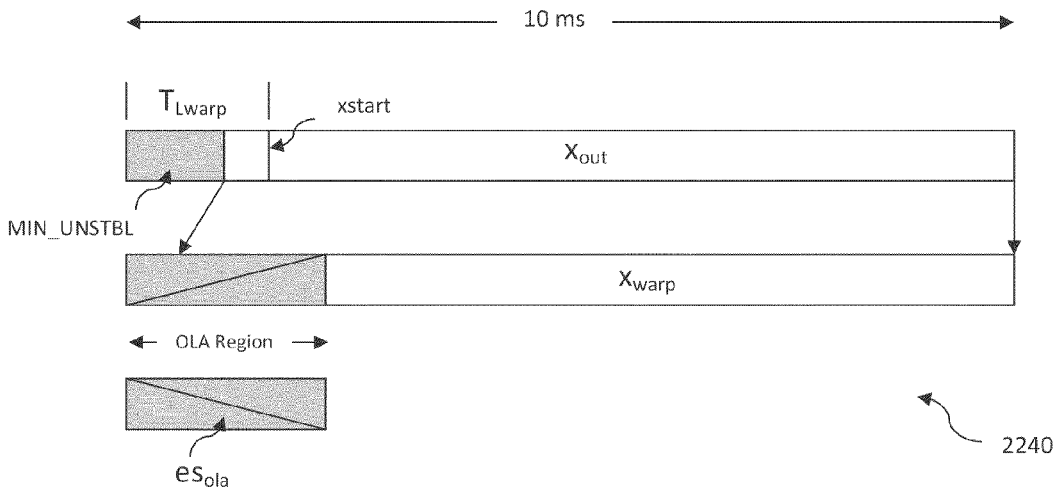

FIGS. 22A, 22B and 22C each depict timelines that show the application of time-warping of a decoded speech signal in accordance with an embodiment of the present invention.

Figure 23:
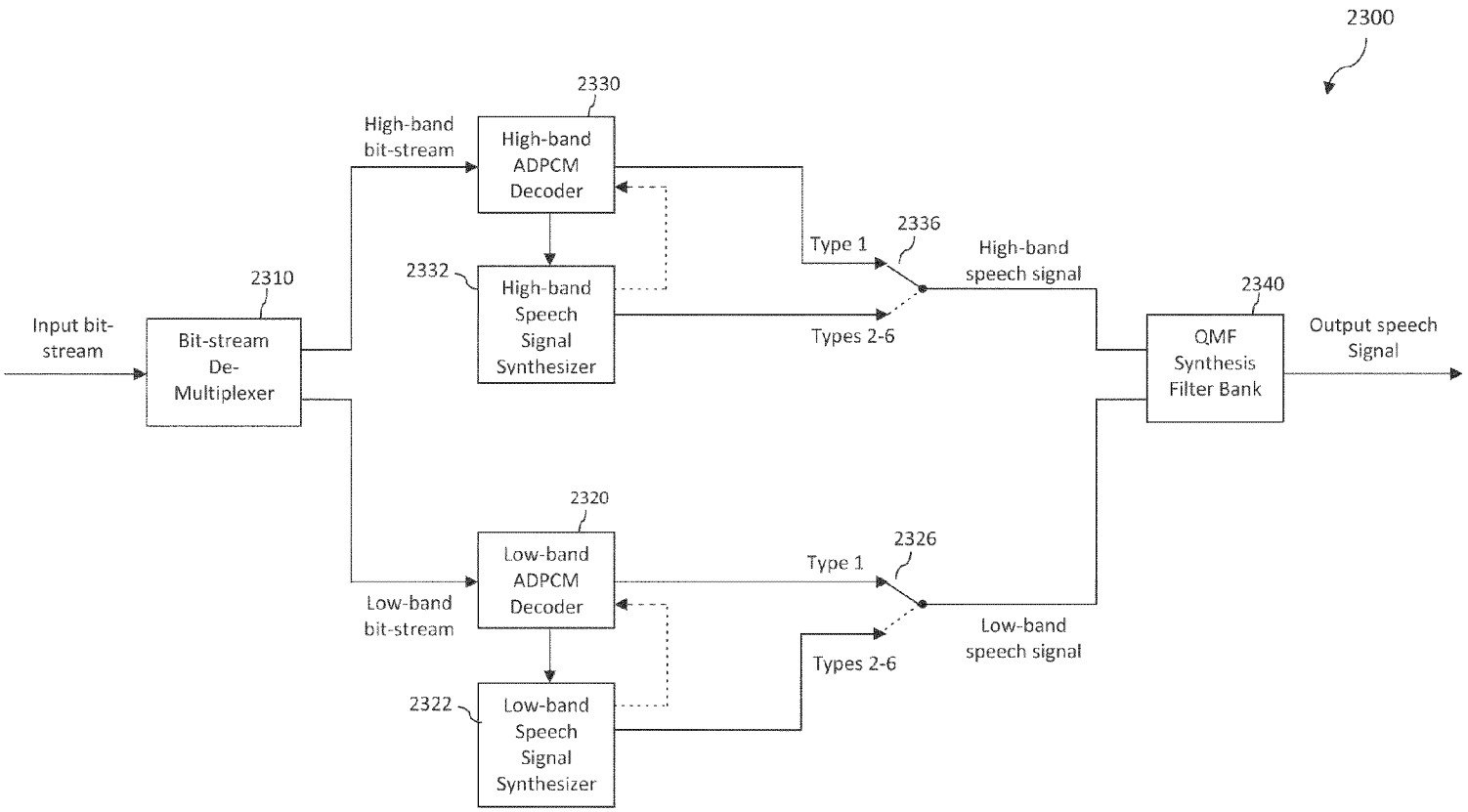

FIG. 23 is a block diagram of an alternative decoder/PLC system in accordance with an embodiment of the present invention.

Figure 24:
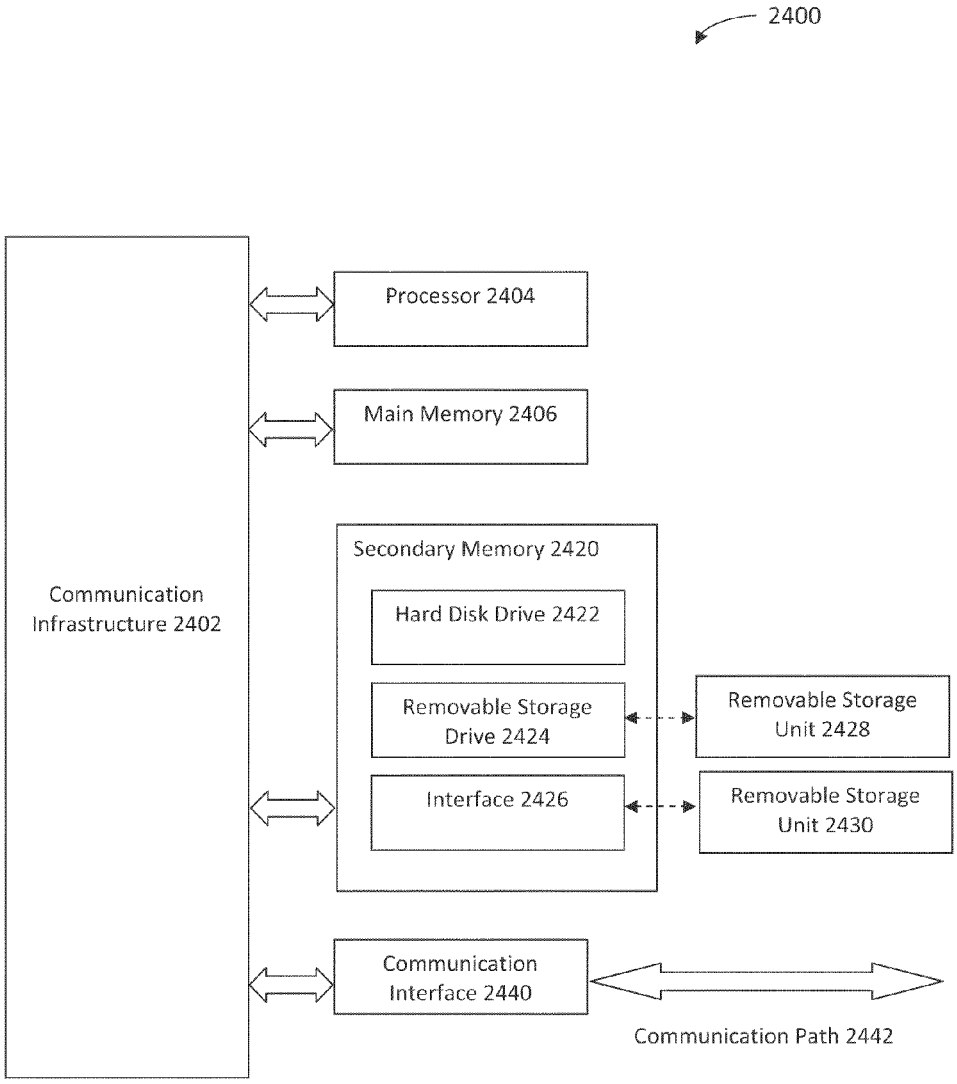

FIG. 24 is a block diagram of a computer system in which an embodiment of the present invention may be implemented.

The features and advantages of the present invention will become more apparent from the detailed description set forth below when taken in conjunction with the drawings. The drawing in which an element first appears is indicated by the leftmost digit(s) in the corresponding reference number.

DETAILED DESCRIPTION OF INVENTION

A. Introduction

The following detailed description of the present invention refers to the accompanying drawings that illustrate exemplary embodiments consistent with this invention. Other embodiments are possible, and modifications may be made to the illustrated embodiments within the spirit and scope of the present invention. Therefore, the following detailed description is not meant to limit the invention. Rather, the scope of the invention is defined by the appended claims.

It will be apparent to persons skilled in the art that the present invention, as described below, may be implemented in many different embodiments of hardware, software, firmware, and/or the entities illustrated in the drawings. Any actual software code with specialized control hardware to implement the present invention is not limiting of the present invention. Thus, the operation and behavior of the present invention will be described with the understanding that modifications and variations of the embodiments are possible, given the level of detail presented herein.

It should be understood that while the detailed description of the invention set forth herein may refer to the processing of speech signals, the invention may be also be used in relation to the processing of other types of audio signals as well. Therefore, the terms "speech" and "speech signal" are used herein purely for convenience of description and are not limiting. Persons skilled in the relevant art(s) will appreciate that such terms can be replaced with the more general terms "audio" and "audio signal." Furthermore, although speech and audio signals are described herein as being partitioned into frames, persons skilled in the relevant art(s) will appreciate that such signals may be partitioned into other discrete segments as well, including but not limited to sub-frames. Thus, descriptions herein of operations performed on frames are also intended to encompass like operations performed on other segments of a speech or audio signal, such as sub-frames.

Additionally, although the following description discusses the loss of frames of an audio signal transmitted over packet networks (termed "packet loss"), the present invention is not limited to packet loss concealment (PLC). For example, in wireless networks, frames of an audio signal may also be lost or erased due to channel impairments. This condition is termed "frame erasure." When this condition occurs, to avoid substantial degradation in output speech quality, the decoder in the wireless system needs to perform "frame erasure concealment" (FEC) to try to conceal the quality-degrading effects of the lost frames. For a PLC or FEC algorithm, the packet loss and frame erasure amount to the same thing: certain transmitted frames are not available for decoding, so the PLC or FEC algorithm needs to generate a waveform to fill up the waveform gap corresponding to the lost frames and thus conceal the otherwise degrading effects of the frame loss. Because the terms FEC and PLC generally refer to the same kind of technique, they can be used interchangeably. Thus, for the sake of convenience, the term "packet loss concealment," or PLC, is used herein to refer to both.

B. Review of Sub-Band Predictive Coding

In order to facilitate a better understanding of the various embodiments of the present invention described in later sections, the basic principles of sub-band predictive coding are first reviewed here. In general, a sub-band predictive coder may split an input speech signal into N sub-bands where $N \geqq 2$. Without loss of generality, the two-band predictive coding system of the ITU-T G.722 coder will be described here as an example. Persons skilled in the relevant art(s) will readily be able to generalize this description to any N-band sub-band predictive coder.

Figure 1:
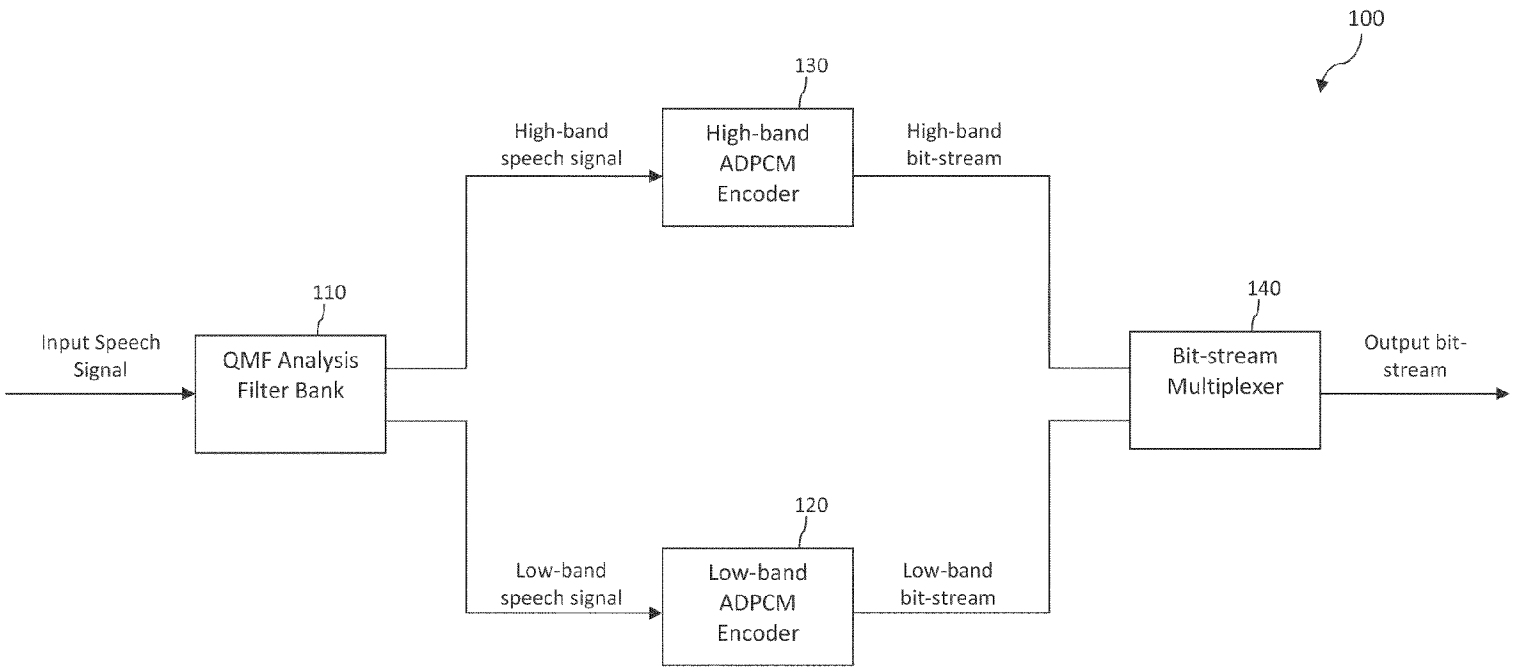
FIG. 1 (PRIOR ART)
FIG. 1 shows an encoder structure of a conventional ITU-T G.722 sub-band predictive coder.

FIG. 1 shows a simplified encoder structure 100 of a G.722 sub-band predictive coder. Encoder structure 100 includes a quadrature mirror filter (QMF) analysis filter bank 110, a low-band adaptive differential pulse code modulation (ADPCM) encoder 120, a high-band ADPCM encoder 130, and a bit-stream multiplexer 140. QMF analysis filter bank 110 splits an input speech signal into a low-band speech signal and a high-band speech signal. The low-band speech signal is encoded by low-band ADPCM encoder 120 into a low-band bit-stream. The high-band speech signal is encoded by high-band ADPCM encoder 130 into a high-band bit-stream. Bit-stream multiplexer 140 multiplexes the low-band bit-stream and the high-band bit-stream into a single output bit-stream. In the packet transmission applications discussed herein, this output bit-stream is packaged into packets and then transmitted to a sub-band predictive decoder 200, which is shown in FIG. 2.

Figure 2:
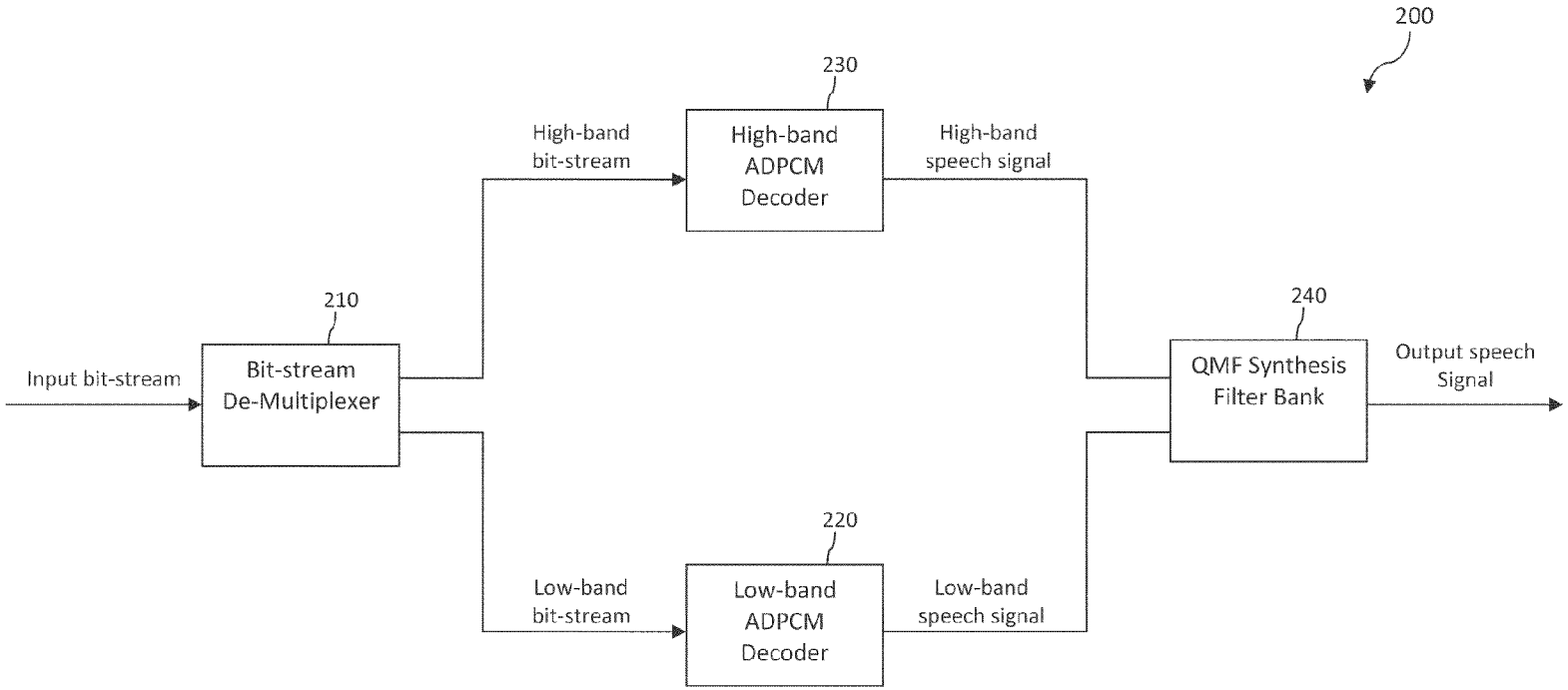
FIG. 2 (PRIOR ART)
FIG. 2 shows a decoder structure of a conventional ITU-T G.722 sub-band predictive coder.

As shown in FIG. 2, decoder 200 includes a bit-stream de-multiplexer 210, a low-band ADPCM decoder 220, a high-band ADPCM decoder 230, and a QMF synthesis filter bank 240. Bit-stream de-multiplexer 210 separates the input bit-stream into the low-band bit-stream and the high-band bit-stream. Low-band ADPCM decoder 220 decodes the low-band bit-stream into a decoded low-band speech signal. High-band ADPCM decoder 230 decodes the high-band bit-stream into a decoded high-band speech signal. QMF synthesis filter bank 240 then combines the decoded low-band speech signal and the decoded high-band speech signal into the full-band output speech signal.

Further details concerning the structure and operation of encoder 100 and decoder 200 may be found ITU-T Recommendation G.722, the entirety of which is incorporated by reference herein.

C. Packet Loss Concealment for a Sub-Band Predictive Coder Based on Extrapolation of Full-Band Speech Waveform A high quality PLC system and method in accordance with one embodiment of the present invention will now be described. An overview of the system and method will be provided in this section, while further details relating to a specific implementation of the system and method will be described below in Section D. The example system and method is configured for use with an ITU-T Recommendation G.722 speech coder. However, persons skilled in the relevant art(s) will readily appreciate that many of the concepts described herein in reference to this particular embodiment may advantageously be used to perform PLC in other types of sub-band predictive speech coders as well as in other types of speech and audio coders in general.

As will be described in more detail herein, this embodiment performs PLC in the 16 kHz output domain of a G.722 speech decoder. Periodic waveform extrapolation is used to fill in a waveform associated with lost frames of a speech signal, wherein the extrapolated waveform is mixed with filtered noise according to signal characteristics prior to the loss. To update the states of the sub-band ADPCM decoders, the extrapolated 16 kHz signal is passed through a QMF analysis filter bank to generate sub-band signals, and the sub-band signals are then processed by simplified sub-band ADPCM encoders. Additional processing takes place after each packet loss in order to provide a smooth transition from the extrapolated waveform associated with the lost frames to a normally-decoded waveform associated with the good frames received after the packet loss. Among other things, the states of the sub-band ADPCM decoders are phase aligned with the first good frame received after a packet loss and the normally-decoded waveform associated with the first good frame is time warped in order to align with the extrapolated waveform before the two are overlap-added to smooth the transition. For extended packet loss, the system and method gradually mute the output signal.

Figure 3:
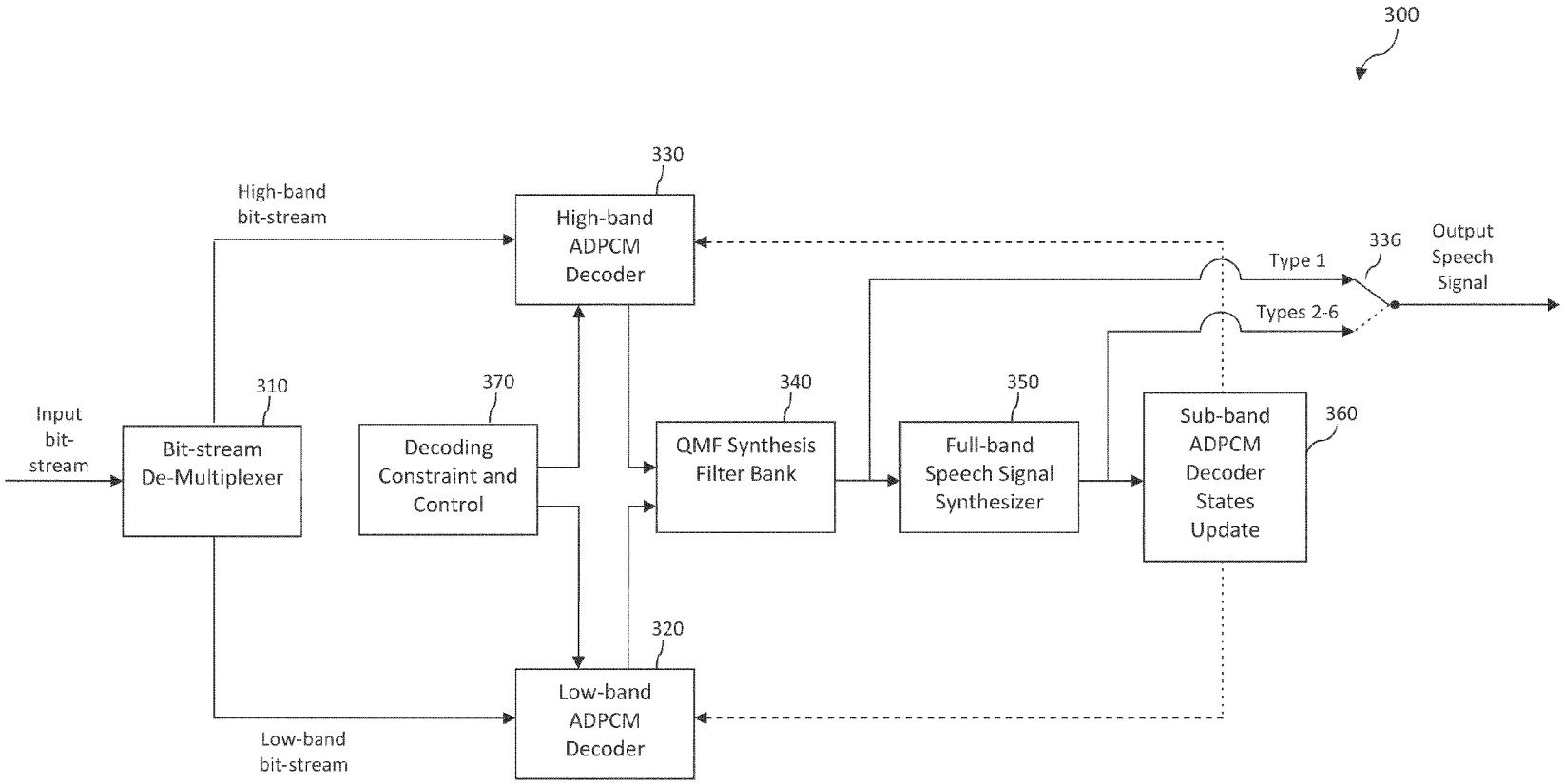
FIG. 3 is a block diagram of a decoder/PLC system in accordance with an embodiment of the present invention.

FIG. 3 is a high-level block diagram of a G.722 speech decoder 300 that implements such PLC functionality. Although decoder/PLC system 300 is described herein as including a G.722 decoder, persons skilled in the relevant art(s) will appreciate that many of the concepts described herein may be generally applied to any N-band sub-band predictive coding system. Similarly, the predictive coder for each sub-band does not have to be an ADPCM coder as shown in FIG. 3, but can be any general predictive coder, and can be either forward-adaptive or backward-adaptive.

As shown in FIG. 3, decoder/PLC system 300 includes a bit-stream de-multiplexer 310, a low-band ADPCM decoder 320, a high-band ADPCM decoder 330, a switch 336, a QMF synthesis filter bank 340, a full-band speech signal synthesizer 350, a sub-band ADPCM decoder states update module 360, and a decoding constraint and control module 370.

As used herein, the term "lost frame" or "bad frame" refers to a frame of a speech signal that is not received at decoder/PLC system 300 or that is otherwise deemed unsuitable for normal decoding operations. A "received frame" or "good frame" is a frame of speech signal that is received normally at decoder/PLC system 300. A "current frame" is a frame that is currently being processed by decoder/PLC system 300 to produce an output speech signal, while a "previous frame" is a frame that was previously processed by decoder/PLC system 300 to produce an output speech signal. The terms "current frame" and "previous frame" may be used to refer both to received frames as well as lost frames for which PLC operations are being performed.

Figure 4:
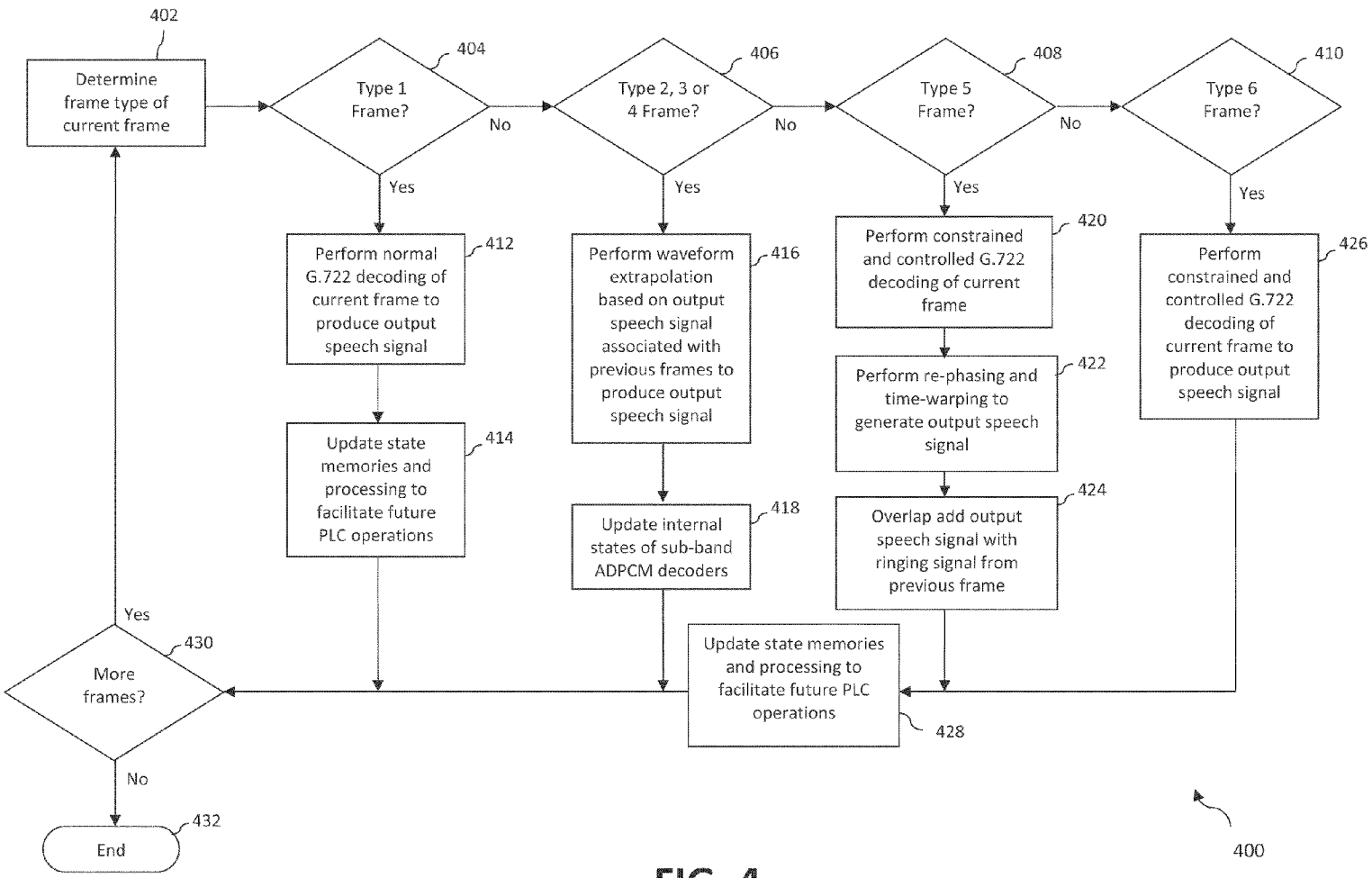
FIG. 4 illustrates a flowchart of a method for processing frames to produce an output speech signal in a decoder/PLC system in accordance with an embodiment of the present invention.
Figure 5:
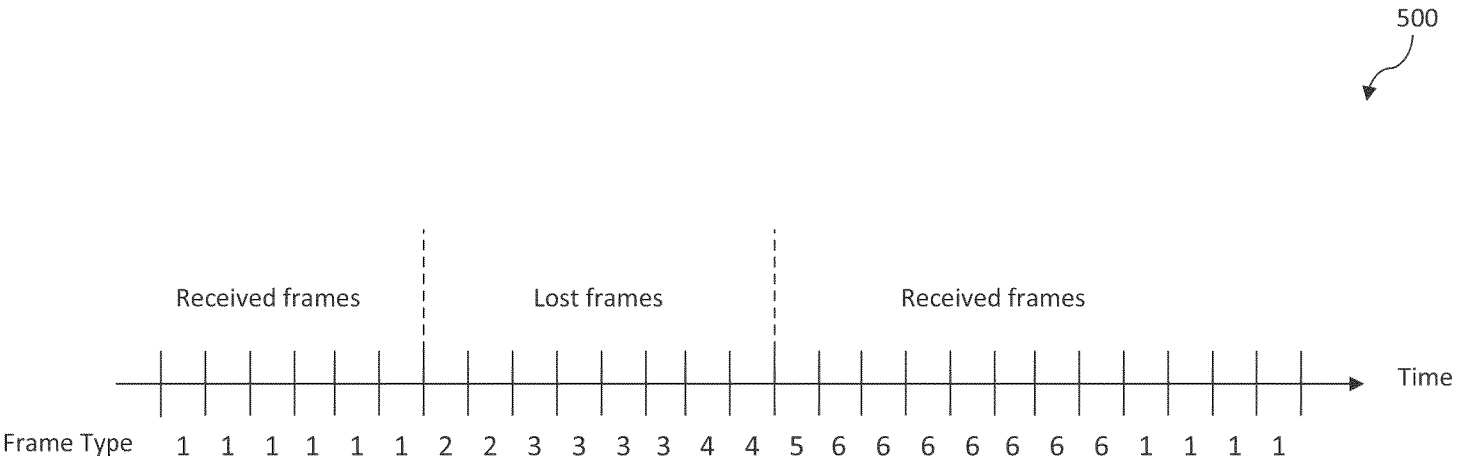
FIG. 5 is a timing diagram showing different types of frames that may be processed by a decoder/PLC system in accordance with an embodiment of the present invention.

The manner in which decoder/PLC system 300 operates will now be described with reference to flowchart 400 of FIG. 4. As shown in FIG. 4, the method of flowchart 400 begins at step 402, in which decoder/PLC system 300 determines the frame type of the current frame. Decoder/PLC system 300 distinguishes between six different types of frames, denoted Types 1 through 6, respectively. FIG. 5 provides a time line 500 that illustrates the different frame types. A Type 1 frame is any received frame beyond the eighth received frame after a packet loss. A Type 2 frame is either of the first and second lost frames associated with a packet loss. A Type 3 frame is any of the third through sixth lost frames associated with a packet loss. A Type 4 frame is any lost frame beyond the sixth frame associated with a packet loss. A Type 5 frame is any received frame that immediately follows a packet loss. Finally, a Type 6 frame is any of the second through eighth received frames that follow a packet loss. Persons skilled in the relevant art(s) will readily appreciate that other schemes for classifying frame types may be used in accordance with alternative embodiments of the present invention. For example, in a system having a different frame size, the number of frames within each frame type may be different than that above. Also for a different codec (i.e., a non-G.722 codec), the number of frames within each frame type may be different.

The manner in which decoder/PLC system 300 processes the current frame to produce an output speech signal is determined by the frame type of the current frame. This is reflected in FIG. 4 by the series of decision steps 404, 406, 408 and 410. In particular, if it is determined in step 402 that the current frame is a Type 1 frame, then a first sequence of processing steps are performed to produce the output speech signal as shown at decision step 404. If it is determined in step 402 that the current frame is Type 2, Type 3 or Type 4 frame, then a second sequence of processing steps are performed to produce the output speech signal as shown at decision step 406. If it is determined in step 402 that the current frame is a Type 5 frame, then a third sequence of processing steps are performed to produce the output speech signal as shown at decision step 408. Finally, if it is determined in step 402 that the current frame is a Type 6 frame, then a fourth sequence of processing steps are performed to produce the output speech signal as shown at decision step 410. The processing steps associated with each of the different frame types will be described below.

After each sequence of processing steps is performed, a determination is made at decision step 430 as to whether there are additional frames to process. If there are additional frames to process, then processing returns to step 402. However, if there are no additional frames to process, then processing ends as shown at step 432.

1. Processing of Type 1 Frames

As shown at step 412 of flowchart 400, if the current frame is a Type 1 frame then decoder/PLC system 300 performs normal G.722 decoding of the current frame. Consequently, blocks 310, 320, 330, and 340 of decoder/PLC system 300 perform exactly the same functions as their counterpart blocks 210, 220, 230, and 240 of conventional G.722 decoder 200, respectively. Specifically, bit-stream de-multiplexer 310 separates the input bit-stream into a low-band bit-stream and a high-band bit-stream. Low-band ADPCM decoder 320 decodes the low-band bit-stream into a decoded low-band speech signal. High-band ADPCM decoder 330 decodes the high-band bit-stream into a decoded high-band speech signal. QMF synthesis filter bank 340 then re-combines the decoded low-band speech signal and the decoded high-band speech signal into the full-band speech signal. During processing of Type 1 frames, switch 336 is connected to the upper position labeled "Type 1," thus taking the output signal of QMF synthesis filter bank 340 as the final output speech signal of decoder/PLC system 300 for Type 1 frames.

After the completion of step 412, decoder/PLC system 300 updates various state memories and performs some processing to facilitate PLC operations that may be performed for future lost frames, as shown at step 414. The state memories include a PLC-related low-band ADPCM decoder state memory, a PLC-related high-band ADPCM decoder state memory, and a full-band PLC-related state memory. As part of this step, full-band speech signal synthesizer 350 stores the output signal of the QMF synthesis filter bank 340 in an internal signal buffer in preparation for possible speech waveform extrapolation during the processing of a future lost frame. Sub-band ADPCM decoder states update module 360 and decoding constraint and control module 370 are inactive during the processing of Type 1 frames. Further details concerning the processing of Type 1 frames are provided below in reference to the specific implementation of decoder/PLC system 300 described in section D.

2. Processing of Type 2, Type 3 and Type 4 Frames

During the processing of a Type 2, Type 3 or Type 4 frame, the input bit-stream associated with the lost frame is not available. Consequently, blocks 310, 320, 330, and 340 cannot perform their usual functions and are inactive. Instead, switch 336 is connected to the lower position labeled "Types 2-6," and full-band speech signal synthesizer 350 becomes active and synthesizes the output speech signal of decoder/PLC system 300. The full-band speech signal synthesizer 350 synthesizes the output speech signal of decoder/PLC system 300 by extrapolating previously-stored output speech signals associated with the last few received frames immediately before the packet loss. This is reflected in step 416 of flowchart 400.

After full-band speech signal synthesizer 350 completes the task of waveform synthesis, sub-band ADPCM decoder states update module 360 then properly updates the internal states of low-band ADPCM decoder 320 and high-band ADPCM decoder 330 in preparation for a possible good frame in the next frame as shown at step 418. The manner in which steps 416 and 418 are performed will now be described in more detail.

a. Waveform Extrapolation

There are many prior art techniques for performing the waveform extrapolation function of step 416. The technique used by the implementation of decoder/PLC system 300 described in Section D below is a modified version of that described in U.S. patent application Ser. No. 11/234,291 to Chen, filed Sep. 26, 2005, and entitled "Packet Loss Concealment for Block-Independent Speech Codecs." A high-level description of this technique will now be provided, while further details are set forth below in section D.

In order to facilitate the waveform extrapolation function, full-band speech signal synthesizer 350 analyzes the stored output speech signal from QMF synthesis filter bank 340 during the processing of received frames to extract a pitch period, a short-term predictor, and a long-term predictor. These parameters are then stored for later use.

Full-band speech signal synthesizer 350 extracts the pitch period by performing a two-stage search. In the first stage, a lower-resolution pitch period (or "coarse pitch") is identified by performing a search based on a decimated version of the input speech signal or a filtered version of it. In the second stage, the coarse pitch is refined to the normal resolution by searching around the neighborhood of the coarse pitch using the undecimated signal. Such a two-stage search method requires significantly lower computational complexity than a single-stage full search in the undecimated domain. Before the decimation of the speech signal or its filtered version, normally the undecimated signal needs to pass through an anti-aliasing low-pass filter. To reduce complexity, a common prior-art technique is to use a low-order Infinite Impulse Response (IIR) filter such as an elliptic filter. However, a good low-order IIR filter often has it poles very close to the unit circle and therefore requires double-precision arithmetic operations when performing the filtering operation corresponding to the all-pole section of the filter in 16-bit fixed-point arithmetic.

In contrast to the prior art, full-band speech signal synthesizer 350 uses a Finite Impulse Response (FIR) filter as the anti-aliasing low-pass filter. By using a FIR filter in this manner, only single-precision 16-bit fixed-point arithmetic operations are needed and the FIR filter can operate at the much lower sampling rate of the decimated signal. As a result, this approach can significantly reduce the computational complexity of the anti-aliasing low-pass filter. For example, in the implementation of decoder/PLC system 300 described in Section D, the undecimated signal has a sampling rate of 16 kHz, but the decimated signal for pitch extraction has a sampling rate of only 2 kHz. With the prior-art technique, a $4^{th}$-order elliptic filter is used. The all-pole section of the elliptic filter requires double-precision fixed-point arithmetic and needs to operate at the 16 kHz sampling rate. Because of this, even though the all-zero section can operate at the 2 kHz sampling rate, the entire $4^{th}$-order elliptic filter and down-sampling operation takes 0.66 WMOPS (Weighted Million Operations Per Second) of computational complexity. In contrast, even if a relatively high-order FIR filter of $60^{th}$-order is used to replace the $4^{th}$-order elliptic filter, since the $60^{th}$-order FIR filter is operating at the very low 2 kHz sampling rate, the entire $60^{th}$-order FIR filter and down-sampling operation takes only 0.18 WMOPS of complexity—a reduction of 73% from the $4^{th}$-order elliptic filter.

At the beginning of the first lost frame of a packet loss, full-band speech signal synthesizer 350 uses a cascaded long-term synthesis filter and short-term synthesis filter to generate a signal called the "ringing signal" when the input to the cascaded synthesis filter is set to zero. Full-band speech signal synthesizer 350 then analyzes certain signal parameters such as pitch prediction gain and normalized autocorrelation to determine the degree of "voicing" in the stored output speech signal. If the previous output speech signal is highly voiced, then the speech signal is extrapolated in a periodic manner to generate a replacement waveform for the current bad frame. The periodic waveform extrapolation is performed using a refined version of the pitch period extracted at the last received frame. If the previous output speech signal is highly unvoiced or noise-like, then scaled random noise is passed through a short-term synthesis filter to generate a replacement signal for the current bad frame. If the degree of voicing is somewhere between the two extremes, then the two components are mixed together proportional to a voicing measure. Such an extrapolated signal is then overlap-added with the ringing signal to ensure that there will not be a waveform discontinuity at the beginning of the first bad frame of a packet loss. Furthermore, the waveform extrapolation is extended beyond the end of the current bad frame by a period of time at least equal to the overlap-add period, so that the extra samples of the extrapolated signal at the beginning of next frame can be used as the "ringing signal" for the overlap-add at the beginning of the next frame.

In a bad frame that is not the very first bad frame of a packet loss (i.e., in a Type 3 or Type 4 frame), the operation of full-band speech signal synthesizer 350 is essentially the same as what was described in the last paragraph, except that full-band speech signal synthesizer 350 does not need to calculate a ringing signal and can instead use the extra samples of extrapolated signal computed in the last frame beyond the end of last frame as the ringing signal for the overlap-add operation to ensure that there is no waveform discontinuity at the beginning of the frame.

For extended packet loss, full-band speech signal synthesizer 350 gradually mutes the output speech signal of decoder/PLC system 300. For example, in the implementation of decoder/PLC system 300 described in Section D, the output speech signal generated during packet loss is attenuated or "ramped down" to zero in a linear fashion starting at 20 ms into packet loss and ending at 60 ms into packet loss. This function is performed because the uncertainty regarding the shape and form of the "real" waveform increases with time. In practice, many PLC schemes start to produce buzzy output when the extrapolated segment goes much beyond approximately 60 ms.

In an alternate embodiment of the present invention, for PLC in background noise (and in general) an embodiment of the present invention tracks the level of background noise (the ambient noise), and attenuates to that level instead of zero for long erasures. This eliminates the intermittent effect of packet loss in background noise due to muting of the output by the PLC system.

A further alternative embodiment of the present invention addresses the foregoing issue of PLC in background noise by implementing a comfort noise generation (CNG) function. When this embodiment of the invention begins attenuating the output speech signal of decoder/PLC system 300 for extended packet losses, it also starts mixing in comfort noise generated by the CNG. By mixing in and replacing with comfort noise the output speech signal of decoder/PLC system 300 when it is otherwise attenuated, and eventually muted, the intermittent effect described above will be eliminated and a faithful reproduction of the ambient environment of the signal will be provided. This approach has been proven and is commonly accepted in other applications. For example, in a sub-band acoustic echo canceller (SBAEC), or an acoustic echo canceller (AEC) in general, the signal is muted and replaced with comfort noise when residual echo is detected. This is often referred to as non-linear processing (NLP). This embodiment of the present invention is premised on the appreciation that PLC presents a very similar scenario. Similar to AEC, the use of this approach for PLC will provide a much enhanced experience that is far less objectionable than the intermittent effect.

b. Updating of Internal States of Low-Band and High-Band ADPCM Decoders

After full-band speech signal synthesizer 350 completes the task of waveform synthesis performed in step 416, sub-band ADPCM decoder states update module 360 then properly updates the internal states of the low-band ADPCM decoder 320 and the high-band ADPCM decoder 330 in preparation for a possible good frame in the next frame in step 418. There are many ways to perform the update of the internal states of low-band ADPCM decoder 320 and high-band ADPCM decoder 330. Since the G.722 encoder in FIG. 1 and the G.722 decoder in FIG. 2 have the same kinds of internal states, one straightforward way to update the internal states of decoders 320 and 330 is to feed the output signal of full-band speech signal synthesizer 350 through the normal G.722 encoder shown in FIG. 1 starting with the internal states left at the last sample of the last frame. Then, after encoding the current bad frame of extrapolated speech signal, the internal states left at the last sample of the current bad frame is used to update the internal states of low-band ADPCM decoder 320 and high-band ADPCM decoder 330.

However, the foregoing approach carries the complexity of the two sub-band encoders. In order to save complexity, the implementation of decoder/PLC system 300 described in Section D below carries out an approximation to the above. For the high-band ADPCM encoder, it is recognized that the high-band adaptive quantization step size, $\Delta_H(n)$, is not needed when processing the first received frame after a packet loss. Instead, the quantization step size is reset to a running mean prior to the packet loss (as is described elsewhere herein). Consequently, the difference signal (or prediction error signal), $e_H(n)$, is used unquantized for the adaptive predictor updates within the high-band ADPCM encoder, and the quantization operation on $e_H(n)$ is avoided entirely.

For the low-band ADPCM encoder, the scenario is slightly different. Due to the importance of maintaining the pitch modulation of the low-band adaptive quantization step size, $\Delta_L(n)$, the implementation of decoder/PLC system 300 described in Section D below advantageously updates this parameter during the lost frame(s). A standard G.722 low-band ADPCM encoder applies a 6-bit quantization of the difference signal (or prediction error signal), $e_L(n)$. However, in accordance with the G.722 standard, a subset of only 8 of the magnitude quantization indices is used for updating the low-band adaptive quantization step size $\Delta_L(n)$. By using the unquantized difference signal $e_L(n)$ in place of the quantized difference signal for adaptive predictor updates within the low-band ADPCM encoder, the embodiment described in Section D is able to use a less complex quantization of the difference signal, while maintaining identical update of the low-band adaptive quantization step size $\Delta_L(n)$.

Persons skilled in the relevant art(s) will readily appreciate that in descriptions herein involving the high-band adaptive quantization step size $\Delta_H(n)$, the high-band adaptive quantization step size may be replaced by the high-band log scale factor $\nabla_H(n)$. Likewise in descriptions herein involving the low-band adaptive quantization step size $\Delta_L(n)$, the low-band adaptive quantization step size may be replaced by the low-band log scale factor $\nabla_L(n)$.

Another difference between the low-band and high-band ADPCM encoders used in the embodiment of Section D as compared to standard G.722 sub-band ADPCM encoders is an adaptive reset of the encoders based on signal properties and duration of the packet loss. This functionality will now be described.

As noted above, for packet losses of a long duration, full-band speech signal synthesizer 350 mutes the output speech waveform after a predetermined time. In the implementation of decoder/PLC system 300 described below in Section D, the output signal from full-band speech signal synthesizer 350 is fed through a G.722 QMF analysis filter bank to derive sub-band signals used for updating the internal states of low-band ADPCM decoder 320 and high-band ADPCM decoder 330 during lost frames. Consequently, once the output signal from full-band speech signal synthesizer 350 is attenuated to zero, the sub-band signals used for updating the internal states of the sub-band ADPCM decoders will become zero as well. A constant zero can cause the adaptive predictor within each decoder to diverge from those of the encoder since it will unnaturally make the predictor sections adapt continuously in the same direction. This is very noticeable in a conventional high-band ADPCM decoder, which commonly produces high frequency chirping when processing good frames after a long packet loss. For a conventional low-band ADPCM decoder, this issue occasionally results in an unnatural increase in energy due to the predictor effectively having too high a filter gain.

Based on the foregoing observations, the implementation of decoder/PLC system 300 described below in Section D resets the ADPCM sub-band decoders once the PLC output waveform has been attenuated to zero. This method almost entirely eliminates the high frequency chirping after long erasures. The observation that the uncertainty of the synthesized waveform generated by full-band speech signal synthesizer 350 increases as the duration of packet loss increases supports that at some point it may not be sensible to use it to update sub-band ADPCM decoders 320 and 330.

However, even if the sub-band APCM decoders 320 and 330 are reset at the time when the output of full-band speech signal synthesizer 350 is completely muted, some issues in the form of infrequent chirping (from high-band ADPCM decoder 330), and infrequent unnatural increase in energy (from low-band ADPCM decoder 320) remain. This has been addressed in the implementation described in Section D by making the reset depth of the respective sub-band ADPCM decoders adaptive. Reset will still occur at the time of waveform muting, but one or more of sub-band ADPCM decoders 320 and 330 may also be reset earlier.

As will be described in Section D, the decision on an earlier reset is based on monitoring certain properties of the signals controlling the adaptation of the pole sections of the adaptive predictors of sub-band ADPCM decoders 320 and 330 during the bad frames, i.e. during the update of the sub-band ADPCM decoders 320 and 330 based on the output signal from full-band speech signal synthesizer 350. For low-band ADPCM decoder 320, the partial reconstructed signal $p_{Lt}(n)$ drives the adaptation of the all-pole filter section, while it is the partial reconstructed signal $p_H(n)$ that drives the adaptation of the all-pole filter section of high-band ADPCM decoder 330. Essentially, each parameter is monitored for being constant to a large degree during a lost frame of 10 ms, or for being predominantly positive or negative during the duration of the current loss. It should be noted that in the implementation described in Section D, the adaptive reset is limited to after 30 ms of packet loss.

3. Processing of Type 5 and Type 6 Frames

During the processing of Type 5 and Type 6 frames, the input bit-stream associated with the current frame is once again available and, thus, blocks 310, 320, 330, and 340 are active again. However, the decoding operations performed by low-band ADPCM decoder 320 and high-band ADPCM decoder 330 are constrained and controlled by decoding constraint and control module 370 to reduce artifacts and distortion at the transition from lost frames to received frames, thereby improving the performance of decoder/PLC system 300 after packet loss. This is reflected in step 420 of flowchart 400 for Type 5 frames and in step 426 for Type 6 frames.

For Type 5 frames, additional modifications to the output speech signal are performed to ensure a smooth transition between the synthesized signal generated by full-band speech signal synthesizer 350 and the output signal produced by QMF synthesis filter bank 340. Thus, the output signal of QMF synthesis filter bank 340 is not directly used as the output speech signal of decoder/PLC system 300. Instead, full-band speech signal synthesizer 350 modifies the output of QMF synthesis filter bank 340 and uses the modified version as the output speech signal of decoder/PLC system 300. Thus, during the processing of a Type 5 or Type 6 frame, switch 336 remains connected to the lower position labeled "Types 2-6" to receive the output speech signal from full-band speech signal synthesizer 350.

The operations performed by full-band speech signal synthesizer 350 in this regard include the performance of time-warping and re-phasing if there is a misalignment between the synthesized signal generated by full-band speech signal synthesizer 350 and the output signal produced by QMF synthesis filter bank 340. The performance of these operations is shown at step 422 of flowchart 400 and will be described in more detail below.

Also, for Type 5 frames, the output speech signal generated by full-band speech signal synthesizer 350 is overlap-added with the ringing signal from the previously-processed lost frame. This is done to ensure a smooth transition from the synthesized waveform associated with the previous frame to the output waveform associated with the current Type 5 frame. The performance of this step is shown at step 424 of flowchart 400.

After an output speech signal has been generated for a Type 5 or Type 6 frame, decoder/PLC system 300 updates various state memories and performs some processing to facilitate PLC operations that may be performed for future lost frames in a like manner to step 414, as shown at step 428.

a. Constraint and Control of Sub-Band ADPCM Decoding

As noted above, the decoding operations performed by low-band ADPCM decoder 320 and high-band ADPCM decoder 330 during the processing of Type 5 and Type 6 frames are constrained and controlled by decoding constraint and control module 370 to improve performance of decoder/PLC system 300 after packet loss. The various constraints and controls applied by decoding constraint and control module 370 will now be described. Further details concerning these constraints and controls are described below in Section D in reference to a particular implementation of decoder/PLC system 300.

i. Setting of Adaptive Quantization Step Size for High-Band ADPCM Decoder

For Type 5 frames, decoding constraint and control module 370 sets the adaptive quantization step size for high-band ADPCM decoder 330, $\Delta_H(n)$, to a running mean of its value associated with good frames received prior to the packet loss. This improves the performance of decoder/PLC system 300 in background noise by reducing energy drops that would otherwise be seen for the packet loss in segments of background noise only.

ii. Setting of Adaptive Quantization Step Size for Low-Band ADPCM Decoder

For Type 5 frames, decoding constraint and control module 370 implements an adaptive strategy for setting the adaptive quantization step size for low-band ADPCM decoder 320, $\Delta_L(n)$. In an alternate embodiment, this method can also be applied to high-band ADPCM decoder 330 as well. As noted in the previous sub-section, for high-band ADPCM decoder 330, it is beneficial to the performance of decoder/PLC system 300 in background noise to set the adaptive quantization step size, $\Delta_H(n)$, to a running mean of its value prior to the packet loss at the first good frame. However, the application of the same approach to low-band ADPCM decoder 320 was found to occasionally produce large unnatural energy increases in voiced speech. This is because $\Delta_L(n)$ is modulated by the pitch period in voiced speech, and hence setting $\Delta_L(n)$ to the running mean prior to the frame loss may result in a very large abnormal increase in $\Delta_L(n)$ at the first good frame after packet loss.

Consequently, in a case where $\Delta_L(n)$ is modulated by the pitch period, it is preferable to use the $\Delta_L(n)$ from the ADPCM decoder states update module 360 rather than the running mean of $\Delta_L(n)$ prior to the packet loss. Recall that sub-band ADPCM decoder states update module 360 updates low-band ADPCM decoder 320 by passing the output signal of full-band speech signal synthesizer 350 through a G.722 QMF analysis filter bank to obtain a low-band signal. If full-band speech signal synthesizer 350 is doing a good job, which is likely for voiced speech, then the signal used for updating low-band ADPCM decoder 320 is likely to closely match that used at the encoder, and hence, the $\Delta_L(n)$ parameter is also likely to closely approximate that of the encoder. For voiced speech, this approach is preferable to setting $\Delta_L(n)$ to the running mean of $\Delta_L(n)$ prior to the packet loss.

In view of the foregoing, decoding constraint and control module 370 is configured to apply an adaptive strategy for setting $\Delta_L(n)$ for the first good frame after a packet loss. If the speech signal prior to the packet loss is fairly stationary, such as stationary background noise, then $\Delta_L(n)$ is set to the running mean of $\Delta_L(n)$ prior to the packet loss. However, if the speech signal prior to the packet loss exhibits variations in $\Delta_L(n)$ such as would be expected for voiced speech, then $\Delta_L(n)$ is set to the value obtained by the low-band ADPCM decoder update based on the output of full-band speech signal synthesizer 350. For in-between cases, $\Delta_L(n)$ is set to a linear weighting of the two values based on the variations in $\Delta_L(n)$ prior to the packet loss.

iii. Adaptive Low-Pass Filtering of Adaptive Quantization Step Size for High-Band ADPCM Decoder During processing of the first few good frames after a packet loss (Type 5 and Type 6 frames), decoding constraint and control module 370 advantageously controls the adaptive quantization step size, $\Delta_H(n)$, of the high-band ADPCM decoder in order to reduce the risk of local fluctuations (due to temporary loss of synchrony between the G.722 encoder and G.722 decoder) producing too strong a high frequency content. This can produce a high frequency wavering effect, just shy of actual chirping. Therefore, an adaptive low-pass filter is applied to the high-band quantization step size $\Delta_H(n)$ in the first few good frames. The smoothing is reduced in a quadratic form over a duration which is adaptive. For segments for which the speech signal was highly stationary prior to the packet loss, the duration is longer (80 ms in the implementation of decoder/PLC system 300 described below in Section D). For cases with a less stationary speech prior to the packet loss, the duration is shorter (40 ms in the implementation of decoder/PLC system 300 described below in Section D), while for a non-stationary segment no low-pass filtering is applied.

iv. Adaptive Safety Margin on the All-Pole Filter Section in the First Few Good Frames Due to the inevitable divergence between the G.722 decoder and encoder during and after a packet loss, decoding constraint and control module 370 enforces certain constraints on the adaptive predictor of low-band ADPCM decoder 720 during the first few good frames after packet loss (Type 5 and Type 6 frames). In accordance with the G.722 standard, the encoder and decoder by default enforce a minimum "safety" margin of 1/16 on the pole section of the sub-band predictors. It has been found, however, that the all-pole section of the two-pole, six-zero predictive filter of the low-band ADPCM decoder often causes abnormal energy increases after a packet loss. This is often perceived as a pop. Apparently, the packet loss results in a lower safety margin which corresponds to an all-pole filter section of higher gain producing a waveform of too high energy.

By adaptively enforcing more stringent constraints on the all-pole filter section of the adaptive predictor of low-band ADPCM decoder 320, decoding constraint and control module 370 greatly reduces this abnormal energy increase after a packet loss. In the first few good frames after a packet loss an increased minimum safety margin is enforced. The increased minimum safety margin is gradually reduced to the standard minimum safety margin of G.722. Furthermore, a running mean of the safety margin prior to the packet loss is monitored and the increased minimum safety margin during the first few good frames after packet lost is controlled so as not to exceed the running mean.

v. DC Removal on Internal Signals of the High-Band ADPCM Decoder

During the first few good frames (Type 5 and Type 6 frames) after a packet loss, it has been observed that a G.722 decoder often produces a pronounced high-frequency chirping distortion that is very objectionable. This distortion comes from the high-band ADPCM decoder which has lost synchronization with the high-band ADPCM encoder due to the packet loss and therefore produced a diverged predictor. The loss of synchronization leading to the chirping manifests itself in the input signal to the control of the adaptation of the pole predictor, $p_H(n)$, and the reconstructed high-band signal, $r_H(n)$, having constant signs for extended time. This causes the pole section of the predictor to drift as the adaptation is sign-based, and hence, to keep updating in the same direction.

In order to avoid this, decoding constraint and control module 370 adds DC removal to these signals by replacing signal $p_H(n)$ and $r_H(n)$ with respective high-pass filtered versions $p_{H,HP}(n)$ and $r_{H,HP}(n)$ during the first few good frames after a packet loss. This serves to remove the chirping entirely. The DC removal is implemented as a subtraction of a running mean of $p_H(n)$ and $r_H(n)$, respectively. These running means are updated continuously for both good frames and bad frames. In the implementation of decoder/PLC system 300 described in Section D below, this replacement occurs for the first 40 ms following a packet loss.

b. Re-Phasing and Time-Warping

As noted above, during step 422 of flowchart 400, full-band speech signal synthesizer 350 performs techniques that are termed herein "re-phasing" and "time warping" if there is a misalignment between the synthesized speech signal generated by full-band speech signal synthesizer 350 during a packet loss and the speech signal produced by QMF synthesis filter bank 340 during the first received frame after the packet loss.

As described above, during the processing of a lost frame, if the decoded speech signal associated with the received frames prior to packet loss is nearly periodic, such as vowel signals in speech, full-band speech signal synthesizer 350 extrapolates the speech waveform based on the pitch period. As also described above, this waveform extrapolation is continued beyond the end of the lost frame to include additional samples for an overlap add with the speech signal associated with the next frame to ensure a smooth transition and avoid any discontinuity. However, the true pitch period of the decoded speech signal in general does not follow the pitch track used during the waveform extrapolation in the lost frame. As a result, generally the extrapolated speech signal will not be aligned perfectly with the decoded speech signal associated with the first good.

Figure 6:
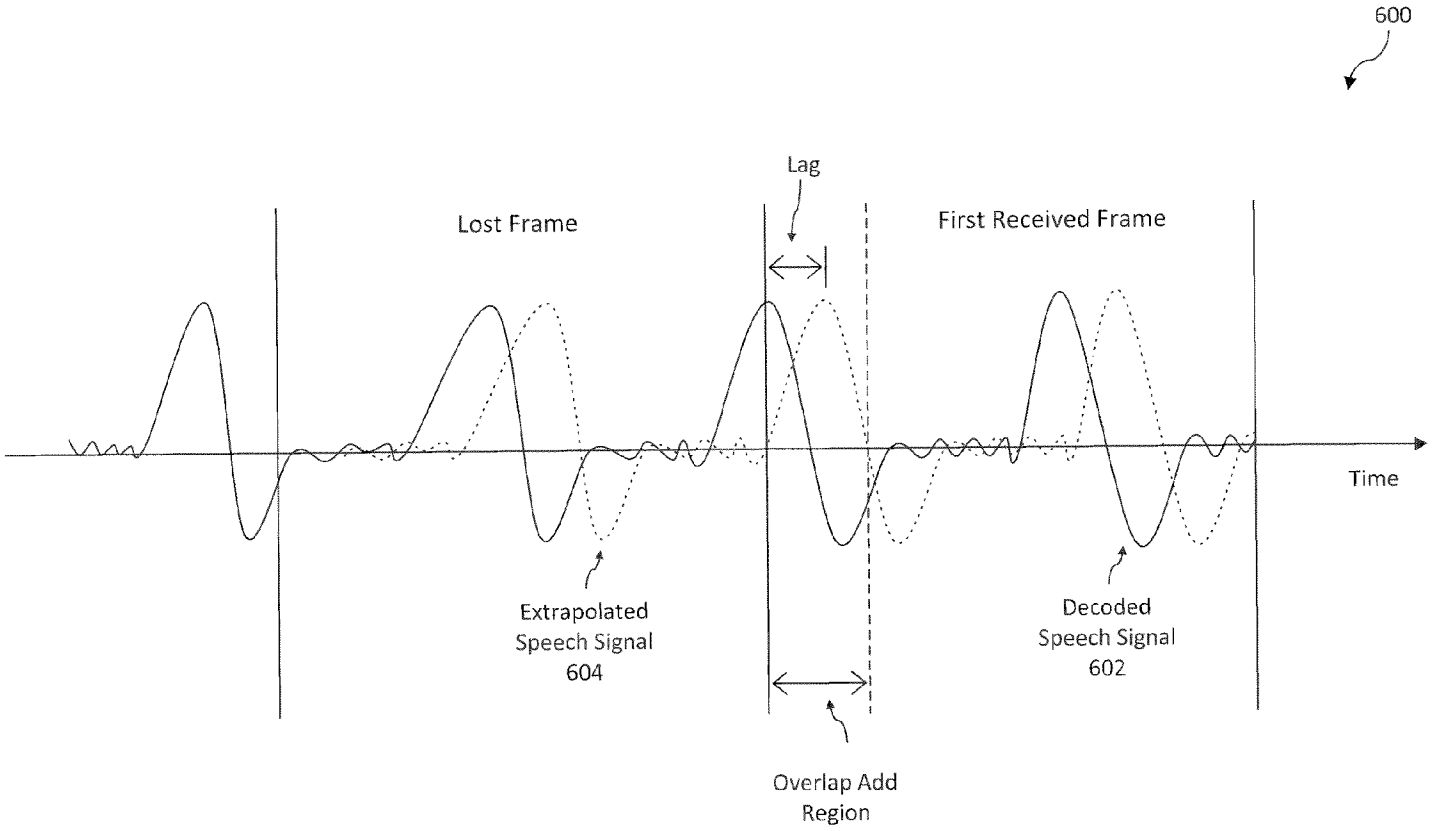
FIG. 6 is a timeline showing the amplitude of an original speech signal and an extrapolated speech signal.

This is illustrated in FIG. 6, which is a timeline 600 showing the amplitude of a decoded speech signal 602 prior to a lost frame and during a first received frame after packet loss (for convenience, the decoded speech signal is also shown during the lost frame, but it is to be understood that decoder/PLC system 300 will not be able to decode this portion of the original signal) and the amplitude of an extrapolated speech signal 604 generated during the lost frame and into the first received frame after packet loss. As shown in FIG. 6, the two signals are out of phase in the first received frame.

This out-of-phase phenomenon results in two problems within decoder/PLC system 300. First, from FIG. 6, it can be seen that in the first received frame after packet loss, decoded speech signal 602 and extrapolated speech signal 604 in the overlap-add region are out of phase and will partially cancel, resulting in an audible artifact. Second, the state memories associated with sub-band ADPCM decoders 320 and 330 exhibit some degree of pitch modulation and are therefore sensitive to the phase of the speech signal. This is especially true if the speech signal is near the pitch epoch, which is the portion of the speech signal near the pitch pulse where the signal level rises and falls sharply. Because sub-band ADPCM decoders 320 and 330 are sensitive to the phase of the speech signal and because extrapolated speech signal 604 is used to update the state memories of these decoders during packet loss (as described above), the phase difference between extrapolated speech signal 604 and decoded speech signal 602 may cause significant artifacts in the received frames following packet loss due to the mismatched internal states of the sub-band ADPCM encoders and decoders.

As will be described in more detail below, time-warping is used to address the first problem of destructive interference in the overlap add region. In particular, time-warping is used to stretch or shrink the time axis of the decoded speech signal associated with the first received frame after packet loss to align it with the extrapolated speech signal used to conceal the previous lost frame. Although time warping is described herein with reference to a sub-band predictive coder with memory, it is a general technique that can be applied to other coders, including but not limited to coders with and without memory, predictive and non-predictive coders, and sub-band and full-band coders.

As will also be described in more detail below, re-phasing is used to address the second problem of mismatched internal states of the sub-band ADPCM encoders and decoders due to the misalignment of the lost frame and the first good frame after packet loss. Re-phasing is the process of setting the internal states of sub-band ADPCM decoders 320 and 330 to a point in time where the extrapolated speech waveform is in-phase with the last input signal sample immediately before the first received frame after packet loss. Although re-phasing is described herein in the context of a backward-adaptive system, it can also be used for performing PLC in forward-adaptive predictive coders, or in any coders with memory.

i. Time Lag Calculation

Each of the re-phasing and time-warping techniques require a calculation of the number of samples that the extrapolated speech signal and the decoded speech signal associated with the first received frame after packet loss are misaligned. This misalignment is termed the "lag" and is labeled as such in FIG. 6. It can be thought of as the number of samples by which the decoded speech signal is lagging the extrapolated speech signal. In the case of FIG. 6, the lag is negative.

Figure 7:
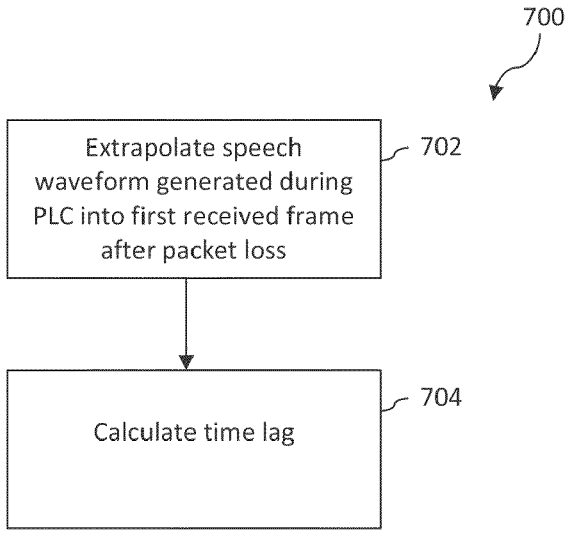
FIG. 7 illustrates a flowchart of a method for calculating a time lag between a decoded speech signal and an extrapolated speech signal in accordance with an embodiment of the present invention.

One general method for performing the time lag calculation is illustrated in flowchart 700 of FIG. 7, although other methods may be used. A specific manner of performing this method is described in Section D below.

As shown in FIG. 7, the method of flowchart 700 begins at step 702 in which the speech waveform generated by full-band speech signal synthesizer 350 during the previous lost frame is extrapolated into the first received frame after packet loss.

Figure 9:
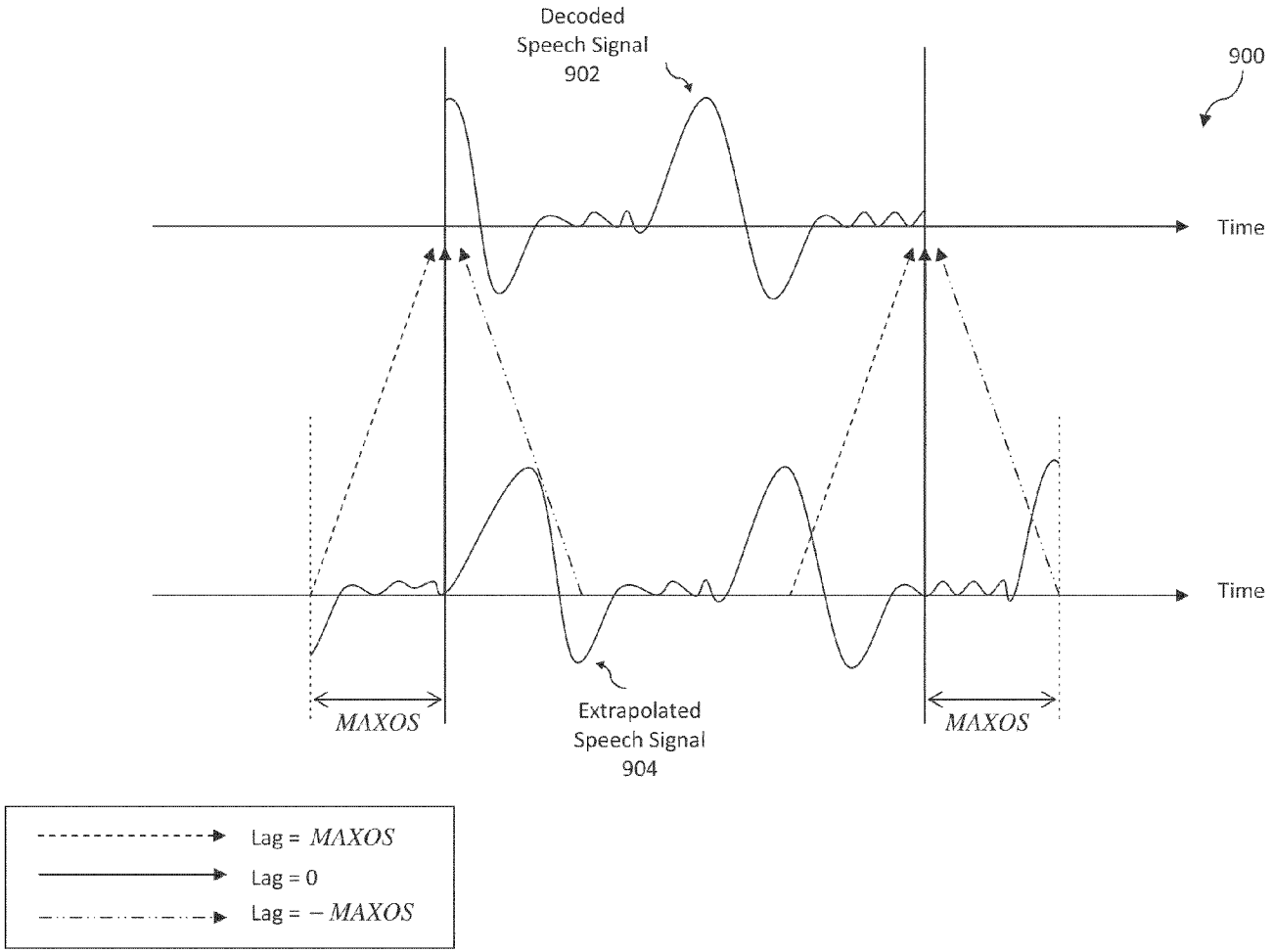
FIG. 9 depicts a manner in which an extrapolated speech signal may be shifted with respect to a decoded speech signal during the performance of a time lag calculation in accordance with an embodiment of the present invention.

In step 704, a time lag is calculated. At a conceptual level, the lag is calculated by maximizing a correlation between the extrapolated speech signal and the decoded speech signal associated with the first received frame after packet loss. As shown in FIG. 9, the extrapolated speech signal (denoted 904) is shifted in a range from −MAXOS to +MAXOS with respect to the decoded speech signal associated with the first received frame (denoted 902), where MAXOS represents a maximum offset, and the shift that maximizes the correlation is used as the lag. This may be accomplished, for example, by searching for the peak of the normalized cross-correlation function R(k) between the signals for a time lag range of ±MAXOS around zero:

$$R(k) = \frac{\sum_{i=0}^{LSW-1} es(i-k)\cdot x(i)}{\sqrt{\sum_{i=0}^{LSW-1} es^2(i-k)\sum_{i=0}^{LSW-1} x^2(i)}},\ k = -MAXOS, \ldots, MAXOS \tag{1}$$

where es is the extrapolated speech signal, x is the decoded speech signal associated with the first received frame after packet loss, MAXOS is the maximum offset allowed, LSW is the lag search window length, and i=0 represents the first sample in the lag search window. The time lag that maximizes this function will correspond to a relative time shift between the two waveforms.

In one embodiment, the number of samples over which the correlation is computed (referred to herein as the lag search window) is determined in an adaptive manner based on the pitch period. For example, in the embodiment described in Section D below, the window size in number of samples (at 16 kHz sampling) for a coarse lag search is given by:

$$LSW = \begin{cases} 80 & \lfloor ppfe\cdot 1.5+0.5\rfloor < 80 \\ 160 & \lfloor ppfe\cdot 1.5+0.5\rfloor > 160 \\ \lfloor ppfe\cdot 1.5+0.5\rfloor & \text{otherwise} \end{cases}, \tag{2}$$

where ppfe is the pitch period. This equation uses a floor function. The floor function of a real number x, denoted $\lfloor x\rfloor$, is a function that returns the largest integer less than or equal to x.

If the time lag calculated in step 704 is zero, then this indicates that the extrapolated speech signal and the decoded speech signal associated with the first received frame are in phase, whereas a positive value indicates that the decoded speech signal associated with the first received frame lags (is delayed compared to) the extrapolated speech signal, and a negative value indicates that the decoded speech signal associated with the first received frame leads the extrapolated speech signal. If the time lag is equal to zero, then re-phasing and time-warping need not be performed. In the example implementation set forth in Section D below, the time lag is also forced to zero if the last received frame before packet loss is deemed unvoiced (as indicated by a degree of "voicing" calculated for that frame, as discussed above in regard to the processing of Type 2, Type 3 and Type 4 frames) or if the first received frame after the packet loss is deemed unvoiced.

Figure 8:
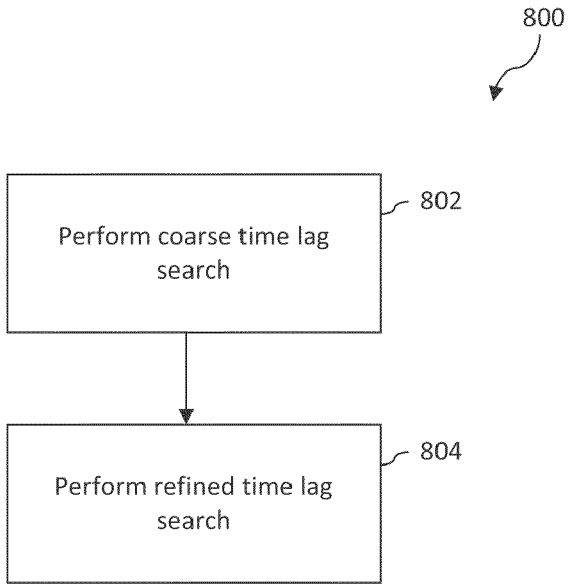
FIG. 8 illustrates a flowchart of a two-stage method for calculating a time lag between a decoded speech signal and an extrapolated speech signal in accordance with an embodiment of the present invention.

In order to minimize the complexity of the correlation computation, the lag search may be performed using a multi-stage process. Such an approach is illustrated by flowchart 800 of FIG. 8, in which a coarse time lag search is first performed using down-sampled representations of the signals at step 802 and then a refined time lag search is performed at step 804 using a higher sampling rate representation of the signals. For example, the coarse time lag search may be performed after down-sampling both signals to 4 kHz and the refined time lag search may be performed with the signals at 8 kHz. To further reduce complexity, down-sampling may be performed by simply sub-sampling the signals and ignoring any aliasing effects.

One issue is what signal to use in order to correlate with the extrapolated speech signal in the first received frame. A "brute force" method is to fully decode the first received frame to obtain a decoded speech signal and then calculate the correlation values at 16 kHz. To decode the first received frame, the internal states of sub-band ADPCM decoders 320 and 330 obtained from re-encoding the extrapolated speech signal (as described above) up to the frame boundary can be used. However, since the re-phasing algorithm to be described below will provide a set of more optimal states for sub-band ADPCM decoders 320 and 330, the G.722 decoding will need to be re-run. Because this method performs two complete decode operations, it is very wasteful in terms of computational complexity. To address this, an embodiment of the present invention implements an approach of lower complexity.

In accordance with the lower-complexity approach, the received G.722 bit-stream in the first received frame is only partially decoded to obtain the low-band quantized difference signal, $d_{Lt}(n)$. During normal G.722 decoding, bits received from bit-stream de-multiplexer 310 are converted by sub-band ADPCM decoders 320 and 330 into difference signals $d_{Lt}(n)$ and $d_{Ht}(n)$, scaled by a backward-adaptive scale factor and passed through backward-adaptive pole-zero predictors to obtain the sub-band speech signals that are then combined by QMF synthesis filter bank 340 to produce the output speech signal. At every sample in this process, the coefficients of the adaptive predictors within sub-band ADPCM decoders 320 and 330 are updated. This update accounts for a significant portion of the decoder complexity. Since only a signal for time lag computation is required, in the lower-complexity approach the two-pole, six-zero predictive filter coefficients remain frozen (they are not updated sample-by-sample). In addition, since the lag is dependent upon the pitch and the pitch fundamental frequency for human speech is less than 4 kHz, only a low-band approximation signal $r_L(n)$ is derived. More details concerning this approach are provided in Section D below.

In the embodiment described in Section D below, the fixed filter coefficients for the two-pole, six-zero predictive filter are those obtained from re-encoding the extrapolated waveform during packet loss up to the end of the last lost frame. In an alternate implementation, the fixed filter coefficients can be those used at the end of the last received frame before packet loss. In another alternate implementation, one or the other of these sets of coefficients can be selected in an adaptive manner dependent upon characteristics of the speech signal or some other criteria.

ii. Re-Phasing

In re-phasing, the internal states of sub-band ADPCM decoders 320 and 330 are adjusted to take into account the time lag between the extrapolated speech waveform and the decoded speech waveform associated with the first received frame after packet loss. As previously described, prior to processing the first received frame, the internal states of sub-band ADPCM decoders 320 and 330 are estimated by re-encoding the output speech signal synthesized by full-band speech signal synthesizer 350 during the previous lost frame. The internal states of these decoders exhibit some pitch modulation. Thus, if the pitch period used during the waveform extrapolation associated with the previous lost frame exactly followed the pitch track of the decoded speech signal, the re-encoding process could be stopped at the frame boundary between the last lost frame and the first received frame and the states of sub-band ADPCM decoders 320 and 330 would be "in phase" with the original signal. However, as discussed above, the pitch used during extrapolation generally does not match the pitch track of the decoded speech signal, and the extrapolated speech signal and the decoded speech signal will not be in alignment at the beginning of the first received frame after packet loss.

To overcome this problem, re-phasing uses the time lag to control where to stop the re-encoding process. In the example of FIG. 6, the time lag between extrapolated speech signal 604 and decoded speech signal 602 is negative. Let this time lag be denoted lag. Then, it can be seen that if the extrapolated speech signal is re-encoded for −lag samples beyond the frame boundary, the re-encoding would cease at a phase in extrapolated speech signal 604 which corresponds with the phase of decoded speech signal 602 at the frame boundary. The resulting state memory of sub-band ADPCM decoders 320 and 330 would be in phase with the received data in the first good frame and therefore provide a better decoded signal. Therefore, the number of samples to re-encode the sub-band reconstructed signals is given by:

$$N = \mathrm{FS} - \mathrm{lag}, \tag{3}$$

where FS is the frame size and all parameters are in units of the sub-band sampling rate (8 kHz).

Figure 10A:
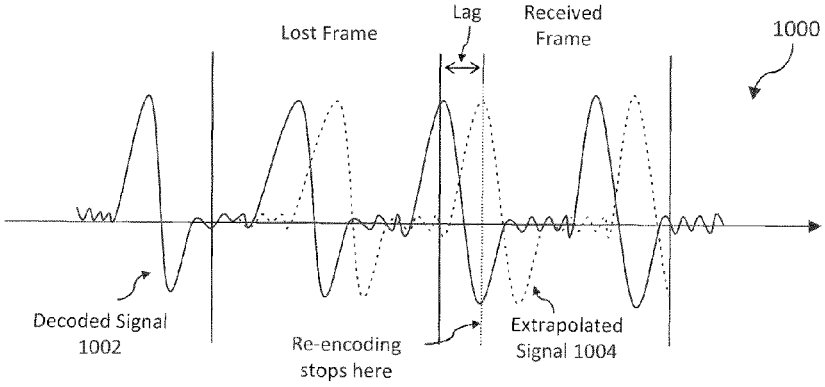
FIG. 10A is a timeline that shows a decoded speech signal that leads an extrapolated speech signal and the associated effect on re-encoding operations in accordance with an embodiment of the present invention.
Figure 10B:
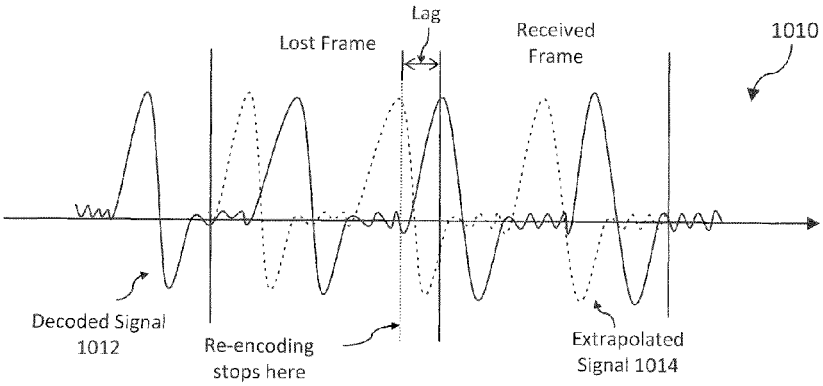
FIG. 10B is a timeline that shows a decoded speech signal that lags an extrapolated speech signal and the associated effect on re-encoding operations in accordance with an embodiment of the present invention.
Figure 10C:
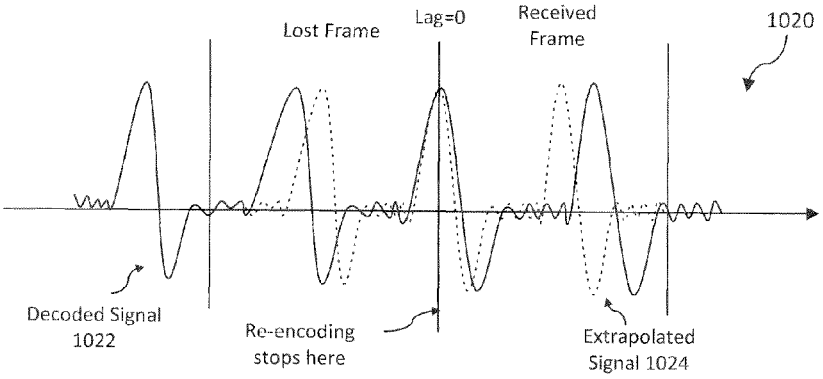
FIG. 10C is a timeline that shows an extrapolated speech signal and a decoded speech signal that are in phase at a frame boundary and the associated effect on re-encoding operations in accordance with an embodiment of the present invention.

Three re-phasing scenarios are presented in FIG. 10A, FIG. 10B and FIG. 10C, respectively. In timeline 1000 of FIG. 10A, the decoded speech signal 1002 "leads" the extrapolated speech signal 1004, so the re-encoding extends beyond the frame boundary by −lag samples. In timeline 1010 of FIG. 10B, the decoded speech signal 1012 lags the extrapolated speech signal 1014 and the re-encoding stops lag samples before the frame boundary. In timeline 1020 of FIG. 10C, the extrapolated speech signal 1024 and the decoded speech signal 1022 are in phase at the frame boundary (even though the pitch track during the lost frame was different) and re-encoding stops at the frame boundary. Note that for convenience, in each of FIGS. 10A, 10B and 10C, the decoded speech signal is also shown during the lost frame, but it is to be understood that decoder 300 will not be able to decode this portion of the original signal.

If no re-phasing of the internal states of sub-band ADPCM decoders 320 and 330 were performed, then the re-encoding used to update these internal states could be performed entirely during processing of the lost frame. However, since the lag is not known until the first received frame after packet loss, the re-encoding cannot be completed during the lost frame. A simple approach to address this would be to store the entire extrapolated waveform used to replace the previous lost frame and then perform the re-encoding during the first received frame. However, this requires the memory to store FS+MAXOS samples. The complexity of re-encoding also falls entirely into the first received frame.

Figure 11:
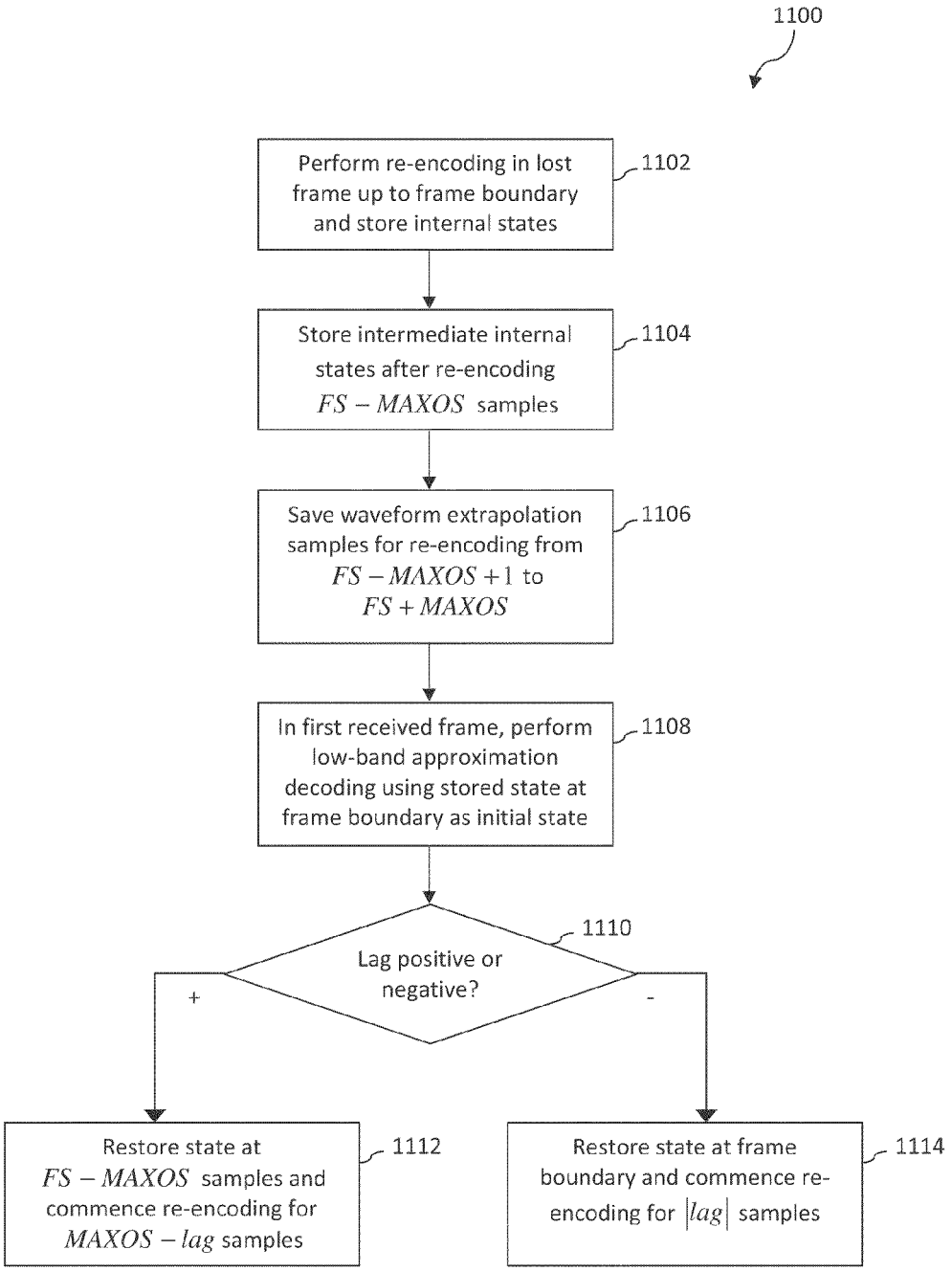
FIG. 11 depicts a flowchart of a method for performing re-phasing of the internal states of sub-band ADPCM decoders after a packet loss in accordance with an embodiment of the present invention.

FIG. 11 illustrates a flowchart 1100 of a method for performing the re-encoding in a manner that redistributes much of the computation to the preceding lost frame. This is desirable from a computational load balance perspective and is possible because MAXOS<<FS.

As shown in FIG. 11, the method of flowchart 1100 begins at step 1102, in which re-encoding is performed in the lost frame up to frame boundary and then the internal states of sub-band ADPCM decoders 320 and 330 at the frame boundary are stored. In addition, the intermediate internal states after re-encoding FS−MAXOS samples are also stored, as shown at step 1104. At step 1106, the waveform extrapolation samples generated for re-encoding from FS−MAXOS+1 to FS+MAXOS are saved in memory. At step 1108, in the first received frame after packet loss, the low-band approximation decoding (used for determining lag as discussed above) is performed using the stored internal states at the frame boundary as the initial state. Then, at decision step 1110, it is determined whether lag is positive or negative. If lag is positive, the internal states at FS−MAXOS samples are restored and re-encoding commences for MAXOS−lag samples, as shown at step 1112. However, if lag is negative, then the internal states at the frame boundary are used and an additional |lag| samples are re-encoded. In accordance with this method, at most, MAXOS samples are re-encoded in the first received frame.

It will be appreciated by persons skilled in the relevant art(s) that the amount of re-encoding in the first good frame can be further reduced by storing more G.722 states along the way during re-encoding in the lost frame. In the extreme case, the G.722 states for each sample between FRAMESIZE−MAXOS and FRAMESIZE+MAXOS can be stored and no re-encoding in the first received frame is required.

In an alternative approach that requires more re-encoding during the first good frame as compared to the method of flowchart 1100, the re-encoding is performed for FS−MAXOS samples during the lost frame. The internal states of sub-band ADPCM decoders 320 and 330 and the remaining 2*MAXOS samples are then saved in memory for use in the first received frame. In the first received frame, the lag is computed and the re-encoding commences from the stored G.722 states for the appropriate number of samples based on the lag. This approach requires the storage of 2*MAXOS reconstructed samples, one copy of the G.722 states, and the re-encoding of at most 2*MAXOS samples in the first good frame. One drawback of this alternative method is that it does not store the internal states of sub-band ADPCM decoders 320 and 330 at the frame boundary that are used for low-complexity decoding and time lag computation as described above.

Ideally, the lag should coincide with the phase offset at the frame boundary between the extrapolated speech signal and the decoded speech signal associated with the first received frame. In accordance with one embodiment of the present invention, a coarse lag estimate is computed over a relatively long lag search window, the center of which does not coincide with the frame boundary. The lag search window may be, for example, 1.5 times the pitch period. The lag search range (i.e., the number of samples by which the extrapolated speech signal is shifted with respect to the original speech signal) may also be relatively wide (e.g., ±28 samples). To improve alignment, a lag refinement search is then performed. As part of the lag refinement search, the search window is moved to begin at the first sample of the first received frame. This may be achieved by offsetting the extrapolated speech signal by the coarse lag estimate. The size of the lag search window in the lag refinement search may be smaller and the lag search range may also be smaller (e.g., ±4 samples). The search methodology may otherwise be identical to that described above in Section C.3.b.i.

The concept of re-phasing has been present above in the context of the G.722 backward-adaptive predictive codec. This concept can easily be extended to other backward-adapted predictive codecs, such as G.726. However, the use of re-phasing is not limited to backward-adaptive predictive codecs. Rather, most memory-based coders exhibit some phase dependency in the state memory and would thus benefit from re-phasing.

iii. Time-Warping

As used herein, the term time-warping refers to the process of stretching or shrinking a signal along the time axis. As discussed elsewhere herein, in order to maintain a continuous signal, an embodiment of the present invention combines an extrapolated speech signal used to replace a lost frame and a decoded speech signal associated with a first received frame after packet loss in a way that avoids a discontinuity. This is achieved by performing an overlap-add between the two signals. However, if the signals are out of phase with each other, waveform cancellation might occur and produce an audible artifact. For example, consider the overlap-add region in FIG. 6. Performing an overlap-add in this region will result in significant waveform cancellation between the negative portion of decoded speech signal 602 and extrapolated speech signal 604.

In accordance with an embodiment of the present invention, the decoded speech signal associated with the first received frame after packet loss is time-warped to phase align the decoded speech signal with the extrapolated speech signal at some point in time within the first received frame. The amount of time-warping is controlled by the value of the time lag. Thus, in one embodiment, if the time lag is positive, the decoded speech signal associated with the first received frame will be stretched and the overlap-add region can be positioned at the start of the first received frame. However, if the lag is negative, the decoded speech signal will be compressed. As a result, the overlap-add region is positioned |lag| samples into the first received frame.

In the case of G.722, some number of samples at the beginning of the first received frame after packet loss may not be reliable due to incorrect internal states of sub-band ADPCM decoders 320 and 330 at the beginning of the frame. Hence, in an embodiment of the present invention, up to the first MIN_UNSTBL samples of the first received frame may not be included in the overlap-add region depending on the application of time-warping to the decoded speech signal associated with that frame. For example, in the embodiment described below in Section D, MIN_UNSTBL is set to 16, or the first 1 ms of a 160-sample 10 ms frame. In this region, the extrapolated speech signal may be used as the output speech signal of decoder/PLC system 300. Such an embodiment advantageously accounts for the re-convergence time of the speech signal in the first received frame.

FIG. 12A, FIG. 12B and FIG. 12C illustrate several examples of this concept. In the example of FIG. 12A, timeline 1200 shows that the decoded speech signal leads the extrapolated signal in the first received frame. Consequently, the decoded speech signal goes through a time-warp shrinking (the time lag, lag, is negative) by −lag samples. The result of the application of time-warping is shown in timeline 1210. As shown in timeline 1210, the signals are in-phase at or near the center of the overlap-add region. In this case, the center of the overlap-add region is located at MIN_UNSTBL−lag+OLA/2 where OLA is the number of samples in the overlap-add region. In the example of FIG. 12B, timeline 1220 shows that the decoded speech signal lags the extrapolated signal in the first received frame. Consequently, the decoded speech signal is time-warp stretched by lag samples to achieve alignment. The result of the application of time-warping is shown in timeline 1230. In this case, MIN_UNSTBL>lag, and there is still some unstable region in the first received frame. In the example of FIG. 12C, timeline 1240 shows that the decoded speech signal again lags the extrapolated signal so the decoded speech signal is time-warp stretched to provide the result in timeline 150. However, as shown in timeline 1250, because MIN_UNSTBL≦lag, the overlap-add region can begin at the first sample in the first received frame.

It is desirable for the "in-phase point" between the decoded speech signal and the extrapolated signal to be in the middle of the overlap-add region, with the overlap-add region positioned as close to the start of the first received frame as possible. This reduces the amount of time by which the synthesized speech signal associated with the previous lost frame must be extrapolated into the first received frame. In one embodiment of the present invention, this is achieved by performing a two-stage estimate of the time lag. In the first stage, a coarse lag estimate is computed over a relatively long lag search window, the center of which may not coincide with the center of the overlap-add region. The lag search window may be, for example, 1.5 times the pitch period. The lag search range (i.e., the number of samples by which the extrapolated speech signal is shifted with respect to the decoded speech signal) may also be relatively wide (e.g., ±28 samples). To improve alignment, a second stage lag refinement search is then performed. As part of the lag refinement search, the lag search window is centered about the expected overlap-add placement according to the coarse lag estimate. This may be achieved by offsetting the extrapolated speech signal by the coarse lag estimate. The size of the lag search window in the lag refinement search may be smaller (e.g., the size of the overlap-add region) and the lag search range may also be smaller (e.g., ±4 samples). The search methodology may otherwise be identical to that described above in Section C.3.b.i.

There are many techniques for performing the time-warping. One technique involves a piece-wise single sample shift and overlap add. Flowchart 1300 of FIG. 13 depicts a method for shrinking that uses this technique. In accordance with this method, a sample is periodically dropped as shown at step 1302. From this point of sample drop, the original signal and the signal shifted left (due to the drop) are overlap-added as shown at step 1304. Flowchart 1400 of FIG. 14 depicts a method for stretching that uses this technique. In accordance with this method, a sample is periodically repeated as shown at step 1402. From that point of sample repeat, the original signal and the signal shifted to the right (due to the sample repeat) are overlap-added as shown at step 1404. The length of the overlap-add window for these operations may be made dependent on the periodicity of the sample add/drop. To avoid too much signal smoothing, a maximum overlap-add period may be defined (e.g., 8 samples). The period at which the sample add/drop occurs may be made dependent on various factors such as frame size, the number of samples to add/drop, and whether adding or dropping is being performed.

The amount of time-warping may be constrained. For example, in the G.722 system described below in Section D, the amount of time-warping is constrained to ±1.75 ms for 10 ms frames (or 28 samples of a 160 sample 10 ms frame). It was found that warping by more than this may remove the destructive interference described above, but often introduced some other audible distortion. Thus, in such an embodiment, in cases where the time lag is outside this range, no time warping is performed.

The system described below in Section D is designed to ensure zero sample delay after the first received frame after packet loss. For this reason, the system does not perform time-warping of the decoded speech signal beyond the first received frame. This in turn, constrains the amount of time warping that may occur without audible distortion as discussed in the previous paragraph. However, as will be appreciated by persons skilled in the relevant art(s), in a system that tolerates some sample delay after the first received frame after packet loss, time-warping may be applied to the decoded speech signal beyond the first good frame, thereby allowing adjustment for greater time lags without audible distortion. Of course, in such a system, if the frame after the first received frame is lost, then time-warping can only be applied to the decoded speech signal associated with the first good frame. Such an alternative embodiment is also within the scope and spirit of the present invention.

In an alternative embodiment of the present invention, time-warping is performed on both the decoded speech signal and the extrapolated speech signal. Such a method may provide improved performance for a variety of reasons.

For example, if the time lag is −20, then the decoded speech signal would be shrunk by 20 samples in accordance with the foregoing methods. This means that 20 samples of the extrapolated speech signal need to be generated for use in the first received frame. This number can be reduced by also shrinking the extrapolated speech signal. For example, the extrapolated speech signal could be shrunk by 4 samples, leaving 16 samples for the decoded speech signal. This reduces the amount of samples of extrapolated signal that must be used in the first received frame and also reduces the amount of warping that must be performed on the decoded speech signal. As noted above, in the embodiment of Section D, it was found that time-warping needed to be limited to 28 samples. A reduction in the amount of time-warping required to align the signals means there is less distortion introduced in the time-warping, and it also increases the number of cases that can be improved.

By time-warping both the decoded speech signal and the extrapolated speech signal, a better waveform match within the overlap-add region should also be obtained. The explanation is as follows; if the lag is −20 samples as in the previous example, this means that the decoded speech signal leads the extrapolated signal by 20 samples. The most likely cause of this is that the pitch period used for the extrapolation was larger than the true pitch. By also shrinking the extrapolated speech signal, the effective pitch of that signal in the overlap-add region becomes smaller, which should be closer to the true pitch period. Also, by shrinking the original signal less, the effective pitch period of that signal is larger than if it is used exclusively in the shrinking. Hence, the two waveforms in the overlap-add region will have a pitch period that more closely matches, and therefore the waveforms should have a better match.

If the lag is positive, the decoded speech signal is stretched. In this case, it is not clear if an improvement is obtained since stretching the extrapolated signal will increase the number of extrapolated samples that must be generated for use in the first received frame. However, if there has been extended packet loss and the two waveforms are significantly out of phase, then this method may provide improved performance. For example, if the lag is 30 samples, in a previously-described approach no warping is performed since it is greater than the constraint of 28 samples. Warping by 30 samples would most likely introduce distortions itself However, if the 30 samples were spread between the two signals, such as 10 samples of stretching for the extrapolated speech signal and 20 samples for the decoded speech signal, then they could be brought into alignment without having to apply too much time-warping.

D. Details of Example Implementation in a G.722 Decoder

This section provides specific details relating to a particular implementation of the present invention in an ITU-T Recommendation G.722 speech decoder. This example implementation operates on an intrinsic 10 millisecond (ms) frame size and can operate on any packet or frame size being a multiple of 10 ms. A longer input frame is treated as a super frame for which the PLC logic is called at its intrinsic frame size of 10 ms an appropriate number of times. It results in no additional delay when compared with regular G.722 decoding using the same frame size. These implementation details and those set forth below are provided by way of example only and are not intended to limit the present invention.

The embodiment described in this section meets the same complexity requirements as the PLC algorithm described in G.722 Appendix IV but provides significantly better speech quality than the PLC algorithm described in that Appendix. Due to its high quality, the embodiment described in this section is suitable for general applications of G.722 that may encounter frame erasures or packet loss. Such applications may include, for example, Voice over Internet Protocol (VoIP), Voice over Wireless Fidelity (WiFi), and Digital Enhanced Cordless Telecommunications (DECT) Next Generation. The embodiment described in this section is easy to accommodate, except for applications where there is practically no complexity headroom left after implementing the basic G.722 decoder without PLC.

1. Abbreviations and Conventions

Some abbreviations used in this section are listed below in Table 1.

TABLE 1

Abbreviations

| Abbreviation | Description |
|---|---|
| ADPCM | Adaptive Differential PCM |
| ANSI | American National Standards Institute |
| dB | Decibel |
| DECT | Digital Enhanced Cordless Telecomminucations |
| DC | Direct Current |
| FIR | Finite Impulse Response |
| Hz | Hertz |
| LPC | Linear Predictive Coding |
| OLA | OverLap-Add |
| PCM | Pulse Code Modulation |
| PLC | Packet Loss Concealment |
| PWE | Periodic Waveform Extrapolation |
| STL2005 | Software Tool Library 2005 |
| QMF | Quadratic Mirror Filter |
| VoIP | Voice over Internet Protocol |

TABLE 1-continued

| Abbreviations | |
|---|---|
| Abbreviation | Description |
| WB | WideBand |
| WiFi | Wireless Fidelity |

The description will also use certain conventions, some of which will now be explained. The PLC algorithm operates at an intrinsic frame size of 10 ms, and hence, the algorithm is described for 10 ms frame only. For packets of a larger size (multiples of 10 ms) the received packet is decoded in 10 ms sections. The discrete time index of signals at the 16 kHz sampling rate level is generally referred to using either "j" or "i." The discrete time of signals at the 8 kHz sampling level is typically referred to with an "n." Low-band signals (0-4 kHz) are identified with a subscript "L" and high-band signals (4-8 kH) are identified with a subscript "H." Where possible, this description attempts to re-use the conventions of ITU-T G.722.

A list of some of the most frequently used symbols and their description is provided in Table 2, below.

TABLE 2

| Frequently-Used Symbols and their Description | |
|---|---|
| Symbol | Description |
| $x_{out}(j)$ | 16 kHz G.722 decoder output |
| $x_{PLC}(i)$ | 16 kHz G.722 PLC output |
| w(j) | LPC window |
| $x_w(j)$ | Windowed speech |
| r(i) | Autocorrelation |
| $\hat{r}(i)$ | Autocorrelation after spectral smoothing and white noise correction |
| $\hat{a}_i$ | Intermediate LPC predictor coefficients |
| $a_i$ | LPC predictor coefficients |
| d(j) | 16 kHz short-term prediction error signal |
| avm | Average magnitude |
| $a'_i$ | Weighted short-term synthesis filter coefficients |
| xw(j) | 16 kHz weighted speech |
| xwd(n) | Down-sampled weighted speech (2 kHz) |
| $b_i$ | 60th order low-pass filter for down-sampling |
| c(k) | Correlation for coarse pitch analysis (2 kHz) |
| E(k) | Energy for coarse pitch analysis (2 kHz) |
| c2(k) | Signed squared correlation for coarse pitch analysis (2 kHz) |
| cpp | Coarse pitch period |
| cpplast | Coarse pitch period of last frame |
| Ei(j) | Interpolated E(k) (to 16 kHz) |
| c2i(j) | Interpolated c2(k) (to 16 kHz) |
| $\hat{E}(k)$ | Energy for pitch refinement (16 kHz) |
| $\hat{c}(k)$ | Correlation for pitch refinement (16 kHz) |
| ppfe | Pitch period for frame erasure |
| ptfe | Pitch tap for frame erasure |
| ppt | Pitch predictor tap |
| merit | Figure of merit of periodicity |
| Gr | Scaling factor for random component |
| Gp | Scaling factor for periodic component |
| ltring(j) | Long-term (pitch) ringing |
| ring(j) | Final ringing (including short-term) |
| wi(j) | Fade-in window |
| wo(j) | Fade-out window |
| wn(j) | Output of noise generator |
| wgn(j) | Scaled output of noise generator |
| fn(j) | Filtered and scaled noise |
| cfecount | Counter of consecutive 10 ms frame erasures |
| $w_i(j)$ | Window for overlap-add |
| $w_o(j)$ | Window for overlap-add |
| $h_i$ | QMF filter coefficients |
| $x_L(n)$ | Low-band subband signal (8 kHz) |
| $x_H(n)$ | High-band subband signal (8 kHz) |
| $I_L(n)$ | Index for low-band ADPCM coder (8 kHz) |
| $I_H(n)$ | Index for high-band ADPCM coder (8 kHz) |

TABLE 2-continued

| Frequently-Used Symbols and their Description | |
|---|---|
| Symbol | Description |
| $s_{Lz}(n)$ | Low-band predicted signal, zero section contribution |
| $s_{Lp}(n)$ | Low-band predicted signal, pole section contribution |
| $s_L(n)$ | Low-band predicted signal |
| $e_L(n)$ | Low-band prediction error signal |
| $r_L(n)$ | Low-band reconstructed signal |
| $p_{Lt}(n)$ | Low-band partial reconstructed truncated signal |
| $\nabla_L(n)$ | Low-band log scale factor |
| $\Delta_L(n)$ | Low-band scale factor |
| $\nabla_{L,m1}(n)$ | Low-band log scale factor, 1st mean |
| $\nabla_{L,m2}(n)$ | Low-band log scale factor, 2nd mean |
| $\nabla_{L,trck}(n)$ | Low-band log scale factor, tracking |
| $\nabla_{L,chng}(n)$ | Low-band log scale factor, degree of change |
| $\beta_L(n)$ | Stability margin of low-band pole section |
| $\beta_{L,MA}(n)$ | Moving average of stability margin of low-band pole section |
| $\beta_{L,min}$ | Minimum stability margin of low-band pole section |
| $s_{Hz}(n)$ | High-band predicted signal, zero section contribution |
| $s_{Hp}(n)$ | High-band predicted signal, pole section contribution |
| $s_H(n)$ | High-band predicted signal |
| $e_H(n)$ | High-band prediction error signal |
| $r_H(n)$ | High-band reconstructed signal |
| $r_{H,HP}(n)$ | High-band high-pass filtered reconstructed signal |
| $p_H(n)$ | High-band partial reconstructed signal |
| $p_{H,HP}(n)$ | High-band high-pass filtered partial reconstructed signal |
| $\nabla_H(n)$ | High-band log scale factor |
| $\nabla_{H,m}(n)$ | High-band log scale factor, mean |
| $\nabla_{H,trck}(n)$ | High-band log scale factor, tracking |
| $\nabla_{H,chng}(n)$ | High-band log scale factor, degree of change |
| $\alpha_{LP}(n)$ | Coefficient for low-pass filtering of high-band log scale factor |
| $\nabla_{H,LP}(n)$ | Low-pass filtered high-band log scale factor |
| $r_{Le}(n)$ | Estimated low-band reconstructed error signal |
| es(n) | Extrapolated signal for time lag calculation of re-phasing |
| $R_{SUB}(k)$ | Sub-sampled normalized cross-correlation |
| R(k) | Normalized cross-correlation |
| $T_{LSUB}$ | Sub-sampled time lag |
| $T_L$ | Time lag for re-phasing |
| $es_{tw}(n)$ | Extrapolated signal for time lag refinement for time-warping |
| $T_{Lwarp}$ | Time lag for time-warping |
| $x_{warp}(j)$ | Time-warped signal (16 kHz) |
| $es_{ola}(j)$ | Extrapolated signal for overlap-add (16 kHz) |

2. General Description of PLC Algorithm

As described above in reference to FIG. 5, there are six types of frames that may be processed by decoder/PLC system 300: Type 1, Type 2, Type 3, Type 4, Type 5, and Type 6. A Type 1 frame is any received frame beyond the eighth received frame after a packet loss. A Type 2 frame is either of the first and second lost frames associated with a packet loss. A Type 3 frame is any of the third through sixth lost frames associated with a packet loss. A Type 4 frame is any lost frame beyond the sixth frame associated with a packet loss. A Type 5 frame is any received frame that immediately follows a packet loss. Finally, a Type 6 frame is any of the second through eighth received frames that follow a packet loss. The PLC algorithm described in this section operates on an intrinsic frame size of 10 ms in duration.

Type 1 frames are decoded in accordance with normal G.722 operations with the addition of maintaining some state memory and processing to facilitate the PLC and associated processing. FIG. 15 is a block diagram 1500 of the logic that performs these operations in accordance with an embodiment of the present invention. In particular, as shown in FIG. 15, during processing of a Type 1 frame, the index for a low-band ADPCM coder, $I_L(n)$, is received from a bit de-multiplexer (not shown in FIG. 15) and is decoded by a low-band ADPCM decoder 1510 to produce a sub-band speech signal. Similarly, the index for a high-band ADPCM coder, $I_H(n)$, is received from the bit de-multiplexer and is decoded by a high-band ADPCM decoder 1520 to produce a sub-band speech signal. The low-band speech signal and the high-band speech signal are combined by QMF synthesis filter bank 1530 to produce the decoder output signal $x_{out}(j)$. These operations are consistent with normal G.722 decoding.

In addition to these normal G.722 decoding operations, during the processing of a Type 1 frame, a logic block 1540 operates to update a PLC-related low-band ADPCM state memory, a logic block 1550 operates to update a PLC-related high-band ADPCM state memory, and a logic block 1560 operates to update a WB PCM PLC-related state memory. These state memory updates are performed to facilitate PLC processing that may occur in association with other frame types.

Wideband (WB) PCM PLC is performed in the 16 kHz output speech domain for frames of Type 2, Type 3 and Type 4. A block diagram 1600 of the logic used to perform WB PCM PLC is provided in FIG. 16. Past output speech, $x_{out}(j)$, of the G.722 decoder is buffered and passed to the WB PCM PLC logic. The WB PCM PLC algorithm is based on Periodic Waveform Extrapolation (PWE), and pitch estimation is an important component of the WB PCM PLC logic. Initially, a coarse pitch is estimated based on a down-sampled (to 2 kHz) signal in the weighted speech domain. Subsequently, this estimate is refined at full resolution using the original 16 kHz sampling. The output of the WB PCM PLC logic, $x_{PLC}(i)$, is a linear combination of the periodically extrapolated waveform and noise shaped by LPC. For extended erasures the output waveform, $x_{PLC}(i)$, is gradually muted. The muting starts after 20 ms of frame loss and is complete after 60 ms of loss.

As shown in the block diagram 1700 of FIG. 17, for frames of Type 2, Type 3 and Type 4, the output of the WB PCM PLC logic, $x_{PLC}(i)$, is passed through a G.722 QMF analysis filter bank 1702 to obtain corresponding sub-band signals that are subsequently passed to a modified low-band ADPCM encoder 1704 and a modified high-band ADPCM encoder 1706, respectively, in order to update the states and memory of the decoder. Only partial simplified sub-band ADPCM encoders are used for this update.

The processing performed by the logic shown in FIG. 16 and FIG. 17 takes place during lost frames. The modified low-band ADPCM encoder 1704 and the modified high-band ADPCM encoder 1706 are each simplified to reduce complexity. They are described in detail elsewhere herein. One feature present in encoders 1704 and 1706 that is not present in regular G.722 sub-band ADPCM encoders is an adaptive reset of the encoders based on signal properties and duration of the packet loss.

The most complex processing associated with the PLC algorithm takes place for a Type 5 frame, which is the first received frame immediately following a packet loss. This is the frame during which a transition from extrapolated waveform to normally-decoded waveform takes place. Techniques used during the processing of a Type 5 frame include rephasing and time-warping, which will be described in more detail herein. FIG. 18 provides a block diagram 1800 of logic used for performing these techniques. Additionally, during processing of a Type 5 frame, the QMF synthesis filter bank at the decoder is updated in a manner described in more detail herein. Another function associated with the processing of a Type 5 frame include adaptive setting of low-band and high-band log-scale factors at the beginning of the first received frame after a packet loss.

Frames of Type 5 and Type 6 are both decoded with modified and constrained sub-band ADPCM decoders. FIG. 19 depicts a block diagram 1900 of the logic used for processing frames of Type 5 and Type 6. As shown in FIG. 19, logic 1970 imposes constraints and controls on sub-band ADPCM decoders 1910 and 1920 during the processing of Type 5 and/or Type 6 frames. The constraint and control of the sub-band ADPCM decoders is imposed during the first 80 ms after packet loss. Some do not extend beyond 40 ms, while others are adaptive in duration or degree. The constraint and control mechanisms will be described in more detail herein. As shown in FIG. 19, logic blocks 1940, 1950 and 1960 are used to update state memories after the processing of a Type 5 or Type 6 frame.

In error-free channel conditions, the PLC algorithm described in this section is bit-exact with G.722. Furthermore, in error conditions, the algorithm is identical to G.722 beyond the $8^{th}$ frame after packet loss, and without bit-errors, convergence towards the G.722 error-free output should be expected.

The PLC algorithm described in this section supports any packet size that is a multiple of 10 ms. The PLC algorithm is simply called multiple times per packet at 10 ms intervals for packet sizes greater than 10 ms. Accordingly, in the remainder of this section, the PLC algorithm is described in this context in terms of the intrinsic frame size of 10 ms.

3. Waveform Extrapolation of G.722 Output

For lost frames corresponding to packet loss (Type 2, Type 3 and Type 4 frames), the WB PCM PLC logic depicted in FIG. 16 extrapolates the G.722 output waveform $x_{out}(j)$ associated with the previous frames to generate a replacement waveform for the current frame. This extrapolated wideband signal waveform $x_{PLC}(i)$ is then used as the output waveform of the G.722 PLC logic during the processing of Type 2, Type 3, and Type 4 frames. For convenience of describing various blocks in FIG. 16, after the signal $x_{PLC}(i)$ has been calculated by the WB PCM PLC logic for lost frames, the signal $x_{PLC}(i)$ is considered to be written to a buffer that stores $x_{out}(j)$, which is the final output of the entire G.722 decoder/PLC system. Each processing block of FIG. 16 will now be described in more detail.

a. Eighth-Order LPC Analysis

Block 1604 is configured to perform $8^{th}$-order LPC analysis near the end of a frame processing loop after the $x_{out}(j)$ signal associated with the current frame has been calculated and stored in a buffer. This 8th-order LPC analysis is a type of autocorrelation LPC analysis, with a 10 ms asymmetric analysis window applied to the $x_{out}(j)$ signal associated with the current frame. This asymmetric window is given by:

$$w(j) = \begin{cases} \frac{1}{2}\left[1 - \cos\left(\frac{(j+1)\pi}{121}\right)\right], & \text{for } j = 0, 1, 2, \ldots, 119 \\ \cos\left(\frac{(j-120)\pi}{80}\right), & \text{for } j = 120, 121, \ldots, 159 \end{cases} \quad (4)$$

Let $x_{out}(0)$, $x_{out}(1)$, . . . , $x_{out}(159)$ represent the G.722 decoder/PLC system output wideband signal samples associated with the current frame. The windowing operation is performed as follows:

$$x_w(j) = x_{out}(j)w(j), j = 0, 1, 2, \ldots, 159. \quad (5)$$

Next, the autocorrelation coefficients are calculated as follows:

$$r(i) = \sum_{j=1}^{159} x_w(j)x_w(j-i),\ i = 0, 1, 2, \ldots, 8. \tag{6}$$

Spectral smoothing and white noise correction operations are then applied to the autocorrelation coefficients as follows:

$$\hat{r}(i) = \begin{cases} 1.0001 \times r(0), & i = 0 \\ r(i)e^{\frac{-(2\pi i\sigma/f_s)^2}{2}}, & i = 1, 2, \ldots, 8, \end{cases} \tag{7}$$

where $f_s$=16000 is the sampling rate of the input signal and $\sigma$=40.

Next, Levinson-Durbin recursion is used to convert the autocorrelation coefficients $\hat{r}(i)$ to the LPC predictor coefficients $\hat{a}_i$, i=0, 1, . . . , 8. If the Levinson-Durbin recursion exits pre-maturely before the recursion is completed (for example, because the prediction residual energy E(i) is less than zero), then the short-term predictor coefficients associated with the last frame are also used in the current frame. To handle exceptions in this manner, there needs to be an initial value of the $\hat{a}_i$ array. The initial value of the $\hat{a}_i$ array is set to $\hat{a}_0$=1 and $\hat{a}_i$=0 for i=1, 2, . . . , 8. The Levinson-Durbin recursion algorithm is specified below:

1. If $\hat{r}(0) \leqq 0$, use the $\hat{a}_i$, array of the last frame, and exit the Levinson-Durbin recursion
2. $E(0) = \hat{r}(0)$
3. $k_1 = -\hat{r}(1) / \hat{r}(0)$
4. $\hat{a}_1^{(1)} = k_1$
5. $E(1) = (1 - k_1^2)E(0)$
6. If $E(1) \leqq 0$, use the $\hat{a}_i$, array of the last frame, and exit the Levinson-Durbin recursion
7. For i = 2, 3, 4, . . . , 8, do the following:

a. $$k_i = \frac{-\hat{r}(i) - \sum_{j=1}^{i-1} \hat{a}_j^{(i-1)}\hat{r}(i-j)}{E(i-1)}$$

b. $\hat{a}_i^{(i)} = k_i$
c. $\hat{a}_j^{(i)} = \hat{a}_j^{(i-1)} + k_i\hat{a}_{i-j}^{(i-1)}$, for j =1, 2, . . . , i − 1
d. $E(i) = (1 - k_i^2)E(i-1)$
e. If $E(i) \leqq 0$ , use the $\hat{a}_i$, array of the last frame and exit the Levinson-Durbin recursion If the recursion exits pre-maturely, the $\hat{a}_i$ array of the previously-processed frame is used. If the recursion is completed successfully (which is normally the case), the LPC predictor coefficients are taken as:

$$\hat{a}_0 = 1 \tag{8}$$

and $$\hat{a}_i = \hat{a}_i^{(8)},\ \text{for } i = 1, 2, \ldots, 8. \tag{9}$$

By applying a bandwidth expansion operation to the coefficients derived above, the final set of LPC predictor coefficients is obtained as:

$$a_i = (0.96852)^i\hat{a}_i,\ \text{for } i = 0, 1, \ldots, 8. \tag{10}$$

b. Calculation of Short-Term Prediction Residual Signal

Block 1602 of FIG. 16, labeled "A(z)" represents a short-term linear prediction error filter, with the filter coefficients of $a_i$ for i=0, 1, . . . , 8 as calculated above. Block 1602 is configured to operate after the 8-th order LPC analysis is performed. Block 1602 calculates a short-term prediction residual signal d(j) as follows:

$$d(j) = x_{out}(j) + \sum_{i=1}^{8} a_i \cdot x_{out}(j-i) \text{ for } j = 0, 1, 2, \ldots, 159. \tag{11}$$

As is conventional, the time index n of the current frame continues from the time index of the previously-processed frame. In other words, if the time index range of 0, 1, 2, . . . , 159 represents the current frame, then the time index range of −160, −159, . . . , −1 represents the previously-processed frame. Thus, in the equation above, if the index (j−i) is negative, the index points to a signal sample near the end of the previously-processed frame.

c. Calculation of Scaling Factor

Block 1606 in FIG. 16 is configured to calculate the average magnitude of the short-term prediction residual signal associated with the current frame. This operation is performed after the short-term prediction residual signal d(j) is calculated by block 1602 in a manner previously described. The average magnitude avm is calculated as follows:

$$avm = \frac{1}{160}\sum_{j=0}^{159} |d(j)|. \tag{12}$$

If the next frame to be processed is a lost frame (in other words, a frame corresponding to a packet loss), this average magnitude avm may be used as a scaling factor to scale a white Gaussian noise sequence if the current frame is sufficiently unvoiced.

d. Calculation of Weighted Speech Signal

Block 1608 of FIG. 16, labeled "1/A(z/y)" represents a weighted short-term synthesis filter. Block 1608 is configured to operate after the short-term prediction residual signal d(j) has been calculated for the current frame in the manner described above in reference to block 1602. The coefficients of this weighted short-term synthesis filter, $a'_i$ for i=0, 1, . . . , 8, are calculated as follows with $\gamma_1$=0.75:

$$a'_i = \gamma_1^i a_i,\ \text{for } i = 1, 2, \ldots, 8. \tag{13}$$

The short term prediction residual signal d(j) is passed through this weighted short-term synthesis filter. The corresponding output weighted speech signal xw(j) is calculated as $$xw(j) = d(j) - \sum_{i=1}^{8} a'_i \cdot xw(j-i),\ \text{for } j = 0, 1, 2, \ldots, 159. \tag{14}$$

e. Eight-to-One Decimation

Block 1616 of FIG. 16 passes the weighted speech signal output by block 1608 through a $60^{th}$-order minimum-phase finite impulse response (FIR) filter, and then 8:1 decimation is performed to down-sample the resulting 16 kHz low-pass filtered weighted speech signal to a 2 kHz down-sampled weighted speech signal xwd(n). This decimation operation is performed after the weighted speech signal xw(j) is calculated. To reduce complexity, the FIR low-pass filtering operation is carried out only when a new sample of xwd(n) is needed. Thus, the down-sampled weighted speech signal xwd (n) is calculated as $$xwd(n) = \sum_{i=0}^{59} b_i \cdot xw(8n + 7 - i), \text{ for } n = 0, 1, 2, \ldots, 19, \tag{15}$$

where $b_i$, i=0, 1, 2, . . . , 59 are the filter coefficients for the 60th-order FIR low-pass filter as given in Table 3.

TABLE 3

Coefficients for 60th order FIR filter

| Lag, i | $b_i$ in Q15 | Lag, i | $b_i$ in Q15 | Lag, i | $b_i$ in Q15 |
|---|---|---|---|---|---|
| 0 | 1209 | 20 | −618 | 40 | 313 |
| 1 | 728 | 21 | −941 | 41 | 143 |
| 2 | 1120 | 22 | −1168 | 42 | −6 |
| 3 | 1460 | 23 | −1289 | 43 | −126 |
| 4 | 1845 | 24 | −1298 | 44 | −211 |
| 5 | 2202 | 25 | −1199 | 45 | −259 |
| 6 | 2533 | 26 | −995 | 46 | −273 |
| 7 | 2809 | 27 | −701 | 47 | −254 |
| 8 | 3030 | 28 | −348 | 48 | −210 |
| 9 | 3169 | 29 | 20 | 49 | −152 |
| 10 | 3207 | 30 | 165 | 50 | −89 |
| 11 | 3124 | 31 | 365 | 51 | −30 |
| 12 | 2927 | 32 | 607 | 52 | 21 |
| 13 | 2631 | 33 | 782 | 53 | 58 |
| 14 | 2257 | 34 | 885 | 54 | 81 |
| 15 | 1814 | 35 | 916 | 55 | 89 |
| 16 | 1317 | 36 | 881 | 56 | 84 |
| 17 | 789 | 37 | 790 | 57 | 66 |
| 18 | 267 | 38 | 654 | 58 | 41 |
| 19 | −211 | 39 | 490 | 59 | 17 |

f. Coarse Pitch Period Extraction

To reduce computational complexity, the WB PCM PLC logic performs pitch extraction in two stages: first, a coarse pitch period is determined with a time resolution of the 2 kHz decimated signal, then pitch period refinement is performed with a time resolution of the 16 kHz undecimated signal. Such pitch extraction is performed only after the down-sampled weighted speech signal xwd(n) is calculated. This sub-section describes the first-stage coarse pitch period extraction algorithm which is performed by block 1620 of FIG. 16. This algorithm is based on maximizing the normalized cross-correlation with some additional decision logic.

A pitch analysis window of 15 ms is used in the coarse pitch period extraction. The end of the pitch analysis window is aligned with the end of the current frame. At a sampling rate of 2 kHz, 15 ms correspond to 30 samples. Without loss of generality, let the index range of n=0 to n=29 correspond to the pitch analysis window for xwd(n). The coarse pitch period extraction algorithm starts by calculating the following values:

$$c(k) = \sum_{n=0}^{29} xwd(n)xwd(n-k), \tag{16}$$

$$E(k) = \sum_{n=0}^{29} [xwd(n-k)]^2, \tag{17}$$

and

-continued $$c2(k) = \begin{cases} c^2(k), & \text{if } c(k) \geq 0 \\ -c^2(k), & \text{if } c(k) < 0, \end{cases} \tag{18}$$

for all integers from k=MINPPD−1 to k=MAXPPD+1, where MINPPD=5 and MAXPPD=33 are the minimum and maximum pitch period in the decimated domain, respectively. The coarse pitch period extraction algorithm then searches through the range of k=MINPPD, MINPPD+1, MINPPD+2, . . . , MAXPPD to find all local peaks of the array {c2(k)/E(k)} for which c(k)>0. (A value is characterized as a local peak if both of its adjacent values are smaller.) Let $N_p$ denote the number of such positive local peaks. Let $k_p(j)$, j=1, 2, . . . , $N_p$ be the indices where $c2(k_p(j))/E(k_p(j))$ is a local peak and $c(k_p(j))>0$, and let $k_p(1)<k_p(2)< \ldots <k_p(N_p)$. For convenience, the term c2(k)/E(k) will be referred to as the "normalized correlation square."

If $N_p=0$—that is, if there is no positive local peak for the function c2(k)/E(k)—then the algorithm searches for the largest negative local peak with the largest magnitude of |c2(k)/E(k)|. If such a largest negative local peak is found, the corresponding index k is used as the output coarse pitch period cpp, and the processing of block 1620 is terminated. If the normalized correlation square function c2(k)/E(k) has neither positive local peak nor negative local peak, then the output coarse pitch period is set to cpp=MINPPD, and the processing of block 1620 is terminated. If $N_p=1$, the output coarse pitch period is set to cpp=$k_p(1)$, and the processing of block 1620 is terminated.

If there are two or more local peaks ($N_p \geqq 2$), then this block uses Algorithms A, B, C, and D (to be described below), in that order, to determine the output coarse pitch period cpp. Variables calculated in the earlier algorithms of the four will be carried over and used in the later algorithms.

Algorithm A below is used to identify the largest quadratically interpolated peak around local peaks of the normalized correlation square $c2(k_p)/E(k_p)$. Quadratic interpolation is performed for $c(k_p)$, while linear interpolation is performed for $E(k_p)$. Such interpolation is performed with the time resolution of the 16 kHz undecimated speech signal. In the algorithm below, D denotes the decimation factor used when decimating xw(n) to xwd(n). Thus, D=8 here.

Algorithm A - Find the largest quadratically interpolated peak around $c2(k_p)/E(k_p)$:

A. Set c2max = −1, Emax = 1, and jmax = 0.
B. For j =1, 2, ..., $N_p$, do the following 12 steps:
  1. Set a = 0.5 [$c(k_p(j) + 1) + c(k_p(j) - 1)$]− $c(k_p(j))$
  2. Set b = 0.5 [$c(k_p(j) + 1) - c(k_p(j) - 1)$]
  3. Set ji = 0
  4. Set ei = $E(k_p(j))$
  5. Set c2m = $c2(k_p(j))$
  6. Set Em = $E(k_p(j))$
  7. If $c2(k_p(j) + 1)E(k_p(j) - 1) > c2(k_p(j) - 1)E(k_p(j) + 1)$, do the remaining part of step 7:
    a. Δ = [$E(k_p(j) + 1)$ − ei]/D
    b. For k = 1, 2, ... , D/2, do the following indented part of step 7:
      i. ci = a $(k / D)^2$ + b (k / D) + $c(k_p(j))$
      ii. ei ← ei + Δ
      iii. If $(ci)^2$ Em > (c2m) ei , do the next three indented lines:
        a. ji = k
        b. c2m = $(ci)^2$
        c. Em = ei -continued Algorithm A - Find the largest quadratically interpolated peak around $c2(k_p)/E(k_p)$:

8. If $c2(k_p(j) + 1)E(k_p(j) - 1) \leqq c2(k_p(j) - 1)E(k_p(j) + 1)$ do the remaining part of step 8:
    a. $\Delta = [E(k_p(j) - 1) - ei]/D$
    b. For $k = -1, -2, \ldots, -D/2$, do the following indented part of step 8:
        i. $ci = a (k / D)^2 + b (k / D) + c(k_p(j))$
        ii. $ei \leftarrow ei + \Delta$
        iii. If $(ci)^2 Em > (c2m) ei$, do the next three indented lines:
            a. $ji = k$
            b. $c2m = (ci)^2$
            c. $Em = ei$
9. Set $lag(j) = k_p(j) + ji / D$
10. Set $c2i(j) = c2m$
11. Set $Ei(j) = Em$
12. If $c2m \times Emax > c2max \times Em$, do the following three indented lines:
    a. $jmax = j$
    b. $c2max = c2m$
    c. $Emax = Em$ The symbol ← indicates that the parameter on the left-hand side is being updated with the value on the right-hand side.

To avoid selecting a coarse pitch period that is around an integer multiple of the true coarse pitch period, a search through the time lags corresponding to the local peaks of $c2(k_p)/E(k_p)$ is performed to see if any of such time lags is close enough to the output coarse pitch period of the previously-processed frame, denoted as cpplast. (For the very first frame, cpplast is initialized to 12.) If a time lag is within 25% of cpplast, it is considered close enough. For all such time lags within 25% of cpplast, the corresponding quadratically interpolated peak values of the normalized correlation square $c2(k_p)/E(k_p)$ are compared, and the interpolated time lag corresponding to the maximum normalized correlation square is selected for further consideration. Algorithm B below performs the task described above. The interpolated arrays c2i(j) and Ei(j) calculated in Algorithm A above are used in this algorithm.

Algorithm B - Find the time lag maximizing interpolated $c2(k_p)/E(k_p)$ among all time lags close to the output coarse pitch period of the last frame:

A. Set index $im = -1$
B. Set $c2m = -1$
C. Set $Em = 1$
D. For $j = 1, 2, \ldots, N_p$, do the following:
    1. If $|k_p(j) - cpplast| \leqq 0.25 \times cpplast$, do the following:
        a. If $c2i(j) \times Em > c2m \times Ei(j)$, do the following three lines:
            i. $im = j$
            ii. $c2m = c2i(i)$
            iii. $Em = Ei(j)$ Note that if there is no time lag $k_p(j)$ within 25% of cpplast, then the value of the index im will remain at −1 after Algorithm B is performed. If there are one or more time lags within 25% of cpplast, the index im corresponds to the largest normalized correlation square among such time lags.

Next, Algorithm C determines whether an alternative time lag in the first half of the pitch range should be chosen as the output coarse pitch period. This algorithm searches through all interpolated time lags lag(j) that are less than 16, and checks whether any of them has a large enough local peak of normalized correlation square near every integer multiple of it (including itself) up to 32. If there are one or more such time lags satisfying this condition, the smallest of such qualified time lags is chosen as the output coarse pitch period.

Again, variables calculated in Algorithms A and B above carry their final values over to Algorithm C below. In the following, the parameter MPDTH is 0.06, and the threshold array MPTH(k) is given as MPTH(2)=0.7, MPTH(3)=0.55, MPTH(4)=0.48, MPTH(5)=0.37, and MPTH(k)=0.30, for k>5.

Algorithm C - Check whether an alternative time lag in the first half of the range of the coarse pitch period should be chosen as the output coarse pitch period:

A. For $j = 1, 2, 3, \ldots, N_p$, in that order, do the following while $lag(j) < 16$:
1. If $j \neq im$, set threshold = 0.73; otherwise, set threshold = 0.4.
2. If $c2i(j) \times Emax \leqq threshold \times c2max \times Ei(j)$, disqualify this j, skip step (3) for this j, increment j by 1 and go back to step (1).
3. If $c2i(j) \times Emax > threshold \times c2max \times Ei(j)$, do the following:
    a. For $k = 2, 3, 4, \ldots$, do the following while $k \times lag(j) < 32$:
        i. $s = k \times lag(j)$
        ii. $a = (1 - MPDTH) s$
        iii. $b = (1 + MPDTH) s$
        iv. Go through $m = j+1, j+2, j+3, \ldots, N_p$, in that order, and see if any of the time lags lag(m) is between a and b. If none of them is between a and b, disqualify this j, stop step 3, increment j by 1 and go back to step 1. If there is at least one such m that satisfies $a < lag(m) \leqq b$ and $c2i(m) \times Emax > MPTH(k) \times c2max \times Ei(m)$, then it is considered that a large enough peak of the normalized correlation square is found in the neighborhood of the k-th integer multiple of lag( j); in this case, stop step 3.a.iv, increment k by 1, and go back to step 3.a.i.
    b. If step 3.a is completed without stopping prematurely-that is, if there is a large enough interpolated peak of the normalized correlation square within ±100×MPDTH% of every integer multiple of lag(j) that is less than 32-then stop this algorithm, skip Algorithm D and set cpp = lag(j) as the final output coarse pitch period.

If Algorithm C above is completed without finding a qualified output coarse pitch period cpp, then Algorithm D examines the largest local peak of the normalized correlation square around the coarse pitch period of the last frame, found in Algorithm B above, and makes a final decision on the output coarse pitch period cpp. Again, variables calculated in Algorithms A and B above carry their final values over to Algorithm D below. In the following, the parameters are SMDTH=0.095 and LPTH1=0.78.

Algorithm D - Final Decision of the output coarse pitch period:

A. If $im = -1$, that is, if there is no large enough local peak of the normalized correlation square around the coarse pitch period of the last frame, then use the cpp calculated at the end of Algorithm A as the final output coarse pitch period, and exit this algorithm.

-continued

| Algorithm D - Final Decision of the output coarse pitch period: |
|---|
| B. If im = jmax, that is, if the largest local peak of the normalized correlation square around the coarse pitch period of the last frame is also the global maximum of all interpolated peaks of the normalized correlation square within this frame, then use the cpp calculated at the end of Algorithm A as the final output coarse pitch period, and exit this algorithm. |
| C. If im < jmax, do the following indented part: |
| 1. If c2m × Emax > 0.43 × c2max × Em, do the following indented part of step C: |
| a. If lag(im) > MAXPPD/2, set output cpp = lag(im) and exit this algorithm. |
| b. Otherwise, for k = 2, 3, 4, 5, do the following indented part: |
| i. s = lag(jmax) / k |
| ii. a = (1 − SMDTH) s |
| iii. b = (1 + SMDTH) s |
| iv. If lag(im) > a and lag(im) < b, set output cpp = lag(im) and exit this algorithm. |
| D. If im > jmax, do the following indented part: |
| 1. If c2m × Emax > LPTH1 × c2max × Em, set output cpp = lag(im) and exit this algorithm. |
| E. If algorithm execution proceeds to here, none of the steps above have selected a final output coarse pitch period. In this case, just accept the cpp calculated at the end of Algorithm A as the final output coarse pitch period. |

g. Pitch Period Refinement

Block 1622 in FIG. 16 is configured to perform the second-stage processing of the pitch period extraction algorithm by searching in the neighborhood of the coarse pitch period in full 16 kHz time resolution using the G.722 decoded output speech signal. This block first converts the coarse pitch period cpp to the undecimated signal domain by multiplying it by the decimation factor D, where D=8. The pitch refinement analysis windows size WSZ is chosen as the smaller of cpp×D samples and 160 samples (corresponding to 10 ms): WSZ=min (cpp×D, 160).

Next, the lower bound of the search range is calculated as lb=max(MINPP, cpp×D−4), where MINPP=40 samples is the minimum pitch period. The upper bound of the search range is calculated as ub=min(MAXPP, cpp×D+4), where MAXPP=265 samples is the maximum pitch period.

Block 1622 maintains a buffer of 16 kHz G.722 decoded speech signal $x_{out}(j)$ with a total of XQOFF=MAXPP+1+FRSZ samples, where FRSZ=160 is the frame size. The last FRSZ samples of this buffer contain the G.722 decoded speech signal of the current frame. The first MAXPP+1 samples are populated with the G.722 decoder/PLC system output signal in the previously-processed frames immediately before the current frame. The last sample of the analysis window is aligned with the last sample of the current frame. Let the index range from j=0 to j=WSZ−1 correspond to the analysis window, which is the last WSZ samples in the $x_{out}(j)$ buffer, and let negative indices denote the samples prior to the analysis window. The following correlation and energy terms in the undecimated signal domain are calculated for time lags k within the search range [lb, ub]:

$$\tilde{c}(k) = \sum_{j=0}^{WSZ-1} x_{out}(j)x_{out}(j-k) \tag{19}$$

and $$\tilde{E}(k) = \sum_{j=0}^{WSZ-1} x_{out}(j-k)^2. \tag{20}$$

The time lag k ∈[lb,ub] that maximizes the ratio $\tilde{c}^2(k)/\tilde{E}(k)$ is chosen as the final refined pitch period for frame erasure, or ppfe. That is, $$ppfe = \underset{k\in[lb,ub]}{\operatorname{argmax}}\left[\frac{\tilde{c}^2(k)}{\tilde{E}(k)}\right]. \tag{21}$$

Next, block 1622 also calculates two more pitch-related scaling factors. The first is called ptfe, or pitch tap for frame erasure. It is the scaling factor used for periodic waveform extrapolation. It is calculated as the ratio of the average magnitude of the $x_{out}(j)$ signal in the analysis window and the average magnitude of the portion of the $x_{out}(j)$ signal that is ppfe samples earlier, with the same sign as the correlation between these two signal portions:

$$ptfe = \operatorname{sign}(\tilde{c}(ppfe))\left[\frac{\sum_{j=0}^{WSZ-1}|x_{out}(j)|}{\sum_{j=0}^{WSZ-1}|x_{out}(j-ppfe)|}\right]. \tag{22}$$

In the degenerate case when $$\sum_{j=0}^{WSZ-1}|x_{out}(j-ppfe)| = 0,$$

ptfe is set to 0. After such calculation of ptfe, the value of ptfe is range-bound to [−1, 1].

The second pitch-related scaling factor is called ppt, or pitch predictor tap. It is used for calculating the long-term filter ringing signal (to be described later herein). It is calculated as ppt=0.75×ptfe.

h. Calculate Mixing Ratio

Block 1618 in FIG. 16 calculates a figure of merit to determine a mixing ratio between a periodically extrapolated waveform and a filtered noise waveform during lost frames. This calculation is performed only during the very first lost frame in each occurrence of packet loss, and the resulting mixing ratio is used throughout that particular packet loss. The figure of merit is a weighted sum of three signal features: logarithmic gain, first normalized autocorrelation, and pitch prediction gain. Each of them is calculated as follows.

Using the same indexing convention for $x_{out}(j)$ as in the previous sub-section, the energy of the $x_{out}(j)$ signal in the pitch refinement analysis window is $$sige = \sum_{j=0}^{WSZ-1} x_{out}^2(j), \tag{23}$$

and the base-2 logarithmic gain lg is calculated as $$lg = \begin{cases} \log_2(sige), & \text{if } sige \neq 0 \\ 0, & \text{if } sige = 0. \end{cases} \tag{24}$$

If $\tilde{E}(ppfe) \neq 0$, the pitch prediction residual energy is calculated as $$rese = sige - \tilde{c}^2(ppfe)/\tilde{E}(ppfe), \tag{25}$$

and the pitch prediction gain pg is calculated as $$pg = \begin{cases} 10\log_{10}\left(\frac{sige}{rese}\right), & \text{if } rese \neq 0 \\ 20, & \text{if } rese = 0. \end{cases} \tag{26}$$

If $\tilde{E}(ppfe)=0$, set pg=0. If sige=0, also set pg=0.

The first normalized autocorrelation $\rho_1$ is calculated as $$\rho_1 = \begin{cases} \left[\frac{\sum_{j=0}^{WSZ-2} x_{out}(j)x_{out}(j+1)}{sige}\right], & \text{if } sige \neq 0 \\ 0, & \text{if } sige = 0. \end{cases} \tag{27}$$

After these three signal features are obtained, the figure of merit is calculated as $$\text{merit} = 1g + pg + 12\rho_1. \tag{28}$$

The merit calculated above determines the two scaling factors Gp and Gr, which effectively determine the mixing ratio between the periodically extrapolated waveform and the filtered noise waveform. There are two thresholds used for merit: merit high threshold MHI and merit low threshold MLO. These thresholds are set as MHI=28 and MLO=20. The scaling factor Gr for the random (filtered noise) component is calculated as $$Gr = \frac{MHI - \text{merit}}{MHI - MLO}, \tag{29}$$

and the scaling factor Gp for the periodic component is calculated as $$Gp = 1 - Gr. \tag{30}$$

i. Periodic Waveform Extrapolation

Block 1624 in FIG. 16 is configured to periodically extrapolate the previous output speech waveform during the lost frames if merit>MLO. The manner in which block 1624 performs this function will now be described.

For the very first lost frame of each packet loss, the average pitch period increment per frame is calculated. A pitch period history buffer pph(m), m=1, 2, . . . , 5 holds the pitch period ppfe for the previous 5 frames. The average pitch period increment is obtained as follows. Starting with the immediate last frame, the pitch period increment from its preceding frame to that frame is calculated (negative value means pitch period decrement). If the pitch period increment is zero, the algorithm checks the pitch period increment at the preceding frame. This process continues until the first frame with a non-zero pitch period increment or until the fourth previous frame has been examined. If all previous five frames have identical pitch period, the average pitch period increment is set to zero. Otherwise, if the first non-zero pitch period increment is found at the m-th previous frame, and if the magnitude of the pitch period increment is less than 5% of the pitch period at that frame, then the average pitch period increment ppinc is obtained as the pitch period increment at that frame divided by m, and then the resulting value is limited to the range of [−1, 2].

In the second consecutive lost frame in a packet loss, the average pitch period increment ppinc is added to the pitch period ppfe, and the resulting number is rounded to the nearest integer and then limited to the range of [MINPP, MAXPP].

If the current frame is the very first lost frame of a packet loss, a so-called "ringing signal" is calculated for use in overlap-add to ensure smooth waveform transition at the beginning of the frame. The overlap-add length for the ringing signal and the periodically extrapolated waveform is 20 samples for the first lost frame. Let the index range of j=0, 1, 2, . . . , 19 corresponds to the first 20 samples of the current first lost frame, which is the overlap-add period, and let the negative indices correspond to previous frames. The long-term ringing signal is obtained as a scaled version of the short-term prediction residual signal that is one pitch period earlier than the overlap-add period:

$$ltring(j) = x_{out}(j - ppfe) + \sum_{i=1}^{8} a_i \cdot x_{out}(j - ppfe - i), \quad \text{for } j = 0, 1, 2, \ldots, 19. \tag{31}$$

After these 20 samples of ltring(j) are calculated, they are further scaled by the scaling factor ppt calculated by block 622:

$$ltring(j) \leftarrow ppt \cdot ltring(j), \text{ for } j = 0, 1, 2, \ldots, 19. \tag{32}$$

With the filter memory ring(j), j=−8, −7, . . . , −1 initialized to the last 8 samples of the $x_{out}(j)$ signal in the last frame, the final ringing signal is obtained as $$\text{ring}(j) = ltring(j) - \sum_{i=1}^{8} a_i \cdot \text{ring}(j - i), \quad \text{for } j = 0, 1, 2, \ldots, 19. \tag{33}$$

Let the index range of j=0, 1, 2, . . . , 159 correspond to the current first lost frame, and the index range of j=160, 161, 162, . . . , 209 correspond to the first 50 samples of the next frame. Furthermore, let wi(j) and wo(j), j=0, 1, . . . , 19, be the triangular fade-in and fade-out windows, respectively, so that wi(j)+wo(j)=1. Then, the periodic waveform extrapolation is performed in two steps as follows:

Step 1:

$$x_{out}(j)=wi(j)\cdot ptfe\cdot x_{out}(n-ppfe)+wo(j)\cdot \text{ring}(j), \text{ for } j=0, 1, 2, \ldots, 19. \quad (34)$$

Step 2:

$$x_{out}(j)=ptfe\cdot x_{out}(j-ppfe), \text{ for } j=20, 21, 22, \ldots, 209. \quad (35)$$

j. Normalized Noise Generator

If merit<MHI, block 1610 in FIG. 16 generates a sequence of white Gaussian random noise with an average magnitude of unity. To save computational complexity, the white Gaussian random noise is pre-calculated and stored in a table. To avoid using a very long table and avoid repeating the same noise pattern due to a short table, a special indexing scheme is used. In this scheme, the white Gaussian noise table wn(j) has 127 entries, and the scaled version of the output of this noise generator block is $$wgn(j)=avm\times wn(\text{mod}(cfe\text{count}\times j,127)), \text{ for } j=0, 1, 2, \ldots, 209, \quad (36)$$

where cfecount is the frame counter with cfecount=k for the k-th consecutive lost frame into the current packet loss, and mod(m,127)=m−127×⌊m/127⌋ is the modulo operation.

k. Filtering of Noise Sequence

Block 1614 in FIG. 16 represents a short-term synthesis filter. If merit<MHI, block 1614 filters the scaled white Gaussian noise to give it the same spectral envelope as that of the $x_{out}(j)$ signal in the last frame. The filtered noise fn(j) is obtained as $$fn(j) = wgn(j) - \sum_{i=1}^{8} a_i \cdot fn(j-i), \quad \text{for } j = 0, 1, 2, \ldots, 209. \quad (37)$$

l. Mixing of Periodic and Random Components

If merit>MHI, only the periodically extrapolated waveform $x_{out}(j)$ calculated by block 1624 is used as the output of the WB PCM PLC logic. If merit<MLO, only the filtered noise signal fn(j) produced by block 1614 is used as the output of the WB PCM PLC logic. If MLO≦merit≦MHI, then the two components are mixed as $$x_{out}(j)\leftarrow Gp\cdot x_{out}(j)+Gr\cdot fn(j), \text{ for } j=0, 1, 2, \ldots, 209. \quad (38)$$

The first 40 extra samples of extrapolated $x_{out}(j)$ signal for j=160, 161, 162, . . . , 199 will become the ringing signal ring(j), j=0, 1, 2, . . . , 39 of the next frame. If the next frame is again a lost frame, only the first 20 samples of this ringing signal will be used for the overlap-add. If the next frame is a received frame, then all 40 samples of this ringing signal will be used for the overlap-add.

m. Conditional Ramp Down

If the packet loss lasts 20 ms or less, the $x_{out}(j)$ signal generated by the mixing of periodic and random components is used as the WB PCM PLC output signal. If the packet loss lasts longer than 60 ms, the WB PCM PLC output signal is completely muted. If the packet loss lasts longer than 20 ms but no more than 60 ms, the $x_{out}(j)$ signal generated by the mixing of periodic and random components is linearly ramped down (attenuate toward zero in a linear fashion). This conditional ramp down is performed as specified in the following algorithm during the lost frames when cfecount>2. The array gawd( ) is given by {−52, −69, −104, −207} in Q15 format. Again the index range of j=0, 1, 2, . . . , 159 corresponds to the current frame of $x_{out}(j)$.

| Conditional Ramp-Down Algorithm: |
|---|
| A. If cfecount ≦ 6, do the next 9 indented lines: |
| 1. delta = gawd(cfecount−3) |
| 2. gaw = 1 |
| 3. For j = 0, 1, 2, ..., 159, do the next two lines: |
| a. $x_{out}(j)$ = gaw · $x_{out}(j)$ |
| b. gaw = gaw + delta |
| 4. If cfecount < 6, do the next three lines: |
| a. For j = 160, 161, 162, ..., 209, do the next two lines: |
| i. $x_{out}(j)$ = gaw · $x_{out}(j)$ |
| ii. gaw = gaw + delta |
| B. Otherwise (if cfecount > 6), set $x_{out}(j)$ = 0 for j = 0, 1, 2, ..., 209. |

n. Overlap-Add in the First Received Frame

For Type 5 frames, the output from the G.722 decoder $x_{out}(j)$ is overlap-added with the ringing signal from the last lost frame, ring(j) (calculated by block 1624 in a manner described above):

$$x_{out}(j)=w_i(j)\cdot x_{out}(j)+w_o(j)\cdot \text{ring}(j) j=0 \ldots L_{OLA}-1, \quad (39)$$

where $$L_{OLA} = \begin{cases} 8 & \text{if } G_p = 0 \\ 40 & \text{otherwise.} \end{cases} \quad (40)$$

4. Re-Encoding of PLC Output

To update the memory and parameters of the G.722 ADPCM decoders during lost frames (Type 2, Type 3 and Type 4 frames), the PLC output is in essence passed through a G.722 encoder. FIG. 17 is a block diagram 1700 of the logic used to perform this re-encoding process. As shown in FIG. 17, the PLC output $x_{out}(j)$ is passed through a QMF analysis filter bank 1702 to produce a low-band sub-band signal $x_L(n)$ and a high-band sub-band signal $x_H(n)$. The low-band sub-band signal $x_L(n)$ is encoded by a low-band ADPCM encoder 1704 and the high-band sub-band signal $x_H(n)$ is encoded by a high-band ADPCM encoder 1706. To save complexity, ADPCM sub-band encoders 1704 and 1706 are simplified as compared to conventional ADPCM sub-band encoders. Each of the foregoing operations will now be described in more detail.

a. Passing the PLC Output Through the QMF Analysis Filter Bank

A memory of QMF analysis filter bank 1702 is initialized to provide sub-band signals that are continuous with the decoded sub-band signals. The first 22 samples of the WB PCM PLC output constitutes the filter memory, and the sub-band signals are calculated according to $$x_L(n) = \sum_{i=0}^{11} h_{2i} \cdot x_{PLC}(23+j-2i) + \sum_{i=0}^{11} h_{2i+1} \cdot x_{PLC}(22+j-2i), \text{ and} \quad (41)$$

$$x_H(n) = \sum_{i=0}^{11} h_{2i} \cdot x_{PLC}(23+j-2i) - \sum_{i=0}^{11} h_{2i+1} \cdot x_{PLC}(22+j-2i), \quad (42)$$

where $x_{PLC}(0)$ corresponds to the first sample of the 16 kHz WB PCM PLC output of the current frame, $x_L(n=0)$ and $x_H(n=0)$ correspond to the first samples of the 8 kHz low-band and high-band sub-band signals, respectively, of the current frame. The filtering is identical to the transmit QMF of the G.722 encoder except for the extra 22 samples of offset, and that the WB PCM PLC output (as opposed to the input) is passed to the filter bank. Furthermore, in order to generate a full frame (80 samples~10 ms) of sub-band signals, the WB PCM PLC needs to extend beyond the current frame by 22 samples and generate (182 samples~11.375 ms). Sub-band signals $x_L(n)$, n=0, 1, . . . , 79, and $x_H(n)$, n=0, 1, . . . , 79, are generated according to Eq. 41 and 42, respectively.

b. Re-Encoding of Low-Band Signal

The low-band signal $x_L(n)$ is encoded with a simplified low-band ADPCM encoder. A block diagram of the simplified low-band ADPCM encoder 2000 is shown in FIG. 20. As can be seen in FIG. 20, the inverse quantizer of a normal low-band ADPCM encoder has been eliminated and the unquantized prediction error replaces the quantized prediction error. Furthermore, since the update of the adaptive quantizer is only based on an 8-member subset of the 64-member set represented by the 6-bit low-band encoder index, $I_L(n)$, the prediction error is only quantized to the 8-member set. This provides an identical update of the adaptive quantizer, yet simplifies the quantization. Table 4 lists the decision levels, output code, and multipliers for the 8-level simplified quantizer based on the absolute value of $e_L(n)$.

TABLE 4

Decisions levels, output code, and multipliers for the 8-level simplified quantizer

| $m_L$ | Lower threshold | Upper threshold | $I_L$ | Multiplier, $W_L$ |
|---|---|---|---|---|
| 1 | 0.00000 | 0.14103 | 3c | −0.02930 |
| 2 | 0.14103 | 0.45482 | 38 | −0.01465 |
| 3 | 0.45482 | 0.82335 | 34 | 0.02832 |
| 4 | 0.82335 | 1.26989 | 30 | 0.08398 |
| 5 | 1.26989 | 1.83683 | 2c | 0.16309 |
| 6 | 1.83683 | 2.61482 | 28 | 0.26270 |
| 7 | 2.61482 | 3.86796 | 24 | 0.58496 |
| 8 | 3.86796 | ∞ | 20 | 1.48535 |

The entities of FIG. 20 are calculated according to their equivalents of the G.722 low-band ADPCM subband encoder:

$$s_{Lz}(n) = \sum_{i=1}^{6} b_{L,i}(n-1)\cdot e_L(n-i), \tag{43}$$

$$s_{LP}(n) = \sum_{i=1}^{2} a_{L,i}(n-1)\cdot x_L(n-i), \tag{44}$$

$$s_L(n) = s_{Lp}(n) + s_{Lz}(n), \tag{45}$$

$$e_L(n) = x_L(n) - s_L(n), \text{ and} \tag{46}$$

$$p_{Lt}(n) = s_{Lz}(n) + e_L(n). \tag{47}$$

The adaptive quantizer is updated exactly as specified for a G.722 encoder. The adaptation of the zero and pole sections take place as in the G.722 encoder, as described in clauses 3.6.3 and 3.6.4 of G.722 specification.

Low-band ADPCM decoder 1910 is automatically reset after 60 ms of frame loss, but it may reset adaptively as early as 30 ms into frame loss. During re-encoding of the low-band signal, the properties of the partial reconstructed signal, $p_{Lt}(n)$, are monitored and control the adaptive reset of low-band ADPCM decoder 1910. The sign of $p_{Lt}(n)$ is monitored over the entire loss, and hence is reset to zero at the first lost frame:

$$\mathrm{sgn}[p_{Lt}(n)] = \begin{cases} \mathrm{sgn}[p_{Lt}(n-1)+1 & p_{Lt}(n) > 0 \\ \mathrm{sgn}[p_{Lt}(n-1)] & p_{Lt}(n) = 0 \\ \mathrm{sgn}[p_{Lt}(n-1)]-1 & p_{Lt}(n) < 0. \end{cases} \tag{48}$$

The property of $p_{Lt}(n)$ compared to a constant signal is monitored on a frame basis for lost frames, and hence the property (cnst[ ]) is reset to zero at the beginning of every lost frame. It is updated as $$cnst[p_{Lt}(n)] = \begin{cases} cnst[p_{Lt}(n-1)]+1 & p_{Lt}(n) = p_{Lt}(n-1) \\ cnst[p_{Lt}(n-1)] & p_{Lt}(n) \neq p_{Lt}(n-1). \end{cases} \tag{49}$$

At the end of lost frame 3 through 5 low-band decoder is reset if the following condition is satisfied:

$$\left|\frac{\mathrm{sgn}[p_{Lt}(n)]}{N_{lost}}\right| > 36 \text{ OR } cnst[p_{Lt}(n)] > 40, \tag{50}$$

where $N_{lost}$ is the number of lost frames, i.e. 3, 4, or 5.

c. Re-Encoding of High-Band Signal

The high-band signal $x_H(n)$ is encoded with a simplified high-band ADPCM encoder. A block diagram of the simplified high-band ADPCM encoder 2100 is shown in FIG. 21. As can be seen in FIG. 21, the adaptive quantizer of a normal high-band ADPCM encoder has been eliminated as the algorithm overwrites the log scale factor at the first received frame with a moving average prior to the loss, and hence, does not need the high-band re-encoded log scale factor. The quantized prediction error of high-band ADPCM encoder 2100 is substituted with the unquantized prediction error.

The entities of FIG. 21 are calculated according to their equivalents of the G.722 high-band ADPCM sub-band encoder:

$$s_{Hz}(n) = \sum_{i=1}^{6} b_{H,i}(n-1)\cdot e_H(n-i), \tag{51}$$

$$s_{Hp}(n) = \sum_{i=1}^{2} a_{H,i}(n-1)\cdot x_H(n-i), \tag{52}$$

$$s_H(n) = s_{Hp}(n) + s_{Hz}(n), \tag{53}$$

$$e_H(n) = x_H(n) - s_H(n), \text{ and} \tag{54}$$

$$p_H(n) = s_{HZ}(n) + e_H(n). \tag{55}$$

The adaptation of the zero and pole sections take place as in the G.722 encoder, as described in clauses 3.6.3 and 3.6.4 of the G.722 specification.

Similar to the low-band re-encoding, high-band decoder 1920 is automatically reset after 60 ms of frame loss, but it may reset adaptively as early as 30 ms into frame loss. During re-encoding of the high-band signal, the properties of the partial reconstructed signal, $p_H(n)$, are monitored and control the adaptive reset of high-band ADPCM decoder 1920. The sign of $p_H(n)$ is monitored over the entire loss, and hence is reset to zero at the first lost frame:

$$\mathrm{sgn}[p_H(n)] = \begin{cases} \mathrm{sgn}[p_H(n-1)] + 1 & p_H(n) > 0 \\ \mathrm{sgn}[p_H(n-1)] & p_H(n) = 0 \\ \mathrm{sgn}[p_H(n-1)] - 1 & p_H(n) < 0. \end{cases} \tag{56}$$

The property of $p_H(n)$ compared to a constant signal is monitored on a frame basis for lost frames, and hence the property (const[ ]) is reset to zero at the beginning of every lost frame. It is updated as $$cnst[p_H(n)] = \begin{cases} cnst[p_H(n-1)] + 1 & p_H(n) = p_H(n-1) \\ cnst[p_H(n-1)] & p_H(n) \neq p_H(n-1). \end{cases} \tag{57}$$

At the end of lost frame 3 through 5 high-band decoder is reset if the following condition is satisfied:

$$\left|\frac{\mathrm{sgn}[p_H(n)]}{N_{lost}}\right| > 36 \text{ OR } cnst[p_H(n)] > 40. \tag{58}$$

5. Monitoring Signal Characteristics and their Use for PLC

The following describes functions performed by constrain and control logic 1970 of FIG. 19 to reduce artifacts and distortion at the transition from lost frames to received frames, thereby improving the performance of decoder/PLC system 300 after packet loss.

a. Low-Band Log Scale Factor

Characteristics of the low-band log scale factor, $\nabla_L(n)$, are updated during received frames and used at the first received frame after frame loss to adaptively set the state of the adaptive quantizer for the scale factor. A measure of the stationarity of the low-band log scale factor is derived and used to determine proper resetting of the state.

i. Stationarity of Low-Band Log Scale Factor

The stationarity of the low-band log scale factor, $\nabla_L(n)$, is calculated and updated during received frames. It is based on a first order moving average, $\nabla_{L,m1}(n)$, of $\nabla_L(n)$ with constant leakage:

$$\nabla_{L,m1}(n)=7/8\cdot\nabla_{L,m1}(n-1)+1/8\cdot\nabla_L(n). \tag{59}$$

A measure of the tracking, $\nabla_{L,trck}(n)$, of the first order moving average is calculated as $$\nabla_{L,trck}(n)=127/128\cdot\nabla_{L,trck}(n-1)+1/128\cdot|\nabla_{L,m1}(n)-\nabla_{L,m1}(n-1)|. \tag{60}$$

A second order moving average, $\nabla_{L,m2}(n)$, with adaptive leakage is calculated according to Eq. 61:

$$\nabla_{L,m2}(n) = \begin{cases} 7/8\cdot\nabla_{L,m2}(n-1) + 1/8\cdot\nabla_{L,m1}(n) & \nabla_{L,trck}(n) < 3277 \\ 3/4\cdot\nabla_{L,m2}(n-1) + 1/4\cdot\nabla_{L,m1}(n) & 3277 \le \nabla_{L,trck}(n) < 6554 \\ 1/2\cdot\nabla_{L,m2}(n-1) + 1/2\cdot\nabla_{L,m1}(n) & 6554 \le \nabla_{L,trck}(n) < 9830 \\ \nabla_{L,m2}(n) = \nabla_{L,m1}(n) & 9830 \le \nabla_{L,trck}(n) \end{cases} \tag{61}$$

The stationarity of the low-band log scale factor is measured as a degree of change according to $$\nabla_{L,chng}(n)=127/128\cdot\nabla_{L,chng}(n-1)+1/128\cdot256\cdot|\nabla_{L,m2}(n)-\nabla_{L,m2}(n-1)|. \tag{62}$$

During lost frames there is no update, in other words:

$$\nabla_{L,m1}(n)=\nabla_{L,m1}(n-1)$$

$$\nabla_{L,trck}(n)=\nabla_{L,trck}(n-1)$$

$$\nabla_{L,m2}(n)=\nabla_{L,m2}(n-1)$$

$$\nabla_{L,chng}(n)=\nabla_{L,chng}(n-1). \tag{63}$$

ii. Resetting of Log Scale Factor of the Low-Band Adaptive Quantizer

At the first received frame after frame loss the low-band log scale factor is reset (overwritten) adaptively depending on the stationarity prior to the frame loss:

$$\nabla_L(n-1) \leftarrow \begin{cases} \nabla_{L,m2}(n-1) & \nabla_{L,chng}(n-1) < 6554 \\ \dfrac{\nabla_L(n-1)}{3276}[\nabla_{L,chng}(n-1) - 6554] + \dfrac{\nabla_{L,m2}(n-1)}{3276}[9830 - \nabla_{L,chng}(n-1)] & 6554 \le \nabla_{L,chng}(n-1) \le 9830 \\ \nabla_L(n-1) & 9830 < \nabla_{L,chng}(n-1) \end{cases} \tag{64}$$

b. High-Band Log Scale Factor

Characteristics of the high-band log scale factor, $\nabla_H(n)$, are updated during received frames and used at the received frame after frame loss to set the state of the adaptive quantization scale factor. Furthermore, the characteristics adaptively control the convergence of the high-band log scale factor after frame loss.

i. Moving Average and Stationarity of High-Band Log Scale Factor

The tracking of $\nabla_H(n)$ is calculated according to $$\nabla_{H,trck}(n)=0.97\cdot\nabla_{H,trck}(n-1)+0.03\cdot\lfloor\nabla_{H,m}(n-1)-\nabla_H(n)\rfloor. \tag{65}$$

Based on the tracking, the moving average is calculated with adaptive leakage as $$\nabla_{H,m}(n) = \begin{cases} 255/256\cdot\nabla_{H,m}(n-1)+1/256\cdot\nabla_H(n) & |\nabla_{H,trck}(n)|<1638 \\ 127/128\cdot\nabla_{H,m}(n-1)+1/128\cdot\nabla_H(n) & 1638\le|\nabla_{H,trck}(n)|<3277 \\ 63/64\cdot\nabla_{H,m}(n-1)+1/64\cdot\nabla_H(n) & 3277\le|\nabla_{H,trck}(n)|<4915 \\ 31/32\cdot\nabla_{H,m}(n-1)+1/32\cdot\nabla_H(n) & 4915\le|\nabla_{H,trck}(n)|. \end{cases} \quad (66)$$

The moving average is used for resetting the high-band log scale factor at the first received frame as will be described in a later sub-section.

A measure of the stationarity of the high-band log scale factor is calculated from the mean according to $$\nabla_{H,chng}(n)=127/128\cdot\nabla_{H,chng}(n-1)+1/128\cdot256\cdot|\nabla_{H,m}(n)-\nabla_{H,m}(n-1)|. \quad (67)$$

The measure of stationarity is used to control re-convergence of $\Delta_H(n)$ after frame loss, as will be described in a later sub-section.

During lost frames there is no update, in other words:

$$\nabla_{H,trck}(n)=\nabla_{H,trck}(n-1)$$

$$\nabla_{H,m}(n)=\nabla_{H,m}(n-1)$$

$$\nabla_{H,chng}(n)=\nabla_{H,chng}(n-1). \quad (68)$$

ii. Resetting of Log Scale Factor of the High-Band Adaptive Quantizer

At the first received frame the high-band log scale factor is reset to the running mean of received frames prior to the loss:

$$\nabla_H(n-1)\leftarrow\nabla_{H,m}(n-1). \quad (69)$$

iii. Convergence of Log Scale Factor of the High-Band Adaptive Quantizer

The convergence of the high-band log-scale factor after frame loss is controlled by the measure of stationarity, $\nabla_{H,chng}(n)$, prior to the frame loss. For stationary cases, an adaptive low-pass filter is applied to $\nabla_H(n)$ after packet loss. The low-pass filter is applied over either 0 ms, 40 ms, or 80 ms, during which the degree of low-pass filtering is gradually reduced. The duration in samples, $N_{LP,\nabla_H}$, is determined according to $$N_{LP,\nabla_H} = \begin{cases} 640 & \nabla_{H,chng}<819 \\ 320 & \nabla_{H,chng}<1311 \\ 0 & \nabla_{H,chng}\ge1311. \end{cases} \quad (70)$$

The low-pass filtering is given by $$\nabla_{H,LP}(n)=\alpha_{LP}(n)\nabla_{H,LP}(n-1)+(1-\alpha_{LP}(n))\nabla_H(n), \quad (71)$$

where the coefficient is given by $$\alpha_{LP}(n) = 1-\left(\frac{n+1}{N_{LP,\nabla_H}+1}\right)^2, n=0, 1 \ldots, N_{LP,\nabla_H}-1. \quad (72)$$

Hence, the low-pass filtering reduces sample by sample with the time n. The low-pass filtered log scale factor simply replaces the regular log scale factor during the $N_{LP,\nabla_H}$ off samples.

c. Low-Band Pole Section

An entity referred to as the stability margin (of the pole section) is updated during received frames for the low-band ADPCM decoder and used to constrain the pole section following frame loss.

i. Stability Margin of Low-Band Pole Section

The stability margin of the low-band pole section is defined as $$\beta_L(n)=1-|a_{L,1}(n)|-a_{L,2}(n), \quad (73)$$

where $a_{L,1}(n)$ and $a_{L,2}(n)$ are the two pole coefficients. A moving average of the stability margin is updated according to $$\beta_{L,MA}(n)=15/16\cdot\beta_{L,MA}(n-1)+1/16\cdot\beta_L(n) \quad (74)$$

during received frames. During lost frames the moving average is not updated:

$$\beta_{L,MA}(n)=\beta_{L,MA}(n-1). \quad (75)$$

ii. Constraint on Low-Band Pole Section

During regular G.722 low-band (and high-band) ADPCM encoding and decoding a minimum stability margin of $\beta_{L,min}=1/16$ is maintained. During the first 40 ms after a frame loss, an increased minimum stability margin is maintained for the low-band ADPCM decoder. It is a function of both the time since the frame loss and the moving average of the stability margin.

For the first three 10 ms frames, a minimum stability margin of $$\beta_{L,min}=\min\{3/16,\beta_{L,MA}(n-1)\} \quad (76)$$

is set at the frame boundary and enforced throughout the frame. At the frame boundary into the fourth 10 ms frame, a minimum stability margin of $$\beta_{L,min} = \min\left\{2/16, \frac{1/16+\beta_{L,MA}(n-1)}{2}\right\} \quad (77)$$

is enforced, while the regular minimum stability margin of $\beta_{L,min}=1/16$ is enforced for all other frames.

d. High-Band Partial Reconstructed and Reconstructed Signals

During all frames, both lost and received, high-pass filtered versions of the high-band partial reconstructed signal, $p_H(n)$, and reconstructed signal, $r_H(n)$, are maintained:

$$p_{H,HP}(n)=0.97[p_H(n)-p_H(n-1)+p_{H,HP}(n-1)],\text{and} \quad (78)$$

$$r_{H,HP}(n)=0.97[r_H(n)-r_H(n-1)+r_{H,HP}(n-1)]. \quad (79)$$

This corresponds to a 3 dB cut-off of about 40 Hz, basically DC removal.

During the first 40 ms after frame loss the regular partial reconstructed signal and regular constructed signal are substituted with their respective high-pass filtered versions for the purpose of high-band pole section adaptation and high-band reconstructed output, respectively.

6. Time Lag Computation

The re-phasing and time-warping techniques discussed herein require the number of samples that the lost frame concealment waveform $x_{PLC}(j)$ and the signal in the first received frame are misaligned.

a. Low Complexity Estimate of the Lower Sub-Band Reconstructed Signal

The signal used in the first received frame for computation of the time lag is obtained by filtering the lower sub-band truncated difference signal, $d_{Lt}(n)$ (3-11 of Rec. G.722) with the pole-zero filter coefficients ($a_{Lpwe,i}(159)$, $b_{Lpwe,i}(159)$) and other required state information obtained from $STATE_{159}$:

$$r_{Le}(n) = \sum_{i=1}^{2} a_{Lpwe,i}(159)\cdot r_{Le}(n-i) + \sum_{i=1}^{6} b_{Lpwe,i}(159)\cdot d_{Lt}(n-i) + d_{Lt}(n), \quad n = 0, 1, \ldots, 79. \tag{80}$$

This function is performed by block 1820 of FIG. 18.

b. Determination of Re-Phasing and Time Warping Requirement

If the last received frame is unvoiced, as indicated by the value of merit, the time lag $T_L$ is set to zero:

$$\text{IF merit} \geqq MLO, T_L = 0. \tag{81}$$

Additionally, if the first received frame is unvoiced, as indicated by the normalized 1st autocorrelation coefficient $$r(1) = \frac{\sum_{n=0}^{78} r_{Le}(n)\cdot r_{Le}(n)}{\sum_{n=0}^{78} r_{Le}(n)\cdot r_{Le}(n+1)}, \tag{82}$$

the time lag is set to zero:

$$\text{IF } r(1) < 0.125, T_L = 0. \tag{83}$$

Otherwise, the time lag is computed as explained in the following section. The calculation of the time lag is performed by block 1850 of FIG. 18.

c. Computation of the Time Lag

The computation of the time lag involves the following steps: (1) generation of the extrapolated signal, (2) coarse time lag search, and (3) refined time lag search. These steps are described in the following sub-sections.

i. Generation of the Extrapolated Signal

The time lag represents the misalignment between $x_{PLC}(j)$ and $r_{Le}(n)$. To compute the misalignment, $x_{PLC}(j)$ is extended into the first received frame and a normalized cross-correlation function is maximized. This sub-section describes how $x_{PLC}(j)$ is extrapolated and specifies the length of signal that is needed. It is assumed that $x_{PLC}(j)$ is copied into the $x_{out}(j)$ buffer. Since this is a Type 5 frame (first received frame), the assumed correspondence is:

$$x_{out}(j-160) = x_{PLC}(j), j = 0, 1, \ldots, 159 \tag{84}$$

The range over which the correlation is searched is given by:

$$\Delta_{TL} = \min(\lfloor ppfe\cdot 0.5 + 0.5\rfloor + 3, \Delta_{TLMAX}), \tag{85}$$

where $\Delta_{TLMAX} = 28$ and ppfe is the pitch period for periodic waveform extrapolation used in the generation of $x_{PLC}(j)$. The window size (at 16 kHz sampling) for the lag search is given by:

$$LSW_{16k} = \begin{cases} 80 & \lfloor ppfe\cdot 1.5 + 0.5\rfloor < 80 \\ 160 & \lfloor ppfe\cdot 1.5 + 0.5\rfloor > 160 \\ \lfloor ppfe\cdot 1.5 + 0.5\rfloor & \text{otherwise.} \end{cases} \tag{86}$$

It is useful to specify the lag search window, LSW, at 8 kHz sampling as:

$$LSW = \lfloor LSW_{16k}\cdot 0.5\rfloor \tag{87}$$

Given the above, the total length of the extrapolated signal that needs to be derived from $x_{PLC}(j)$ is given by:

$$L = 2\cdot(LSW + \Delta_{TL}). \tag{88}$$

The starting position of the extrapolated signal in relation to the first sample in the received frame is:

$$D = 12 - \Delta_{TL}. \tag{89}$$

The extrapolated signal es(j) is constructed according to the following:

```
If D<0
    es(j) = x_out(D + j)                    j = 0,1,...,−D − 1
    If (L + D ≦ ppfe)
        es(j) = x_out(−ppfe + D + j)        j = − D ,− D + 1,..., L − 1
    Else
        es(j) = x_out(−ppfe + D + j)        j = −D,−D + 1,..., ppfe −D − 1
        es(j) = es(j − ppfe)                j = ppfe − D, ppfe − D + 1,...,L−1
Else
    ovs = ppfe · ⌈D / ppfe⌉ − D
    If (ovs ≧ L)
        es(j) = x_out(−ovs + j)             j = 0,1,...,L − 1
    Else
        If (ovs > 0)
            es(j) = x_out(−ovs + j)         j = 0,1,...,ovs − 1
        If (L − ovs ≦ ppfe)
            es(j) = x_out(−ovs − ppfe + j)  j = ovs,ovs + 1,...,L − 1
        Else
            es(j) = x_out(−ovs − ppfe + j)  j = ovs,ovs + 1,...,ovs + ppfe − 1
            es(j) = es(j − ppfe)            j = ovs + ppfe,ovs + ppfe + 1,..., L − 1 .
```

ii. Coarse Time Lag Search

A coarsely estimated time lag, $T_{LSUB}$, is first computed by searching for the peak of the sub-sampled normalized cross-correlation function $R_{SUB}(k)$:

$$R_{SUB}(k) = \frac{\sum_{i=0}^{LSW/2-1} es(4i-k+\Delta_{TL})\cdot r_{Le}(2i)}{\sqrt{\sum_{i=0}^{LSW/2-1} es^2(4i-k+\Delta_{TL}) \sum_{i=0}^{LSW-1} r_{Le}^2(2i)}}, \quad (90)$$

$$k = -\Delta_{TL}, -\Delta_{TL}+4, -\Delta_{TL}+8, \ldots, \Delta_{TL}$$

To avoid searching out of bounds during refinement, $T_{LSUB}$ may be adjusted as follows:

$$\text{If}(T_{LSUB}>\Delta_{TLMAX}-4)T_{LSUB}=\Delta_{TLMAX}-4 \quad (91)$$

$$\text{If}(T_{LSUB}<-\Delta_{TLMAX}+4)T_{LSUB}=-\Delta_{TLMAX}+4. \quad (92)$$

iii. Refined Time Lag Search

The search is then refined to give the time lag, $T_L$, by searching for the peak of R(k) given by:

$$R(k) = \frac{\sum_{i=0}^{LSW-1} es(2i-k+\Delta_{TL})\cdot r_{Le}(i)}{\sqrt{\sum_{i=0}^{LSW-1} es^2(2i-k+\Delta_{TL}) \sum_{i=0}^{LSW-1} r_{Le}^2(i)}}, \quad (93)$$

$$k = -4+T_{LSUB}, -2+T_{LSUB}, \ldots, 4+T_{LSUB}.$$

Finally, the following conditions are checked:

$$\text{If} \sum_{i=0}^{LSW-1} r_{Le}^2(i) = 0 \quad (94)$$

$$\text{Or} \sum_{i=0}^{LSW-1} es(2i-T_L+\Delta_{TL})\cdot r_{Le}(i) \le 0.25\cdot\sqrt{\sum_{i=0}^{LSW-1} r_{Le}^2(i)} \quad (95)$$

$$\text{Or } (T_L > \Delta_{TLMAX}-2) \,||\, (T_L < -\Delta_{TLMAX}+2) \quad (96)$$
$$\text{Then } T_L = 0.$$

7. Re-Phasing

Re-phasing is the process of setting the internal states to a point in time where the lost frame concealment waveform $x_{PLC}(j)$ is in-phase with the last input signal sample immediately before the first received frame. The re-phasing can be broken down into the following steps: (1) store intermediate G.722 states during re-encoding of lost frames, (2) adjust re-encoding according to the time lag, and (3) update QMF synthesis filter memory. The following sub-sections will now describe these steps in more detail. Re-phasing is performed by block 1810 of FIG. 18.

a. Storage of Intermediate G.722 States During Re-Encoding

As described elsewhere herein, the reconstructed signal $x_{PLC}(j)$ is re-encoded during lost frames to update the G.722 decoder state memory. Let $STATE_j$ be the G.722 state and PLC state after re-encoding the jth sample of $x_{PLC}(j)$. Then in addition to the G.722 state at the frame boundary that would normally be maintained (i.e. $STATE_{159}$), the $STATE_{159-\Delta_{TLMAX}}$ is also stored. To facilitate the re-phasing, the sub-band signals $$x_L(n), x_H(n) n=69-\Delta_{TLMAX}/2 \ldots 79+\Delta_{TLMAX}/2$$

are also stored.

b. Adjustment of the Re-Encoding According to the Time Lag

Depending on the sign of the time lag, the procedure for adjustment of the re-encoding is as follows:

If $\Delta_{TL}>0$

1. Restore the G.722 state and PLC state to $STATE_{159-\Delta_{TLMAX}}$.
2. Re-encode $x_L(n)$, $x_H(n)$ $n=80-\Delta_{TLMAX}/2 \ldots 79-\Delta_{TL}/2$ in the manner previously described.

If $\Delta_{TL}<0$

1. Restore the G.722 state and PLC state to $STATE_{159}$
2. Re-encode $x_L(n)$, $x_H(n)$ $n=80 \ldots 79+|\Delta_{TL}/2|$ in the manner previously described.

Note that to facilitate re-encoding of $x_L(n)$ and $x_H(n)$ up to $n=79+|\Delta_{TL}/2|$, samples up to $\Delta_{TLMAX}+182$ of $x_{PLC}(j)$ are required.

c. Update of QMF Synthesis Filter Memory

At the first received frame the QMF synthesis filter memory needs to be calculated since the QMF synthesis filter bank is inactive during lost frames due to the PLC taking place in the 16 kHz output speech domain. Time-wise, the memory would generally correspond to the last samples of the last lost frame. However, the re-phasing needs to be taken into account. According to G.722, the QMF synthesis filter memory is given by $$x_d(i)=r_L(n-i)-r_H(n-i),\ i=1, 2, \ldots, 11, \text{ and} \quad (97)$$

$$x_s(i)=r_L(n-i)+r_H(n-i),\ i=1, 2, \ldots, 11 \quad (98)$$

as the first two output samples of the first received frame is calculated as $$x_{out}(j) = 2\sum_{i=0}^{11} h_{2i}\cdot x_d(i), \text{ and} \quad (99)$$

$$x_{out}(j+1) = 2\sum_{i=0}^{11} h_{2i+1}\cdot x_s(i). \quad (100)$$

The filter memory, i.e. $x_d(i)$ and $x_s(i)$, i=1, 2, . . . , 11, is calculated from the last 11 samples of the re-phased input to the simplified sub-band ADPCM encoders during re-encoding, $x_L(n)$ and $x_H(n)$, $n=69-\Delta_{TL}/2, 69-\Delta_{TL}/2+1, \ldots, 79-\Delta_{TL}/2$, i.e. the last samples up till the re-phasing point:

$$x_d(i)=x_L(80-\Delta_{TL}/2-i)-x_H(80-\Delta_{TL}/2-i),\ i=1, 2, \ldots, 11, \text{ and} \quad (101)$$

$$x_s(i)=x_L(80-\Delta_{TL}/2-i)+x_H(80-\Delta_{TL}/2-i),\ i=1, 2, \ldots, 11, \quad (102)$$

where $x_L(n)$ and $x_H(n)$ have been stored in state memory during the lost frame.

8. Time-Warping

Time-warping is the process of stretching or shrinking a signal along the time axis. The following describes how $x_{out}(j)$ is time-warped to improve alignment with the periodic waveform extrapolated signal $x_{PLC}(j)$. The algorithm is only executed if $T_L \neq 0$. Time-warping is performed by block 1860 of FIG. 18.

a. Time Lag Refinement

The time lag, $T_L$, is refined for time-warping by maximizing the cross-correlation in the overlap-add window. The estimated starting position of the overlap-add window within the first received frame based on $T_L$ is given by:

$$SP_{OLA}=\max(0, \text{MIN_}UNSTBL-T_L), \quad (103)$$

where MIN_UNSTBL=16.

The starting position of the extrapolated signal in relation to $SP_{OLA}$ is given by:

$$D_{ref}=SP_{OLA}-T_L-RSR, \tag{104}$$

where RSR=4 is the refinement search range.

The required length of the extrapolated signal is given by:

$$L_{ref}=OLALG+\mathrm{RSR}. \tag{105}$$

An extrapolated signal, $es_{tw}(j)$, is obtained using the same procedures as described above in Section D.6.c.i, except LSW=OLALG, $L=L_{ref}$, and $D=D_{ref}$.

A refinement lag, $T_{ref}$, is computed by searching for the peak of the following:

$$R(k)=\frac{\sum_{i=0}^{OLALG} es_{tw}(i-k+RSR)\cdot x_{out}(i+SP_{OLA})}{\sqrt{\sum_{i=0}^{OLALG-1} es_{tw}^2(i-k+RSR)\sum_{i=0}^{OLALG-1} x_{out}^2(i+SP_{OLA})}}, \tag{106}$$

$$k=-RSR,\ -RSR+1\ \ldots\ ,\ RSR.$$

The final time lag used for time-warping is then obtained by:

$$T_{Lwarp}=T_L+T_{ref}. \tag{107}$$

b. Computation of Time-Warped $x_{out}(j)$ Signal

The signal $x_{out}(j)$ is time-warped by $T_{Lwarp}$ samples to form the signal $x_{warp}(j)$ which is later overlap-added with the waveform extrapolated signal $es_{ola}(j)$. Three cases, depending on the value of $T_{Lwarp}$, are illustrated in timelines 2200, 2220 and 2240 of FIG. 22A, FIG. 22B and FIG. 22C, respectively. In FIG. 22A, $T_{Lwarp}<0$ and $x_{out}(j)$ undergoes shrinking or compression. The first MIN_UNSTBL samples of $x_{out}(j)$ are not used in the warping to create $x_{warp}(j)$ and xstart=MIN_UNSTBL. In FIG. 22B, $0\leqq T_{Lwarp}<$MIN_UNSTBL, and $x_{out}(j)$ is stretched by $T_{Lwarp}$ samples. Again, the first MIN_UNSTBL samples of $x_{out}(j)$ are not used and xstart=MIN_UNSTBL. In FIG. 22C, $T_{Lwarp}\geqq$MIN_UNSTBL, and $x_{out}(j)$ is once more stretched by $T_{Lwarp}$ samples. However, the first $T_{Lwarp}$ samples of $x_{out}(j)$ are not needed in this case since an extra $T_{Lwarp}$ samples will be created during warping; therefore, xstart=$T_{Lwarp}$.

In each case, the number of samples per add/drop is given by:

$$spad=\frac{(160-xstart)}{|T_{Lwarp}|}. \tag{108}$$

The warping is implemented via a piece-wise single sample shift and triangular overlap-add, starting from $x_{out}$[xstart]. To perform shrinking, a sample is periodically dropped. From the point of sample drop, the original signal and the signal shifted left (due to the drop) are overlap-added. To perform stretching, a sample is periodically repeated. From the point of sample repeat, the original signal and the signal shifted to the right (due to the sample repeat) are overlap-added. The length of the overlap-add window, $L_{olawarp}$, (note: this is different from the OLA region depicted in FIGS. 22A, 22B and 22C) depends on the periodicity of the sample add/drop and is given by:

$$\text{If } T_{Lwarp}<0,\ L_{olawarp}=\frac{(160-xstart-|T_{Lwarp}|)}{|T_{Lwarp}|} \tag{109}$$

$$\text{Else } L_{olawarp}=\lceil spad\rceil$$

$$L_{olawarp}=\min(8,\ L_{olawarp}).$$

The length of the warped input signal, $x_{warp}$ is given by:

$$L_{xwarp}=\min(160,160-\mathrm{MIN_}UNSTBL+T_{Lwarp}). \tag{110}$$

c. Computation of the Waveform Extrapolated Signal

The warped signal $x_{warp}(j)$ and the extrapolated signal $es_{ola}(j)$ are overlap-added in the first received frame as shown in FIGS. 22A, 22B and 22C. The extrapolated signal $es_{ola}(j)$ is generated directly within the $x_{out}(j)$ signal buffer in a two step process according to:

Step 1

$$es_{ola}(j)=x_{out}(j)=ptfe\cdot x_{out}(j-ppfe)j=0,1,\ldots,160-L_{xwarp}+39 \tag{111}$$

Step 2

$$x_{out}(j)=x_{out}(j)\cdot w_i(j)+\mathrm{ring}(j)\cdot w_o(j)j=0,1,\ldots,39, \tag{112}$$

where $w_i(j)$ and $w_o(j)$ are triangular upward and downward ramping overlap-add windows of length 40 and ring(j) is the ringing signal computed in a manner described elsewhere herein.

d. Overlap-Add of Time Warped Signal with the Waveform Extrapolated Signal

The extrapolated signal computed in the preceding paragraph is overlap-added with the warped signal $x_{warp}(j)$ according to:

$$x_{out}(160-L_{xwarp}+j)=x_{out}(160-L_{xwarp}+j)\cdot w_o(j)+x_{warp}(j)\cdot w_i(j),\ j=0,1,\ldots,39. \tag{113}$$

The remaining part of $x_{warp}(j)$ is then simply copied into the signal buffer:

$$x_{out}(160-L_{xwarp}+j)=x_{warp}(j),\ j=40,41,\ldots,L_{xwarp}-1. \tag{114}$$

E. Packet Loss Concealment for a Sub-Band Predictive Coder Based on Extrapolation of Sub-Band Speech Waveforms An alternative embodiment of the present invention is shown as decoder/PLC system 2300 in FIG. 23. Most of the techniques developed for decoder/PLC system 300 as described above can also be used in the second example embodiment as well. The main difference between decoder/PLC system 2300 and decoder/PLC system 300 is that the speech waveform extrapolation is performed in the sub-band speech signal domain rather than the full-band speech signal domain.

As shown in FIG. 23, decoder/PLC system 2300 includes a bit-stream de-multiplexer 2310, a low-band ADPCM decoder 2320, a low-band speech signal synthesizer 2322, a switch 2326, a high-band ADPCM decoder 2330, a high-band speech signal synthesizer 2332, a switch 2336, and a QMF synthesis filter bank 2340. Bit-stream de-multiplexer 2310 is essentially the same as the bit-stream de-multiplexer 210 of FIG. 2, and QMF synthesis filter bank 2340 is essentially the same as QMF synthesis filter bank 240 of FIG. 2.

Like decoder/PLC system 300 of FIG. 3, decoder/PLC system 2300 processes frames in a manner that is dependent on frame type and the same frame types described above in reference to FIG. 5 are used.

During the processing of a Type 1 frame, decoder/PLC system 2300 performs normal G.722 decoding. In this mode of operation, blocks 2310, 2320, 2330, and 2340 of decoder/PLC system 2300 perform exactly the same functions as their counterpart blocks 210, 220, 230, and 240 of conventional G.722 decoder 200, respectively. Specifically, bit-stream demultiplexer 2310 separates the input bit-stream into a low-band bit-stream and a high-band bit-stream. Low-band ADPCM decoder 2320 decodes the low-band bit-stream into a decoded low-band speech signal. Switch 2326 is connected to the upper position marked "Type 1," thus connecting the decoded low-band speech signal to QMF synthesis filter bank 2340. High-band ADPCM decoder 2330 decodes the high-band bit-stream into a decoded high-band speech signal. Switch 2336 is also connected to the upper position marked "Type 1," thus connecting the decoded high-band speech signal to QMF synthesis filter bank 2340. QMF synthesis filter bank 2340 then re-combines the decoded low-band speech signal and the decoded high-band speech signal into the full-band output speech signal.

Hence, during the processing of a Type 1 frame, the decoder/PLC system is equivalent to the decoder 200 of FIG. 2 with one exception—the decoded low-band speech signal is stored in low-band speech signal synthesizer 2322 for possible use in a future lost frame, and likewise the decoded high-band speech signal is stored in high-band speech signal synthesizer 2332 for possible use in a future lost frame. Other state updates and processing in anticipation of performing PLC operations may be performed as well.

During the processing of Type 2, Type 3 and Type 4 frames (lost frames), the decoded speech signal of each sub-band is individually extrapolated from the stored sub-band speech signals associated with previous frames to fill up the waveform gap associated with the current lost frame. This waveform extrapolation is performed by low-band speech signal synthesizer 2322 and high-band speech signal synthesizer 2332. There are many prior-art techniques for performing the waveform extrapolation function of blocks 2322 and 2332. For example, the techniques described in U.S. patent application Ser. No. 11/234,291 to Chen, filed Sep. 26, 2005, and entitled "Packet Loss Concealment for Block-Independent Speech Codecs" may be used, or a modified version of those techniques such as described above in reference to decoder/PLC system 300 of FIG. 3 may be used.

During the processing of a Type 2, Type 3 or Type 4 frame, switches 2326 and 2336 are both at the lower position marked "Type 2-6". Thus, they will connect the synthesized low-band audio signal and the synthesized high-band audio signal to QMF synthesis filter bank 2340, which re-combines them into a synthesized output speech signal for the current lost frame.

Similar to the decoder/PLC system 300, the first few received frames immediately after a bad frame (Type 5 and Type 6 frames) require special handling to minimize the speech quality degradation due to the mismatch of G.722 states and to ensure that there is a smooth transition from the extrapolated speech signal waveform in the last lost frame to the decoded speech signal waveform in the first few good frames after the last bad frame. Thus, during the processing of these frames, switches 2326 and 2336 remain in the lower position marked "Type 2-6," so that the decoded low-band speech signal from low-band ADPCM decoder 2320 can be modified by low-band speech signal synthesizer 2322 prior to being provided to QMF synthesis filter bank 2340 and so that the decoded high-band speech signal from high-band ADPCM decoder 2330 can be modified by high-band speech signal synthesizer 2332 prior to being provided to QMF synthesis filter bank 2340.

Those skilled in the art would appreciate that most of the techniques described in subsections C and D above for the first few frames after a packet loss can readily be applied to this example embodiment for the special handling of the first few frames after a packet loss as well. For example, decoding constraint and control logic (not shown in FIG. 23) may be included in decoder/PLC system 2300 to constrain and control the decoding operations performed by low-band ADPCM decoder 2320 and high-band ADPCM decoder 2330 during the processing of Type 5 and 6 frames in a similar manner to that described above with reference to decoder/PLC system 300. Also, each sub-band speech signal synthesizer 2322 and 2332 may be configured to perform re-phasing and time warping techniques such as those described above in reference to decoder/PLC system 300. Since a full description of these techniques is provided in previous sections, there is no need to repeat the description of those techniques for use in the context of decoder/PLC system 2300.

The primary advantage of decoder/PLC system 2300 as compared to decoder/PLC system 300 is that it has a lower complexity. This is because extrapolating the speech signal in the sub-band domain eliminates the need to employ a QMF analysis filter bank to split the full-band extrapolated speech signal into sub-band speech signals, as is done in the first example embodiment. However, extrapolating the speech signal in the full-band domain has its advantage. This is explained below.

When system 2300 in FIG. 23 extrapolates the high-band speech signal, there are some potential issues. First, if it does not perform periodic waveform extrapolation for the high-band speech signal, then the output speech signal will not preserve the periodic nature of the high-band speech signal that can be present in some highly-periodic voiced signals. On the other hand, if it performs periodic waveform extrapolation for the high-band speech signal, even if it uses the same pitch period as used in the extrapolation of the low-band speech signal to save computation and to ensure that the two sub-band speech signals are using the same pitch period for extrapolation, there is still another problem. When the high-band speech signal is extrapolated periodically, the extrapolated high-band speech signal will be periodic and will have a harmonic structure in its spectrum. In other words, the frequencies of the spectral peaks in the spectrum of the high-band speech signal will be related by integer multiples. However, once this high-band speech signal is re-combined with the low-band speech signal by the synthesis filter bank 2340, the spectrum of the high-band speech signal will be "translated" or shifted to the higher frequency, possibly even with mirror imaging taking place, depending on the QMF synthesis filter bank used. Thus, after such mirror imaging and frequency shifting, there is no guarantee that the spectral peaks in the high band portion of the full-band output speech signal will have frequencies that are still integer multiples of the pitch frequency in the low-band speech signal. This can potentially cause degradation in the output audio quality of highly periodic voiced signals. In contrast, system 300 in FIG. 3 will not have this problem. Since system 300 performs the audio signal extrapolation in the full-band domain, the frequencies of the harmonic peaks in the high band is guaranteed to be integer multiple of the pitch frequency.

In summary, the advantage of decoder/PLC system 300 is that for voiced signals the extrapolated full-band speech signal will preserve the harmonic structure of spectral peaks throughout the entire speech bandwidth. On the other hand, decoder/PLC system 2300 has the advantage of lower complexity, but it may not preserve such harmonic structure in the higher sub-bands.

F. Hardware and Software Implementations

The following description of a general purpose computer system is provided for the sake of completeness. The present invention can be implemented in hardware, or as a combination of software and hardware. Consequently, the invention may be implemented in the environment of a computer system or other processing system. An example of such a computer system 2400 is shown in FIG. 24. In the present invention, all of the decoding and PLC operations described above in Section C, D and E, for example, can execute on one or more distinct computer systems 2400, to implement the various methods of the present invention.

Computer system 2400 includes one or more processors, such as processor 2404. Processor 2404 can be a special purpose or a general purpose digital signal processor. The processor 2404 is connected to a communication infrastructure 2402 (for example, a bus or network). Various software implementations are described in terms of this exemplary computer system. After reading this description, it will become apparent to a person skilled in the relevant art(s) how to implement the invention using other computer systems and/or computer architectures.

Computer system 2400 also includes a main memory 2406, preferably random access memory (RAM), and may also include a secondary memory 2420. The secondary memory 2420 may include, for example, a hard disk drive 2422 and/or a removable storage drive 2424, representing a floppy disk drive, a magnetic tape drive, an optical disk drive, or the like. The removable storage drive 2424 reads from and/or writes to a removable storage unit 2428 in a well known manner. Removable storage unit 2428 represents a floppy disk, magnetic tape, optical disk, or the like, which is read by and written to by removable storage drive 2424. As will be appreciated, the removable storage unit 2428 includes a computer usable storage medium having stored therein computer software and/or data.

In alternative implementations, secondary memory 2420 may include other similar means for allowing computer programs or other instructions to be loaded into computer system 2400. Such means may include, for example, a removable storage unit 2430 and an interface 2426. Examples of such means may include a program cartridge and cartridge interface (such as that found in video game devices), a removable memory chip (such as an EPROM, or PROM) and associated socket, and other removable storage units 2430 and interfaces 2426 which allow software and data to be transferred from the removable storage unit 2430 to computer system 2400.

Computer system 2400 may also include a communications interface 2440. Communications interface 2440 allows software and data to be transferred between computer system 2400 and external devices. Examples of communications interface 2440 may include a modem, a network interface (such as an Ethernet card), a communications port, a PCMCIA slot and card, etc. Software and data transferred via communications interface 2440 are in the form of signals which may be electronic, electromagnetic, optical, or other signals capable of being received by communications interface 2440. These signals are provided to communications interface 2440 via a communications path 2442. Communications path 2442 carries signals and may be implemented using wire or cable, fiber optics, a phone line, a cellular phone link, an RF link and other communications channels.

As used herein, the terms "computer program medium" and "computer usable medium" are used to generally refer to media such as removable storage units 2428 and 2430, a hard disk installed in hard disk drive 2422, and signals received by communications interface 2440. These computer program products are means for providing software to computer system 2400.

Computer programs (also called computer control logic) are stored in main memory 2406 and/or secondary memory 2420. Computer programs may also be received via communications interface 2440. Such computer programs, when executed, enable the computer system 2400 to implement the present invention as discussed herein. In particular, the computer programs, when executed, enable the processor 2400 to implement the processes of the present invention, such as any of the methods described herein. Accordingly, such computer programs represent controllers of the computer system 2400. Where the invention is implemented using software, the software may be stored in a computer program product and loaded into computer system 2400 using removable storage drive 2424, interface 2426, or communications interface 2440.

In another embodiment, features of the invention are implemented primarily in hardware using, for example, hardware components such as application-specific integrated circuits (ASICs) and gate arrays. Implementation of a hardware state machine so as to perform the functions described herein will also be apparent to persons skilled in the relevant art(s).

F. Conclusion

While various embodiments of the present invention have been described above, it should be understood that they have been presented by way of example, and not limitation. It will be apparent to persons skilled in the relevant art that various changes in form and detail can be made therein without departing from the spirit and scope of the invention. Thus, the breadth and scope of the present invention should not be limited by any of the above-described exemplary embodiments, but should be defined only in accordance with the following claims and their equivalents.

What is claimed is:

1. A method for generating an output audio signal corresponding to an encoded audio signal represented by a series of frames, comprising:

obtaining a first decoded audio signal corresponding to one or more received frames that precede one or more lost frames in the series of frames;

generating a concealment signal based on the first decoded audio signal;

obtaining a second decoded audio signal corresponding to one or more received frames that follow the lost frame(s) in the series of frames;

calculating a time lag between the concealment signal and the second decoded audio signal, the time lag representing a phase difference between the concealment signal and the second decoded audio signal; and time-warping the second decoded audio signal based on the time lag, wherein time-warping the second decoded audio signal comprises stretching or shrinking the second decoded audio signal in the time domain.

2. The method of claim 1, wherein calculating the time lag between the concealment signal and the second decoded audio signal comprises maximizing a correlation between the concealment signal and the second decoded audio signal.

3. The method of claim 2, wherein maximizing the correlation between the concealment signal and the second decoded audio signal comprises searching for a peak of a normalized cross-correlation function R(k) between the concealment signal and the second decoded audio signal for a time lag range of ±MAXOS around zero:

$$R(k) = \frac{\sum_{i=0}^{LSW-1} es(i-k)\cdot x(i)}{\sqrt{\sum_{i=0}^{LSW-1} es^2(i-k) \sum_{i=0}^{LSW-1} x^2(i)}},$$

$$k = -MAXOS, \ldots, MAXOS$$

where es is the concealment signal, x is the second decoded audio signal, MAXOS is a maximum allowed offset, LSW is a length of a lag search window, and i=0 represents a first sample in the lag search window.

4. The method of claim 1, wherein calculating the time lag between the concealment signal and the second decoded audio signal comprises:

searching for a first peak of a normalized cross-correlation function between the concealment signal and the second decoded audio signal using a first lag search range and a first lag search window to identify a coarse time lag, wherein the first lag search range specifies a range over which a starting point of the concealment signal is shifted during the search and the first lag search window specifies a number of samples over which the normalized cross-correlation function is computed; and searching for a second peak of a normalized cross-correlation function between the concealment signal and the second decoded audio signal using a second lag search range and a second lag search window to identify a refined time lag, wherein the second lag search range is smaller than the first lag search range.

5. The method of claim 4, wherein searching for the first peak of the normalized cross-correlation function between the concealment signal and the second decoded audio signal comprises searching for a peak of a normalized cross-correlation function between down-sampled representations of the concealment signal and the second decoded audio signal.

6. The method of claim 4, wherein the second lag search window is smaller than the first lag search window.

7. The method of claim 4, wherein searching for the second peak of the normalized cross-correlation function between the concealment signal and the second decoded audio signal using the second lag search range and the second lag search window comprises aligning the second lag search window with a center of an overlap add region of the second decoded audio signal.

8. The method of claim 1, wherein calculating the time lag between the concealment signal and the second decoded audio signal comprises:

partially decoding the received frame(s) that follow the lost frame(s) in the series of frames to generate an approximation of the second decoded audio signal; and calculating a time lag between the concealment signal and the approximation of the second decoded audio signal.

9. The method of claim 8, wherein partially decoding the received frame(s) that follow the lost frame(s) in the series of frames comprises:

decoding a low-band bit stream associated with the received frame(s) that follow the lost frame(s) in the series of frames in a low-band adaptive differential pulse code modulation (ADPCM) decoder to generate a low-band reconstructed signal; and using the low-band reconstructed signal as the approximation of the second decoded audio signal.

10. The method of claim 9, wherein decoding the low-band bit stream associated with the received frame(s) that follow the lost frame(s) in the series of frames in the low-band ADPCM decoder comprises fixing coefficients of a two-pole, six-zero adaptive filter during the decoding of the low-band bit stream.

11. The method of claim 1, further comprising:

overlap-adding the time-warped second decoded audio signal and a portion of the concealment signal.

12. The method of claim 1, wherein overlap-adding the time-warped second decoded audio signal and the portion of the concealment signal comprises:

moving an overlap-add region associated with the time-warped second decoded audio signal forward in time to account for a period of decoder instability.

13. The method of claim 1, wherein stretching the second decoded audio signal in the time domain comprises periodically performing the following steps:

repeating a sample of the second decoded audio signal; and overlap-adding a portion of the second decoded audio signal up to and including the repeated sample and a portion of the second decoded audio signal following the repeated sample.

14. The method of claim 1, wherein shrinking the second decoded audio signal in the time domain comprises periodically performing the following steps:

dropping a sample from the second decoded audio signal; and overlap-adding a portion of the second decoded audio signal prior to the dropped sample and a portion of the second decoded audio signal following the dropped sample.

15. The method of claim 1, further comprising:

time-warping a portion of the concealment signal based on the time lag, wherein time-warping the portion of the concealment signal comprises stretching or shrinking the portion of the concealment signal in the time domain.

16. A system, comprising:

a decoder configured to obtain a first decoded audio signal corresponding to one or more received frames that precede one or more lost frames in a series of frames of an encoded audio signal and a second decoded audio signal corresponding to one or more received frames that follow the lost frame(s) in the series of frames;

an audio signal synthesizer configured to generate a concealment signal based on the first decoded audio signal; and time-warping logic configured to calculate a time lag between the concealment signal and the second decoded audio signal and to time-warp the second decoded audio signal based on the time lag;

wherein the time lag represents a phase difference between the concealment signal and the second decoded audio signal and wherein time-warping the second decoded audio signal comprises stretching or shrinking the second decoded audio signal in the time domain.

17. The system of claim 16, wherein the time-warping logic is configured to calculate the time lag between the concealment signal and the second decoded audio signal by maximizing a correlation between the concealment signal and the second decoded audio signal.

18. The system of claim 17, wherein the time-warping logic is configured to maximize the correlation between the concealment signal and the second decoded audio signal by searching for a peak of a normalized cross-correlation function R(k) between the concealment signal and the second decoded audio signal for a time lag range of ±MAXOS around zero:

$$R(k) = \frac{\sum_{i=0}^{LSW-1} es(i-k)\cdot x(i)}{\sqrt{\sum_{i=0}^{LSW-1} es^2(i-k) \sum_{i=0}^{LSW-1} x^2(i)}},$$

$$k = -MAXOS, \ldots, MAXOS$$

where es is the concealment signal, x is the second decoded audio signal, MAXOS is a maximum allowed offset, LSW is a length of a lag search window, and i=0 represents a first sample in the lag search window.

19. The system of claim 16, wherein the time-warping logic is configured to search for a first peak of a normalized cross-correlation function between the concealment signal and the second decoded audio signal using a first lag search range and a first lag search window to identify a coarse time lag, wherein the first lag search range specifies a range over which a starting point of the concealment signal is shifted during the search and the first lag search window specifies a number of samples over which the normalized cross-correlation function is computed, and to search for a second peak of a normalized cross-correlation function between the concealment signal and the second decoded audio signal using a second lag search range and a second lag search window to identify a refined time lag, wherein the second lag search range is smaller than the first lag search range.

20. The system of claim 19, wherein the time-warping logic is configured to search for the first peak of the normalized cross-correlation function between the concealment signal and the second decoded audio signal by searching for a peak of a normalized cross-correlation function between down-sampled representations of the concealment signal and the second decoded audio signal.

21. The system of claim 19, wherein the second lag search window is smaller than the first lag search window.

22. The system of claim 19, wherein the time-warping logic is configured to align the second lag search window with a center of an overlap add region of the second decoded audio signal.

23. The system of claim 16, wherein the time-warping logic is configured to partially decode the received frame(s) that follow the lost frame(s) in the series of frames to generate an approximation of the second decoded audio signal and to calculate a time lag between the concealment signal and the approximation of the second decoded audio signal.

24. The system of claim 23, wherein the time-warping logic is configured to partially decode the received frame(s) that follow the lost frame(s) in the series of frames by decoding a low-band bit stream associated with the received frame(s) that follow the lost frame(s) in the series of frames in a low-band adaptive differential pulse code modulation (ADPCM) decoder to generate a low-band reconstructed signal and by using the low-band reconstructed signal as the approximation of the second decoded audio signal.

25. The system of claim 24, wherein the time-warping logic is configured to fix coefficients of a two-pole, six-zero adaptive filter during the decoding of the low-band bit stream.

26. The system of claim 16, wherein the time-warping logic is further configured to overlap-add the time-warped second decoded audio signal and a portion of the concealment signal.

27. The system of claim 16, wherein the time-warping logic is further configured to move an overlap-add region associated with the time-warped second decoded audio signal forward in time to account for a period of decoder instability.

28. The system of claim 16, wherein the time-warping logic is configured to stretch the second decoded audio signal in the time domain by periodically performing the following steps: repeating a sample of the second decoded audio signal and overlap-adding a portion of the second decoded audio signal up to and including the repeated sample and a portion of the second decoded audio signal following the repeated sample.

29. The system of claim 16, wherein the time-warping logic is configured to shrink the second decoded audio signal in the time domain by periodically performing the following steps: dropping a sample from the second decoded audio signal and overlap-adding a portion of the second decoded audio signal prior to the dropped sample and a portion of the second decoded audio signal following the dropped sample.

30. The system of claim 16, wherein the time-warping logic is further configured to time-warp a portion of the concealment signal based on the time lag, wherein time-warping the portion of the concealment signal comprises stretching or shrinking the waveform segment in the time domain.

31. A computer program product comprising a computer-readable medium having computer program logic recorded thereon for enabling a processor to generate an output audio signal corresponding to an encoded audio signal represented by a series of frames, the computer program logic comprising:

first means for enabling the processor to obtain a first decoded audio signal corresponding to one or more received frames that precede one or more lost frames in the series of frame;

second means for enabling the processor to generate a concealment signal based on the first decoded audio signal;

third means for enabling the processor to obtain a second decoded audio signal corresponding to one or more received frames that following the lost frame(s) in the series of frames;

fourth means for enabling the processor to calculate a time lag between the concealment signal and the second decoded audio signal, the time lag representing a phase difference between the concealment signal and the second decoded audio signal; and time-warping the second decoded audio signal based on the time lag, wherein time-warping the second decoded audio signal comprises stretching or shrinking the second decoded audio signal in the time domain.

* * * * *